US011242631B2

(12) United States Patent
Yu et al.

(10) Patent No.: US 11,242,631 B2
(45) Date of Patent: Feb. 8, 2022

(54) LAUNDRY PROCESSING APPARATUS

(71) Applicant: LG ELECTRONICS INC., Seoul (KR)

(72) Inventors: Insik Yu, Seoul (KR); Dongcheol Kim, Seoul (KR); Youngjong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 220 days.

(21) Appl. No.: 16/474,682

(22) PCT Filed: Dec. 29, 2017

(86) PCT No.: PCT/KR2017/015731
§ 371 (c)(1),
(2) Date: Jun. 28, 2019

(87) PCT Pub. No.: WO2018/124813
PCT Pub. Date: Jul. 5, 2018

(65) Prior Publication Data

US 2019/0368102 A1 Dec. 5, 2019

(30) Foreign Application Priority Data

Dec. 29, 2016 (KR) ..... 10-2016-0182208
Dec. 29, 2016 (KR) ..... 10-2016-0182209
Dec. 29, 2016 (KR) ..... 10-2016-0182210

(51) Int. Cl.
*D06F 37/40* (2006.01)
*D06F 17/08* (2006.01)
*D06F 37/14* (2006.01)
*D06F 37/20* (2006.01)
(Continued)

(52) U.S. Cl.
CPC ..... *D06F 17/08* (2013.01); *D06F 37/14* (2013.01); *D06F 37/206* (2013.01); *D06F 37/40* (2013.01); *D06F 39/08* (2013.01); *D06F 37/24* (2013.01)

(58) Field of Classification Search
CPC ..... D06F 37/14; D06F 37/206; D06F 37/40; D06F 39/083
See application file for complete search history.

(56) References Cited

U.S. PATENT DOCUMENTS

2015/0184330 A1* 7/2015 Lee ..... D06F 37/30 68/23.6

FOREIGN PATENT DOCUMENTS

CN 1173563 A 2/1998
CN 201021477 Y * 2/2008
(Continued)

OTHER PUBLICATIONS

Machine English Translation of Description of JPH 05131079 A (Hirochika) (Year: 1993).*
(Continued)

*Primary Examiner* — Joseph L. Perrin
*Assistant Examiner* — Irina Graf
(74) *Attorney, Agent, or Firm* — Finnegan, Henderson, Farabow, Garrett & Dunner, LLP

(57) ABSTRACT

A laundry processing apparatus includes: an outer tub for accommodating washing water therein; an inner tub disposed inside the outer tub and containing laundry therein; a pulsator provided in a lower portion of the inner tub; a blade provided below the pulsator; a driving motor disposed outside the outer tub for rotating a washing shaft; a pulsator connecting shaft penetrating a lower side surface of the outer tub for rotating the pulsator; a blade connecting shaft which also penetrates a lower side surface of the outer tub for
(Continued)

rotating the blade; and a gear module disposed outside the outer tub for transmitting a rotational force of the washing shaft to the pulsator connecting shaft and the blade connecting shaft respectively.

16 Claims, 35 Drawing Sheets

(51) Int. Cl.
*D06F 39/08* (2006.01)
*D06F 37/24* (2006.01)

(56) References Cited

FOREIGN PATENT DOCUMENTS

| | | | |
|---|---|---|---|
| CN | 101210372 | A | 7/2008 |
| CN | 101338507 | A | 1/2009 |
| CN | 102086580 | A | 6/2011 |
| CN | 102720032 | A | 10/2012 |
| JP | H05131079 | A | 5/1993 |
| JP | H1080593 | A | 3/1998 |
| JP | 4873066 | | 2/2012 |
| JP | 2014-83383 | | 5/2014 |
| JP | 2015-29546 | | 2/2015 |
| KR | 10-2015-0126330 | | 11/2015 |
| KR | 10-2016-0041614 | | 4/2016 |

OTHER PUBLICATIONS

EP Search Report dated Jun. 8, 2020 on European Patent Application No. 17886496.3.
PCT Search Report dated Apr. 26, 2018 for PCT International Patent Application No. PCT/KR2017/015731.
Chinese Office Action dated Nov. 3, 2020 on Chinese Application No. 201780087703.4.

* cited by examiner

LAUNDRY PROCESSING APPARATUS

CROSS-REFERENCE TO RELATED APPLICATIONS

This application is a U.S. National Phase entry under 35 U.S.C. § 371 from PCT International Application No. PCT/KR2017/015731, filed Dec. 29, 2017, which claims priority to Korean Application Nos. 10-2016-0182208, 10-2016-0182209, and 10-2016-0182210 all filed Dec. 29, 2016, the contents of all of which are incorporated herein by reference in their entireties.

TECHNICAL FIELD

The present invention relates to a laundry processing apparatus for circulating washing water by pumping the washing water to an upper portion of a washing tub using a centrifugal force.

BACKGROUND ART

Generally, a top loading laundry processing apparatus refers to a laundry processing apparatus for loading and unloading laundry over a washing tub. The most common form of top loading laundry processing apparatus is a pulsator type laundry processing apparatus.

The pulsator-type laundry processing apparatus washes laundry by using a washing water flow generated by forcibly flowing washing water through a mechanical force of a pulsator installed and rotated in a lower portion of the washing tub, a friction due to the flowing washing water, and an emulsifying action of the detergent, in a state where detergent, washing water, and laundry are put into the washing tub.

The pulsator is rotated by a driving motor, and may generate various water flows inside the washing tub through forward and reverse rotation.

Meanwhile, conventionally, a circulation pump for pumping the circulating water to the outside of the washing tub is provided separately from the driving motor, and the washing water in the lower portion of the washing tub is pumped and sprayed on cloth from an upper portion of the washing tub. Thus, a laundry processing apparatus which allows laundry (also referred to as "cloth") put into the inside of the washing tub to be easily wet with only a small amount of washing water is developed.

However, when a pump is provided separately from the driving motor, the purchase cost of the pump is additionally occurs. Thus, the manufacturing cost of the laundry processing apparatus is increased, and the operation of the pump is further controlled. Accordingly, there is a problem that the control becomes complicated.

Prior art 1 (Korean Patent Laid-Open No. 2003-0049818) discloses a washing plate installed inside a washing tub to move up and down so as to pump washing water staying in a space between the washing tub and an outer tub, an impeller rotatably installed in a lower portion of the washing tub, and a power transmitting means for reducing and transmitting a rotational speed of the driving motor to the impeller. The washing water pumped by the washing plate and the impeller rises through a guide flow path and is supplied again to the inside of the washing tub through a pumping water discharge hole.

Prior art 2 (Korean Patent Laid-open No. 2013-0049094) discloses to a laundry processing apparatus comprising a pulsator provided to be rotatable inside a drum, a driving motor mounted in the outside of the tub and forming a rotational force of the drum and the pulsator, and a water flow forming means provided in a lower portion of the pulsator and forming a water flow jetted into the drum in a direct flow. The water flow forming means includes a centrifugal blade portion which forms a jetting pressure due to centrifugal force by rotation. The centrifugal blade portion and the pulsator are integrally rotated and rotated at a rotational speed of the driving motor.

PRIOR ART DOCUMENT

Patent Document

Korean Patent Laid-open No. 2003-0049818 (Jun. 25, 2003)

Korean Patent Laid-open No. 2013-0049094 (May 13, 2013)

DISCLOSURE

Technical Problem

In the conventional general laundry processing apparatus, since the detergent dissolving and the cloth wetting are accomplished by rotating only the pulsator in a state where the washing water is supplied, there is a problem that the washing performance is lowered due to the low detergent solubility and it takes a long time to accomplish the detergent dissolving and the cloth wetting. A first object of the present invention is to solve such a problem.

In the conventional general laundry processing apparatus, the washing water is supplied to the interior of an inner tank up to a relatively high water level for the purpose of the detergent dissolving and the cloth wetting, thereby increasing the amount of water used. A second object of the present invention is to solve such a problem and make it possible to easily accomplish the detergent dissolving and the cloth wetting even with a small amount of water.

In the prior art 1, there is a problem that the contact between the impeller and the laundry is limited and the washing power due to friction is weakened. A third object of the present invention is to solve such a problem.

In the prior art 2, when the rotational speed of the driving motor is increased to increase the jetting pressure by the centrifugal blade portion, there is a problem that the rotational speed of the pulsator is increased more than necessary, which hinders the smooth washing and increases the wear of the laundry, and thus, the load caused by the laundry becomes excessively large. On the other hand, in the prior art 2, when the rotational speed of the driving motor is limited in such a manner that the rotational speed of the pulsator does not exceed a certain value, the extent of the jet pressure by the centrifugal blade portion is also limited. That is, in the prior art 2, since the centrifugal blade portion and the pulsator rotate integrally, a problem occurs in any case of increasing or decreasing the number of revolutions of the driving motor. A fourth object of the present invention is to solve such a problem.

When the pulsator and the blade structure are provided to be separately rotated by using two driving motors, there is a problem that the component cost of the driving motor is added and all shaft system structures for transferring the power from the driving motor should be altered, and motor control is additionally required. A fifth object of the present invention is to solve such a problem.

If water penetrates into a power transmission portion, there is a problem that performance of the power transmission portion may be reduced or failure may occur. A sixth object of the present invention is to solve such a problem.

Technical Solution

In order to solve a first problem, the present invention provides a structure for forming water flow in addition to the pulsator.

In order to solve a second problem, the present invention provides a structure for increasing the rpm of the blade and decreasing the rpm of the pulsator.

In order to solve a third problem, the present invention provides a structure for pumping washing water upward while generating frictional force due to contact between the impeller and the laundry, that is, to provide a structure of the pulsator and the blade that rotate independently from each other.

In order to solve a fourth problem, the present invention provides a structure of the pulsator and the blade that rotate independently from each other without rotating integrally.

In order to solve a fifth problem, the present invention provides a structure for transmitting power from a single driving motor.

In order to solve a sixth problem, the present invention provides a structure in which a plurality of gears are disposed outside the outer tub.

A laundry processing apparatus according to the present invention includes: an outer tub which accommodates washing water therein; an inner tub which is disposed inside the outer tub and contains laundry therein; a pulsator which is provided in a lower portion of the inner tub.

In order to solve the above problems, a laundry processing apparatus according to the present invention includes: a blade which is provided below the pulsator; a driving motor which is disposed outside the outer tub and rotates a washing shaft; a pulsator connecting shaft which rotates the pulsator, and is disposed to penetrate a lower side surface of the outer tub; a blade connecting shaft which rotates the blade, and is disposed to penetrate the lower side surface of the outer tub; and a gear module which is disposed outside the outer tub. The gear module transmits a rotational force of the washing shaft to the pulsator connecting shaft and the blade connecting shaft respectively.

Advantageous Effects

With the above-described solution, water can be sprayed with a strong pressure from the upper side, and the detergent dissolving and the cloth wetting can be rapidly performed and the solubility of the detergent can be remarkably increased.

In addition, even with a small amount of water, the detergent dissolving and the cloth wetting can be easily performed, thereby reducing the amount of water used.

Further, by rotating the blade at a relatively high rotation speed and rotating the pulsator at a relatively low rotation speed by using a single driving motor, there is an effect of increasing the pumping pressure and the pumping water flow, performing smooth washing, and reducing wear and rotational load of the laundry.

Further, there is an advantage that a separate driving motor is unnecessary, the change of the shaft system is unnecessary, and control is simple, while achieving the function of the present invention through a single shaft system, through a power transmission portion for transmitting a drive force from a single driving motor.

Further, by using a gear module, the torque load of the driving motor can be reduced, and the energy can be saved by driving the motor in a high efficiency area.

In addition, by allowing the pumped washing water to penetrate a filter portion, foreign matter such as lint can be easily removed.

Further, by disposing a plurality of gears in the outside of the outer tub, the washing water contained in the outer tub is hard to permeate into the inside of the power transmission portion, so that waterproofing property of the power transmission portion can be remarkably increased.

MODE FOR INVENTION

Figure 1:
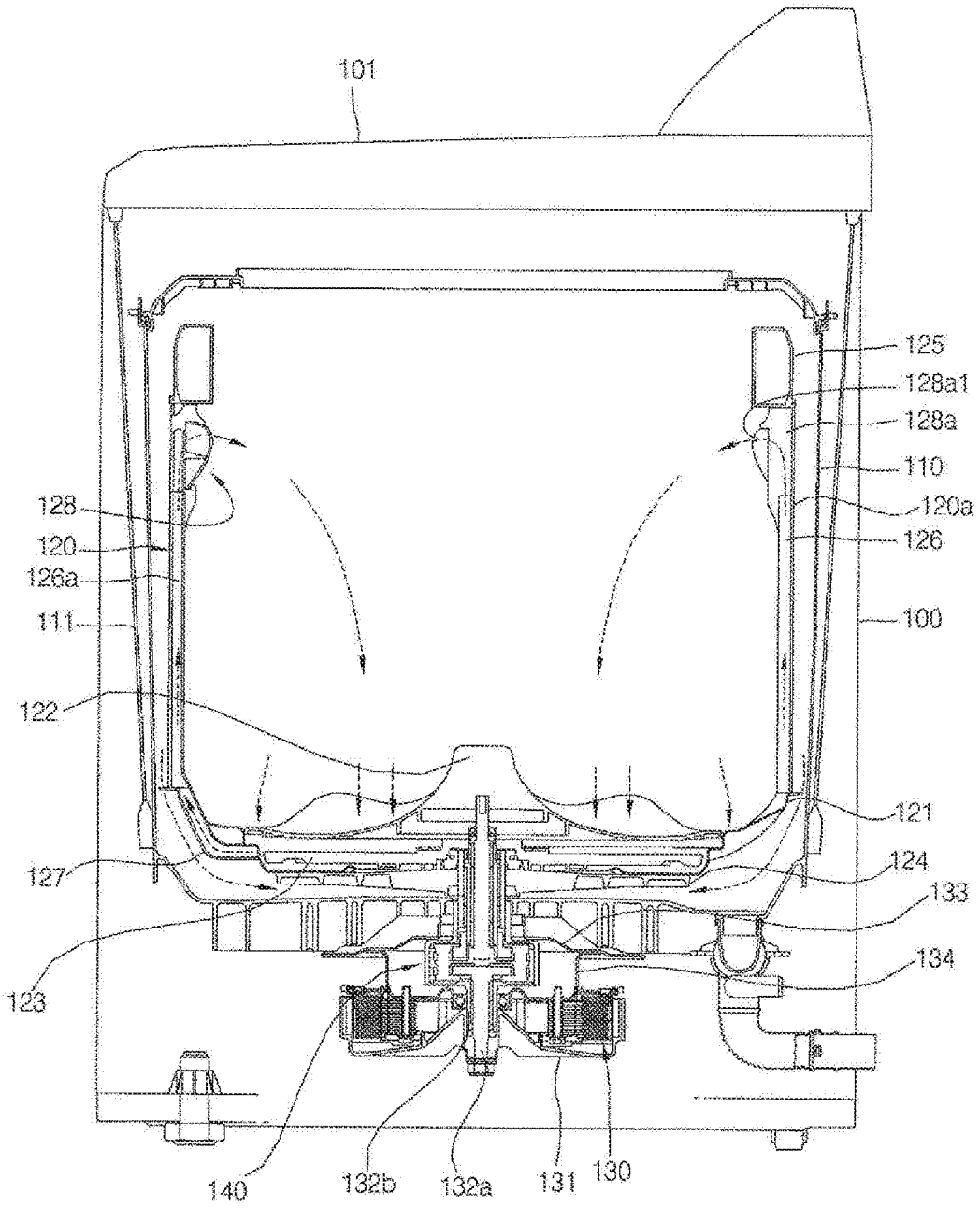
FIG. 1 is a vertical cross-sectional view of a center of a laundry processing apparatus according to a first embodiment of the present invention.
Figure 2:
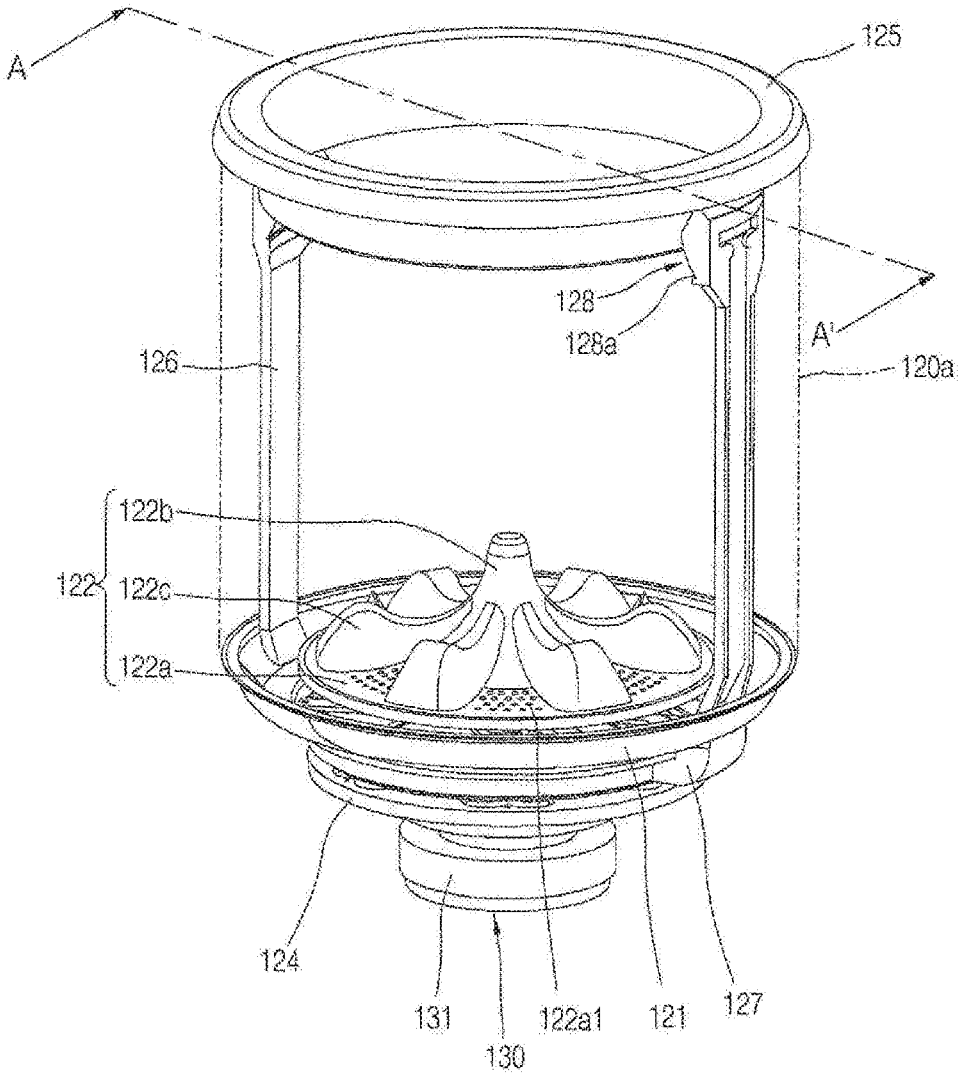
FIG. 2 is a perspective view showing a pulsator 122 and a circulation duct 126 provided inside an inner tub 120 of FIG. 1.
Figure 3:
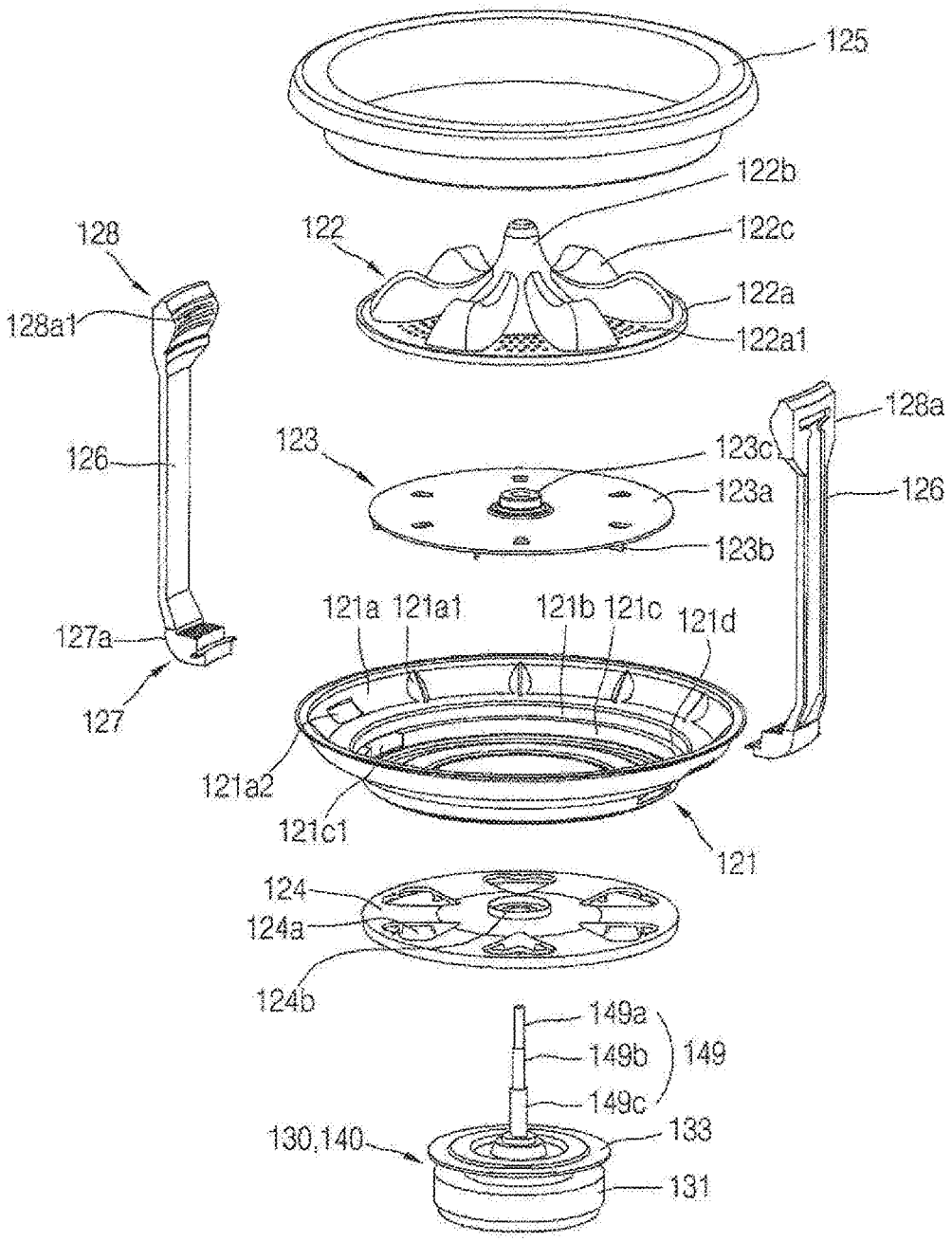
FIG. 3 is an exploded perspective view of the components of FIG. 2.
Figure 4:
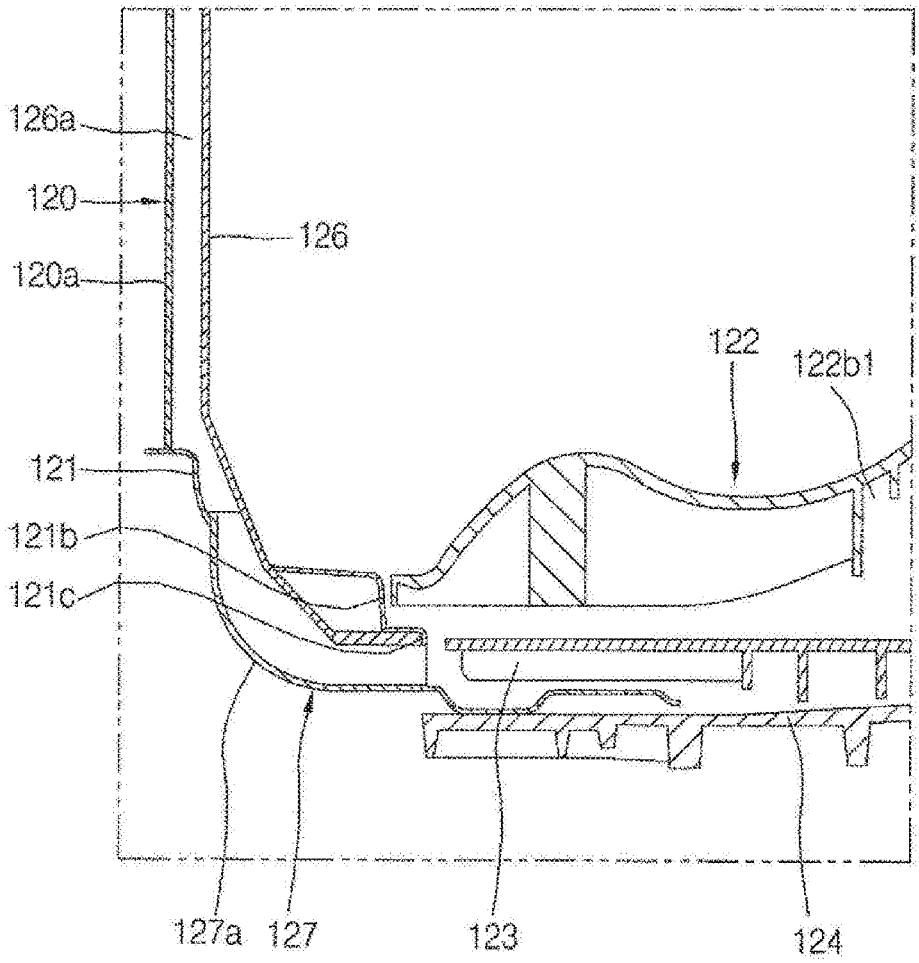
FIG. 4 is a vertical cross-sectional view cut along line A-A' in FIG. 2, and is a partially enlarged view.
Figure 5:
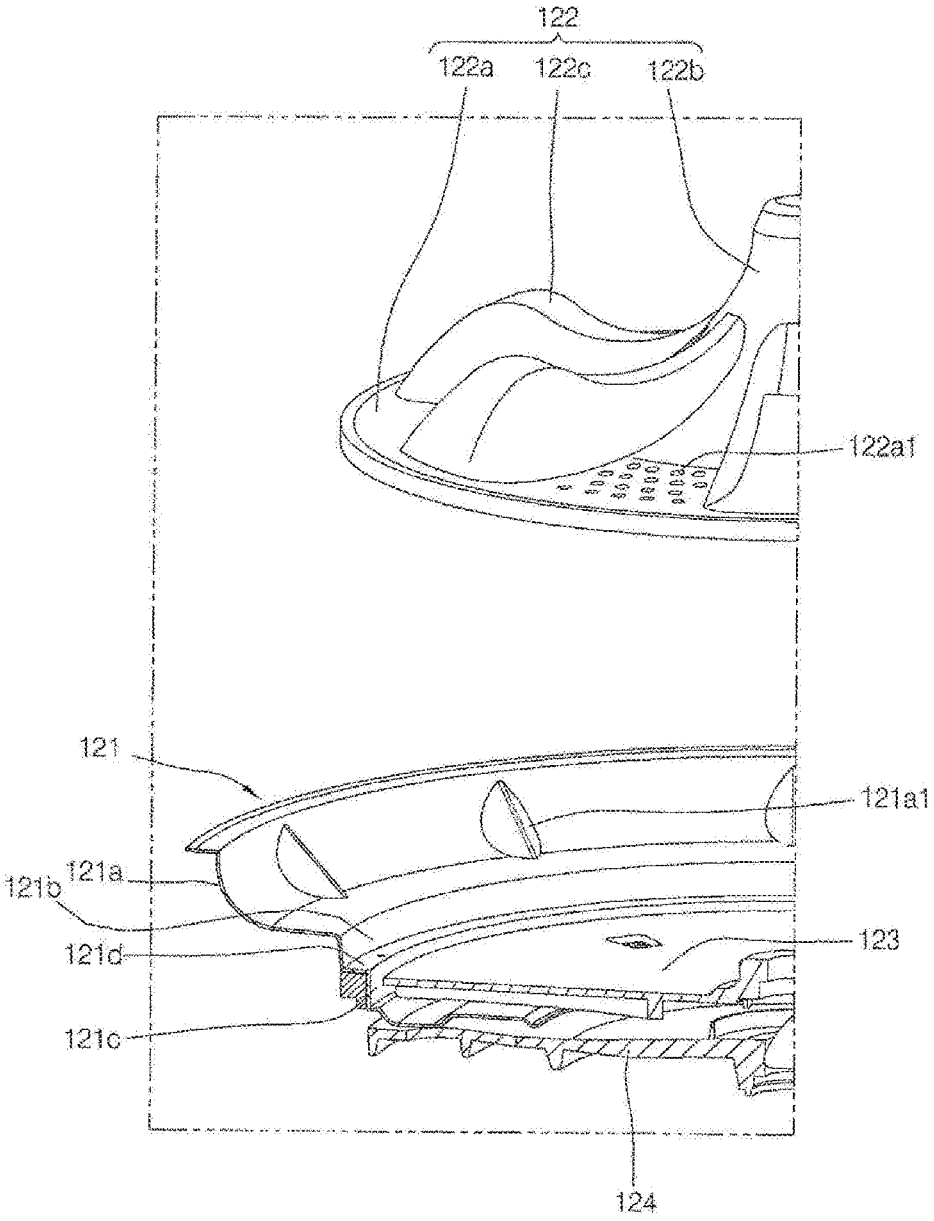
FIG. 5 is an exploded perspective view showing a state before the pulsator 122 of FIG. 4 is mounted in a connecting surface of a base 121.

In this description, a laundry processing apparatus according to a first embodiment, a laundry processing apparatus according to a second embodiment, and a laundry processing apparatus according to a third embodiment are disclosed. In this description, the second embodiment is divided into a 2-A embodiment and a 2-B embodiment, and the third embodiment is divided into a 3-A embodiment and a 3-B embodiment.

FIGS. 1 to 10 are views of a laundry processing apparatus according to a first embodiment, FIGS. 11 to 20 are views of a laundry processing apparatus according to a second embodiment, and FIGS. 21 to 30 are views of a laundry processing apparatus according to a third embodiment.

In order to distinguish the 2-B embodiment from the 2-A embodiment, a comma (') is indicated after the reference numeral in a part, which is a component according to the 2-B embodiment, different from the 2-A embodiment.

In order to distinguish the 3-B embodiment from the 3-A embodiment, a comma (') is indicated after the reference numeral in a part, which is a component according to the 3-B embodiment, different from the 3-A embodiment.

Like reference numerals are used for like or very similar parts throughout the specification.

Hereinafter, a laundry processing apparatus according to the present invention will be described in detail with reference to the drawings. In this specification, the same or similar reference numerals are given to different embodiments in the same or similar configurations, and the description thereof is replaced with the first explanation. As used herein, the singular form includes plural form unless the context clearly dictates otherwise.

Figure 11:
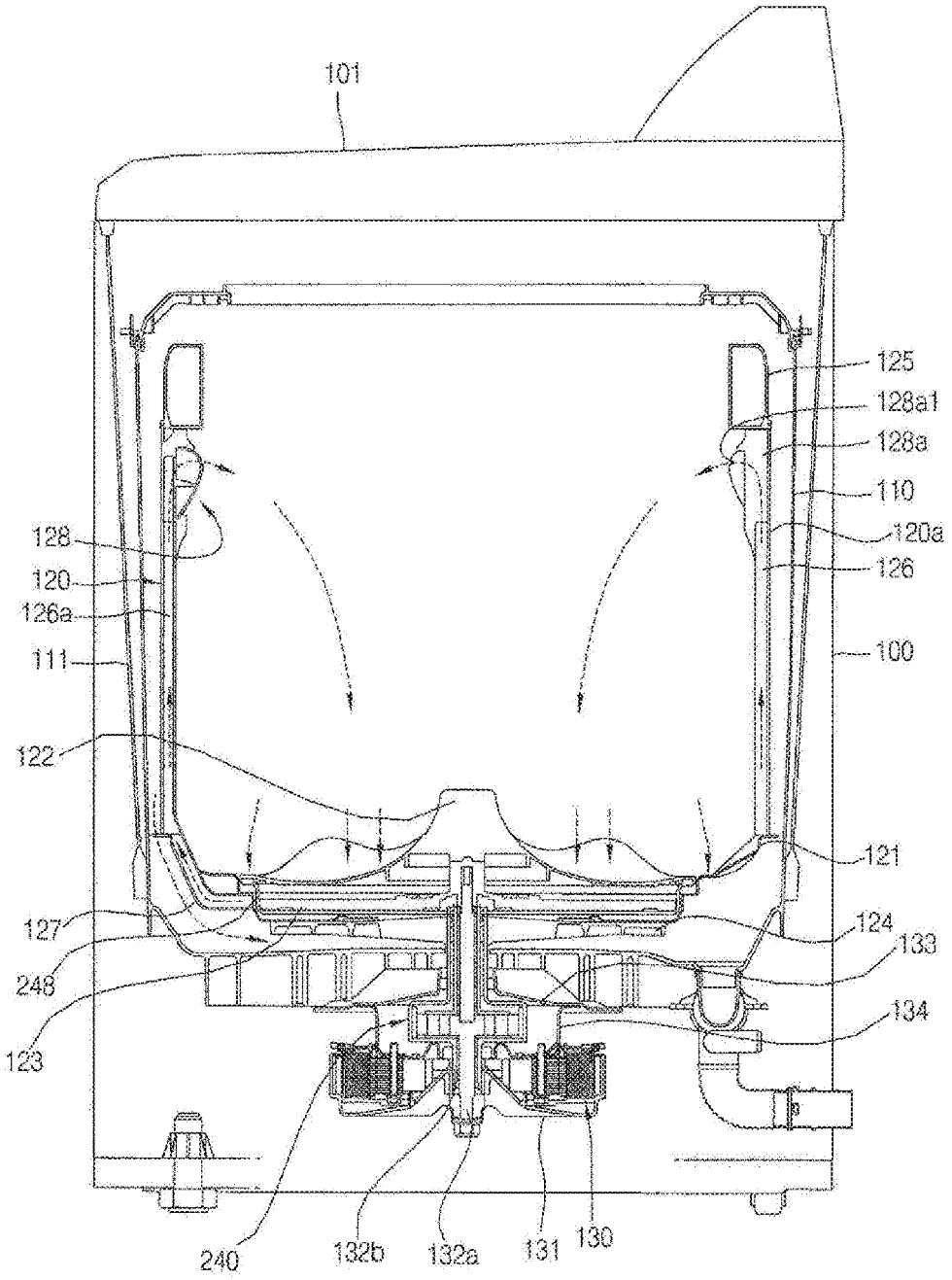
FIG. 11 is a vertical cross-sectional view of a center of a laundry processing apparatus according to a second embodiment of the present invention.
Figure 12:
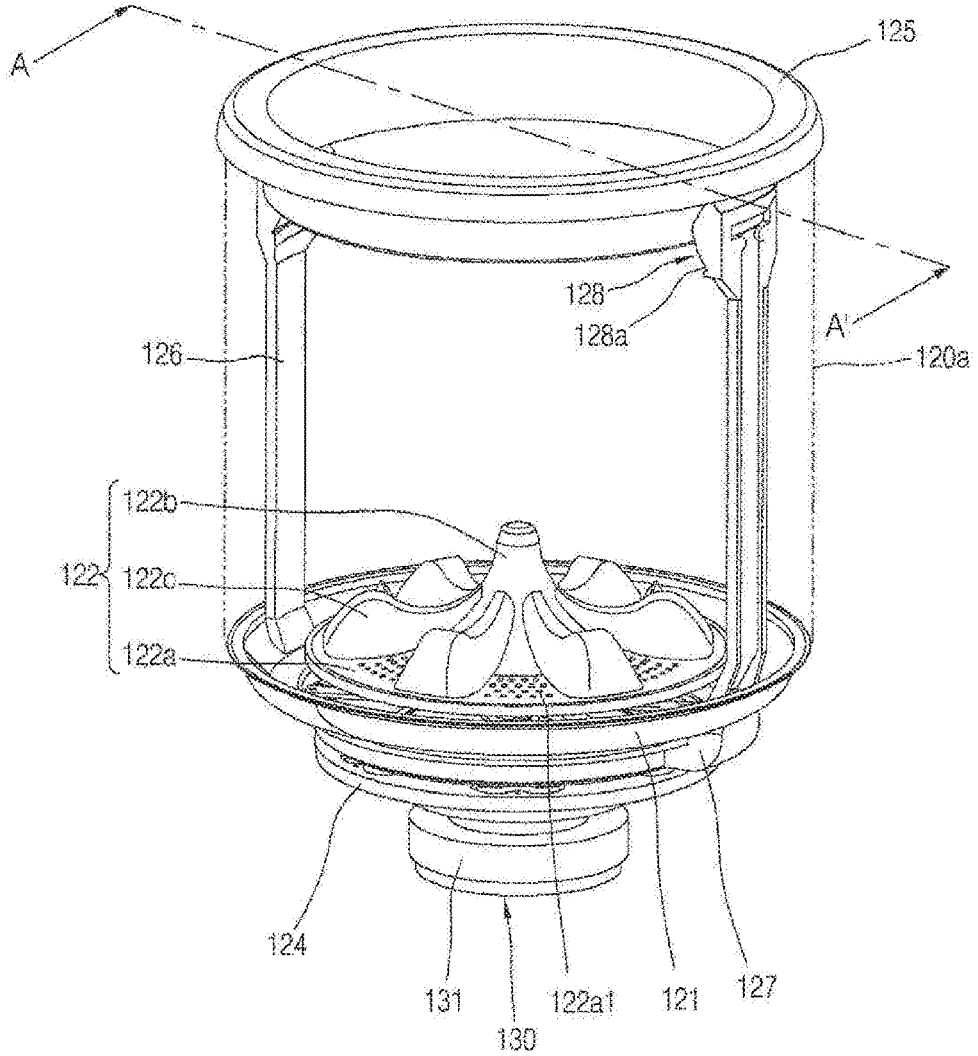
FIG. 12 is a perspective view showing a pulsator 122 and a circulation duct 126 provided inside an inner tub 120 of FIG. 11.
Figure 13:
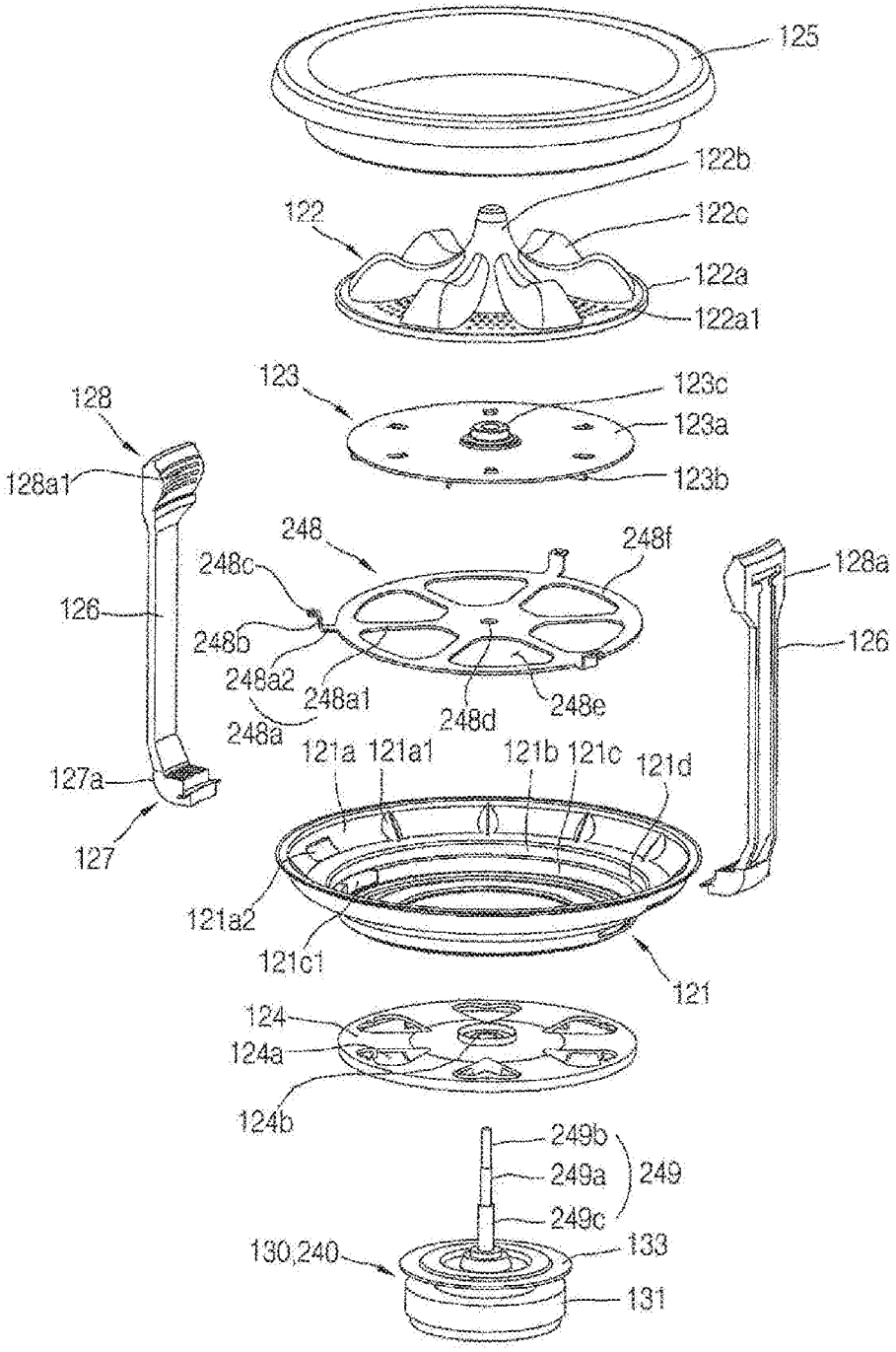
FIG. 13 is an exploded perspective view of the components of FIG. 12.
Figure 14:
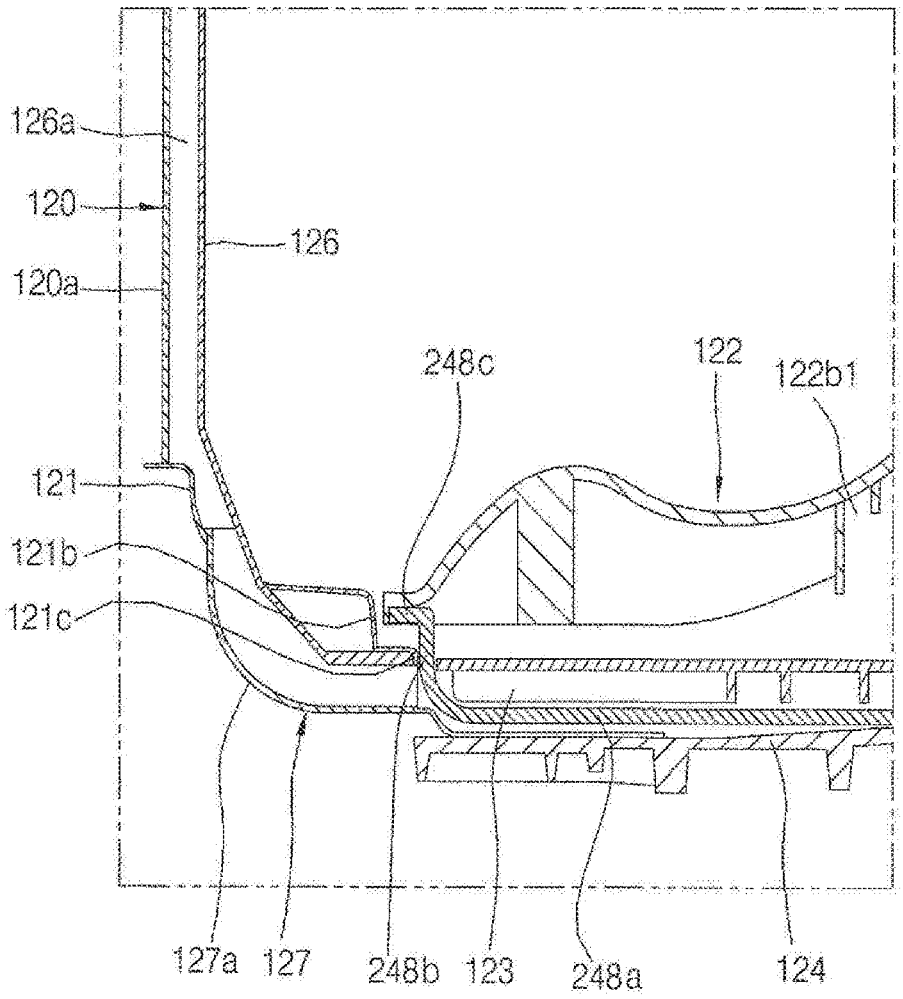
FIG. 14 is a vertical cross-sectional view cut along line A-A' in FIG. 12, and is a partially enlarged view.
Figure 15:
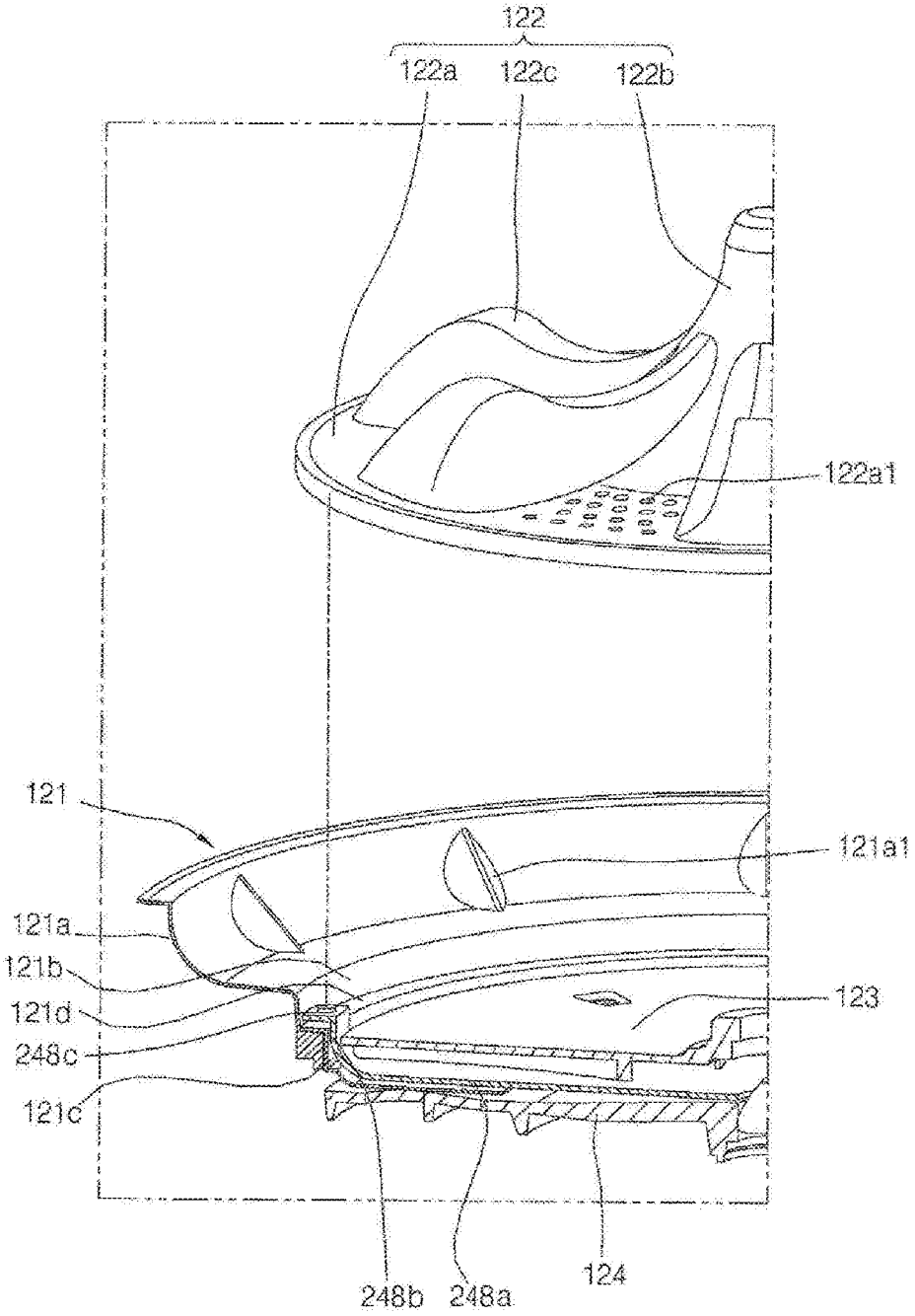
FIG. 15 is an exploded perspective view showing a state before the pulsator 122 of FIG. 14 is mounted in a connecting surface of a base 121.
Figure 21:
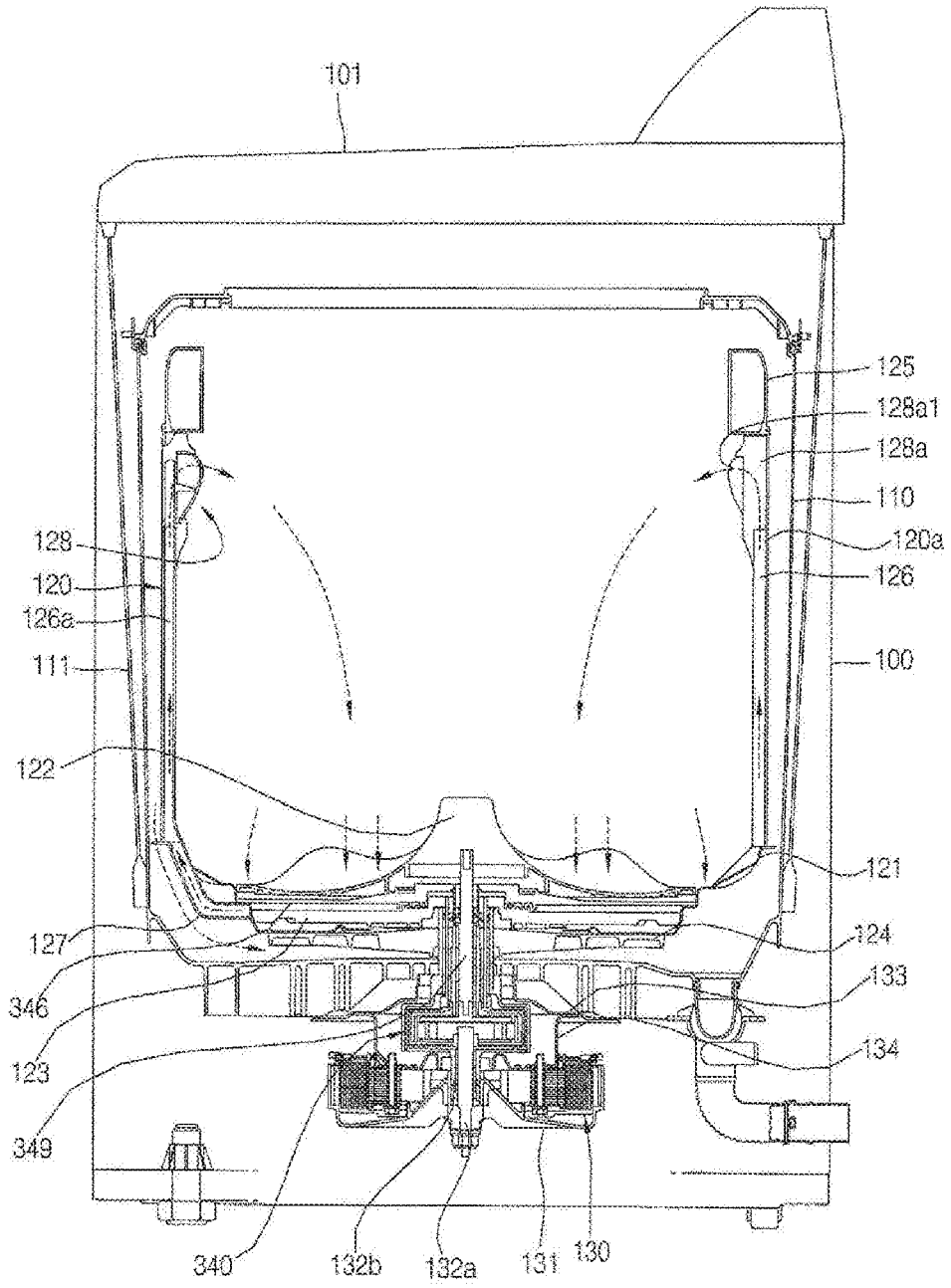
FIG. 21 is a vertical cross-sectional view of a center of a laundry processing apparatus according to a third embodiment of the present invention.
Figure 22:
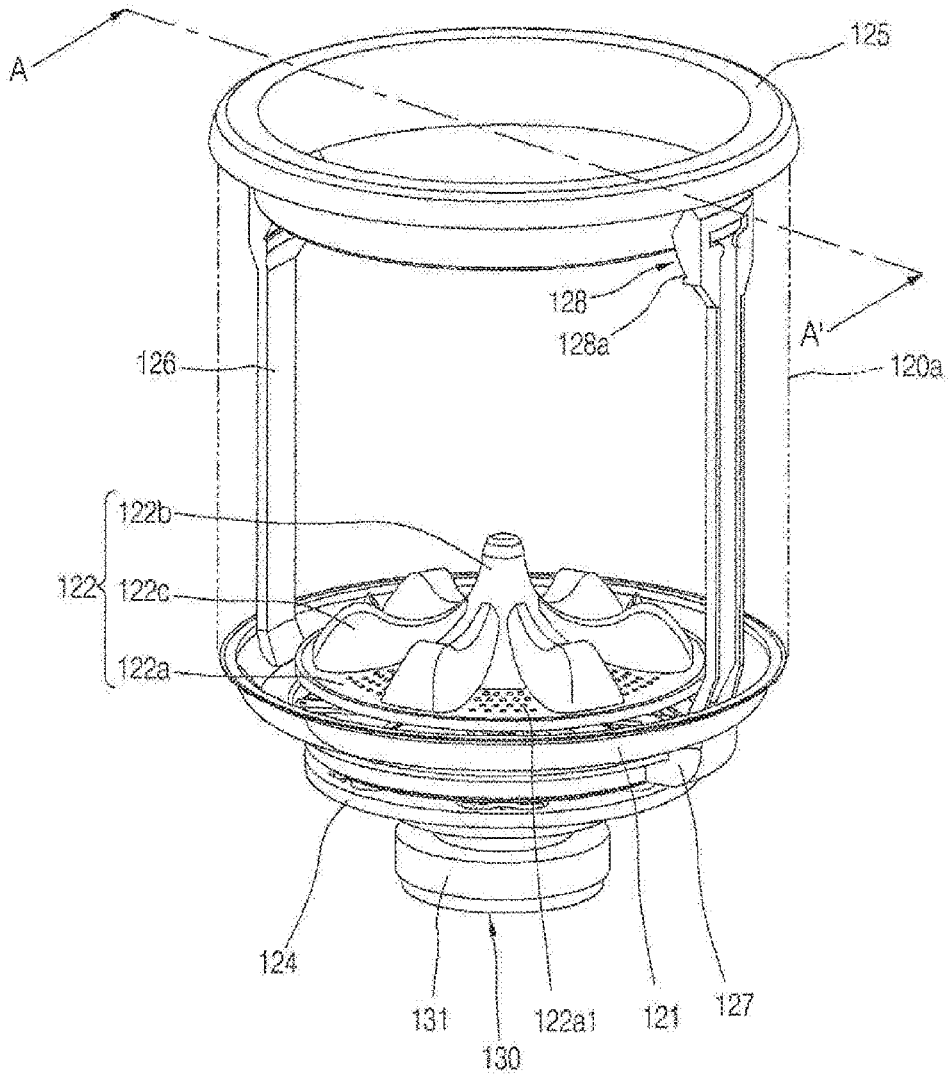
FIG. 22 is a perspective view showing a pulsator 122 and a circulation duct 126 provided inside an inner tub 120 of FIG. 21.
Figure 23:
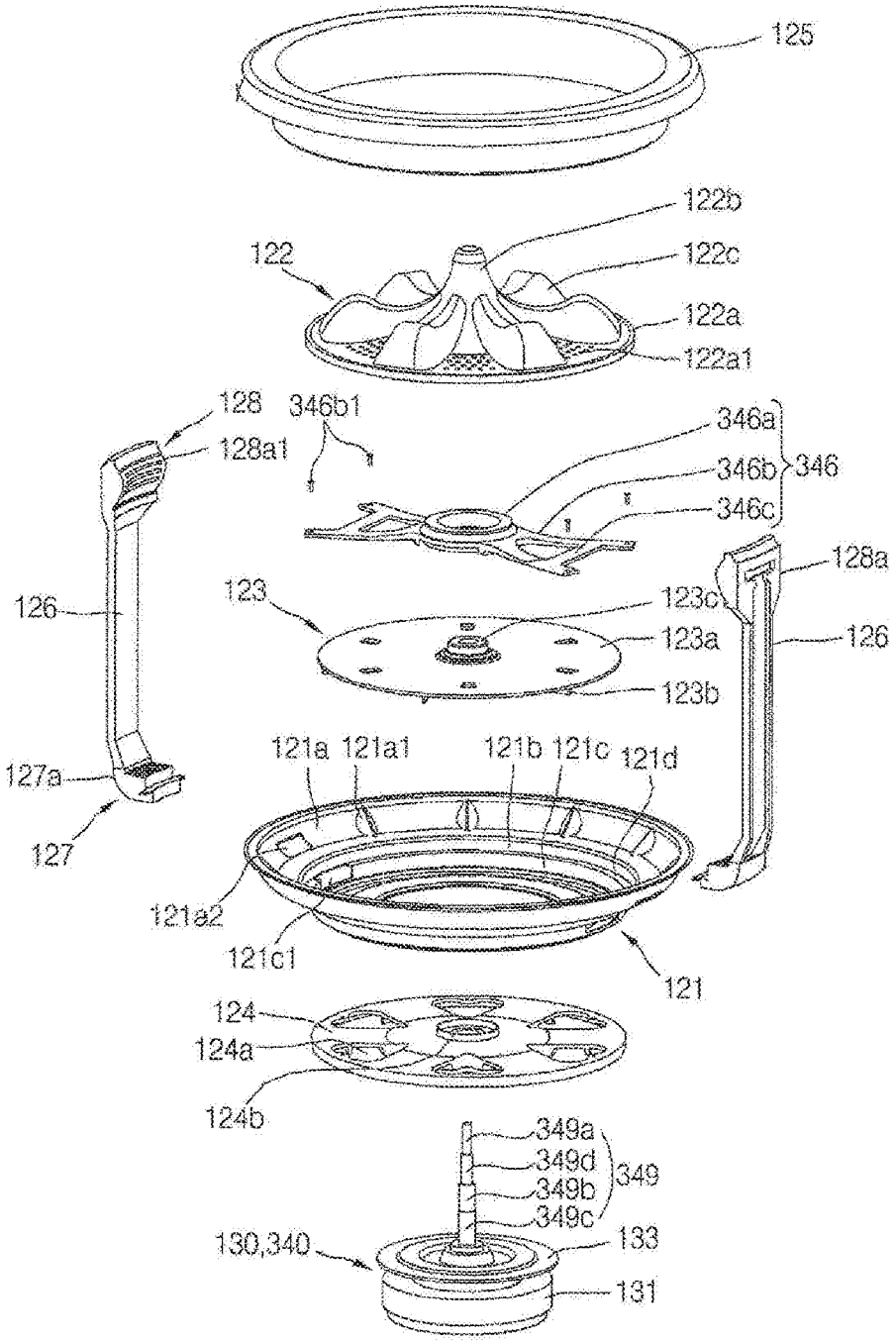
FIG. 23 is an exploded perspective view of the components of FIG. 22.
Figure 24:
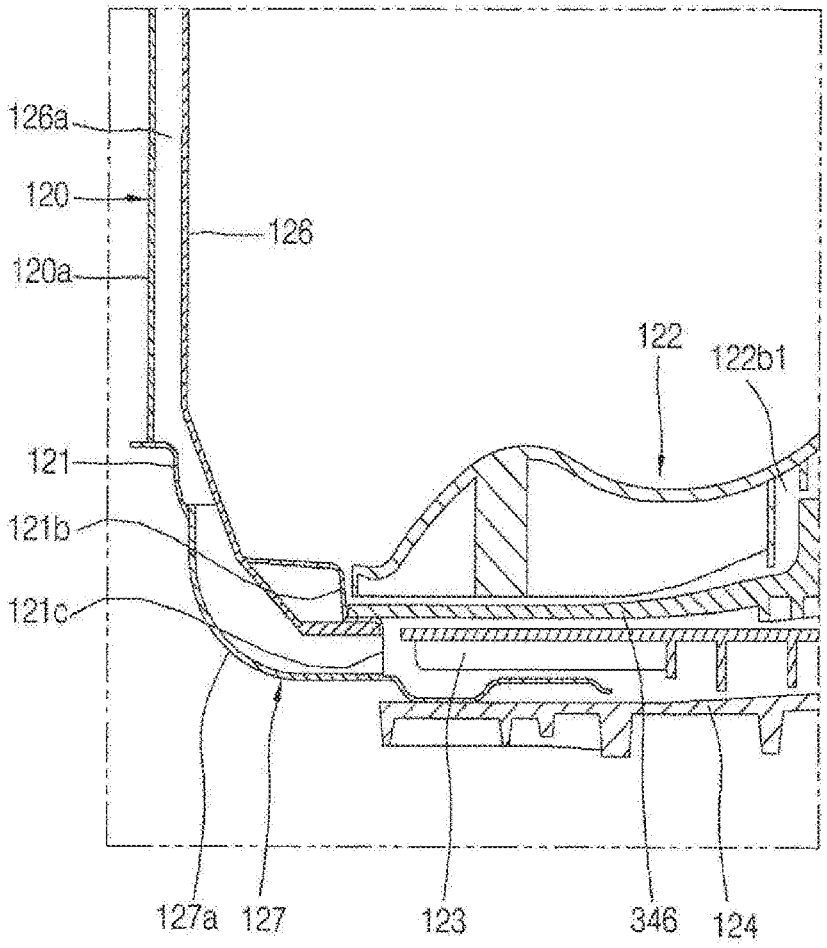
FIG. 24 is a vertical cross-sectional view cut along line A-A' in FIG. 22, and is a partially enlarged view.
Figure 25:
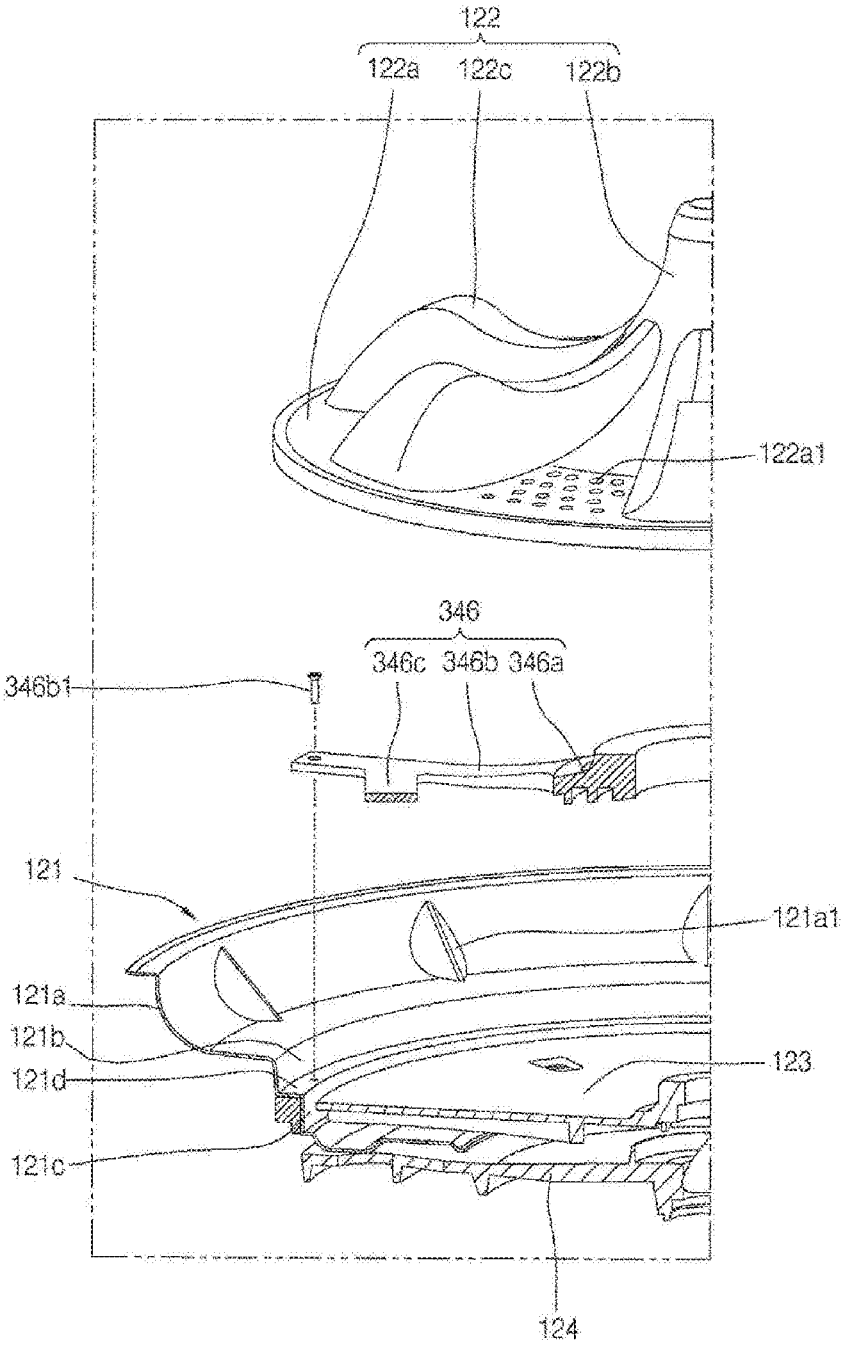
FIG. 25 is an exploded perspective view showing a state before the pulsator 122 of FIG. 24 is mounted in a connecting surface of a base 121.

The terms 'upper side' and 'lower side' mentioned in below to indicate directions are defined based on a top loading washing machine of FIGS. 1, 11 and 21, but it is to be understood that this is only for the present invention to be clearly understood, and it is obvious that the directions may be defined differently depending on where the reference is placed.

The 'central axis' mentioned below means a straight line in which the rotation axis of an inner tub 120 is disposed. The 'centrifugal direction' mentioned below means a direction away from the central axis, and the 'centrifugal opposite direction' means a direction approaching the central axis. In addition, 'circumferential direction' means a direction rotating about the central axis. The 'outer circumferential portion' of a certain component means a 'portion formed along the circumferential direction in the centrifugal direction portion' of the corresponding component.

When viewed from the upper side to the lower side, any one of a clockwise direction and a counterclockwise direction is defined as a 'first direction' and the other is defined as a 'second direction'.

The use of terms such as 'first, second, third, fourth, fifth, sixth' preceding the components mentioned below is intended only to avoid confusion of the designated components, but it is irrelevant to the order, importance, or a master-servant relationship between components. For example, a laundry processing apparatus including only a second component without a first component can be implemented.

The fact that the first component is 'fixed' to the second component, which will be mentioned below, means that not only a case where the first component is directly coupled to the second component, but also a case where the first component is coupled to the third component and the third component is coupled to the second component so that the relative position of the first component with respect to the second component is maintained are also included. In addition, the fact that the first component is 'fixed' to the second component means that even a case where the first component and the second component are integrally formed is included.

The fact that the first component 'rotates integrally' with the second component, which will be mentioned below, means that the first component rotates at the same rotational speed and the same rotational direction as the second component, and means that not only the case where the first component is coupled to the second component and rotated together with the second component, but also the case where the first component is coupled to the third component and the third component is coupled to the second component such that the first component is rotated together with the second component are included.

The fact that the first component 'independently rotates' from the second component, which will be mentioned below, means that the first component does not rotate integrally with the second component but rotates separately, and means that the ratio of the rotational speed of the first component to the rotational speed of the second component is uniformly previously set while the first component is engaged with a gear.

Referring to FIGS. 1 to 5, 11 to 15, and 21 to 25, the laundry processing apparatus includes a cabinet 100 forming an external shape. The laundry processing apparatus includes an outer tub 110 disposed inside the cabinet 100. The outer tub 110 accommodates washing water therein. The laundry processing apparatus includes an inner tub 120 disposed inside the outer tub 110. The inner tub 120 accommodates laundry therein. The inner tub 120 accommodates washing water therein. The laundry processing apparatus includes a pulsator 122 rotatably disposed below the inner tub 120. The laundry processing apparatus includes a blade 123 rotatably disposed between the pulsator 122 and a bottom surface of the inner tub 120 to pump washing water to an upper end portion of the inner tub 120. The laundry processing apparatus includes a driving motor 130 for generating a rotational force of the pulsator 122 and the blade 123. The laundry processing apparatus includes a power transmission portion 140, 240, and 340 that transmit the rotational force of the driving motor 130 to the pulsator 122 and the blade 123.

The cabinet 100 may have a rectangular parallelepiped shape. The cabinet 100 includes a base cabinet forming a lower side surface, a lateral side cabinet forming front, rear, left, and right side surfaces, and a top cover cabinet forming an upper side surface having a laundry access hole so that laundry can enter and exit the laundry processing apparatus.

The upper portion of the cabinet 100 (the top cover cabinet) is provided with a door 101 for loading or unloading laundry. The door 101 opens and closes the laundry access hole.

The outer tub 110 may have a cylindrical shape having an upper side that is opened. The outer tub 110 is suspended and supported by a suspension bar 111 inside the cabinet 100. The outer tub 110 stores the supplied washing water therein. The outer tub 110 is provided to dissolve and mix the supplied detergent with the washing water. A drain port is provided in the bottom surface of the outer tub 110.

The inner tub 120 is rotatably installed inside the outer tub 110 to perform washing. The inner tub 120 receives power from the driving motor 130 and rotates. The inner tub 120 may selectively receive power from the driving motor 130 by intermittent operation of the clutch 137. The inner tub 120 may be fixed at the time of washing and rinsing and may be rotated at the time of dewatering.

The inner tub 120 includes a side wall portion 120*a* that forms a side surface of the inner tub 120 in the centrifugal direction. The side wall portion 120*a* has a plurality of dewatering holes. The washing water in the outer tub 110 flows into the side wall portion 120*a* through the plurality of dewatering holes.

The inner tub 120 includes a balancer 125 mounted in an upper portion of the side wall portion 120*a*. The balancer 125 may extend along the circumference of the side wall portion 120*a*.

The inner tub 120 may include a base 121 coupled to a lower portion of the side wall portion 120*a*. The base 121 is disposed below the inner tub 120 to form at least a part of the lower side surface of the inner tub 120.

The base 121 forms the bottom surface of the inner tub. The upper portion of the base 121 is coupled with the lower end of the side wall portion 120*a*. The base 121 forms a step portion 121*b*, 121*c* at the lower portion thereof. The base 121 forms a first step portion 120*b* at the lower portion thereof. The base 121 forms a second step portion 121*c* at the lower portion thereof.

The blade 123 is disposed to be completely covered when viewed from the upper side to the lower side of the pulsator 122. When viewed from the upper side to the lower side, the pulsator 122 is disposed to completely cover the blade 123. The upper side of the blade 123 is covered and does not contact the laundry inside the inner tub 120. Accordingly, the blade 123 receives a load due to washing water pumping without receiving a load due to contact with the laundry during rotation. The pulsator 122 is able to be in contact with the laundry.

The base 121 is formed to be recessed downward as a whole. The blade 123 is disposed in a space formed by being recessed to the lower side of the base 121. The base 121 is recessed downward to form a space between the bottom surface of the base 121 and the lower side surface of the pulsator 122. The blade 123 is disposed in a space between the bottom surface of the base 121 and the lower side surface of the pulsator 122.

When the base 121 is viewed from the upper side to the lower side, the central portion (the portion near the center) forms the lowest upper side surface. The second step portion 121*c* and the first step portion 121*b* are disposed sequentially in the edge direction from the central portion of the base 121. The upper side surface of the base 121 is raised by the second step portion 121*c*, when following the upper side surface of the base 121 in the edge direction from the central portion of the base 121. The upper side surface of the base 121 is raised by the first step portion 121*b*, when following the upper side surface of the base 121 in the edge direction from the second step portion 121*c*. The first step portion 121*b* is formed to extend in the circumferential direction around a rotation shaft 132. The second step portion 121*c* is formed to extend in the circumferential direction around the rotation shaft 132.

In addition, the base 121 has a connecting surface 121*d* connecting the upper end of the first step portion 121*b* and the lower end of the second step portion 121*c*. The connecting surface 121*b* forms a surface facing upward. The connecting surface 121*d* faces the lower side surface of the pulsator 122. The connecting surface 121*d* is formed to extend along the circumferential direction.

In addition, the base 121 has a round portion 121*a* formed, in an upper portion thereof, to be rounded downward.

When the base 121 is viewed from the upper side to the lower side, the round portion 121*a* is disposed in the edge of the base 121. The round portion 121*a* is formed to extend in the circumferential direction about the rotation axis 132. When the base 121 is viewed from the upper side to the lower side, the round portion 121*a* is inclined so that the height gradually decreases in the direction of the rotation axis 132 from the edge of the base 121. The edge of the round portion 121*a* is connected to the lower end of the side wall portion 120*a*.

In the round portion 121*a*, semicircular protrusions 121*a*1 face each other and are protruded upward to be inclined. The semicircular protrusions 121*al* are spaced apart from one another in the circumferential direction.

The first step portion 121*b* is formed to surround the outer circumferential portion of the pulsator 122. When viewed from the upper side to the lower side, the blade 123 is disposed inside the circumference of the first step portion 121*b*. The first step portion 121*b* includes a vertical surface formed vertically to face the outer circumferential portion of the pulsator 122. The first step portion 121*b* is connected to the lower portion of the round portion 121*a*. The upper end of the first step portion 121*b* is connected to the inner circumferential portion (the end portion in the direction close to the rotation axis) of the round portion 121*a*. A certain gap is formed between the first step portion 121*b* and the outer circumferential portion of the pulsator 122 to avoid interference during the rotation of the pulsator 122. The gap between the first step portion 121*b* and the pulsator 122 may be about 1 mm so that coins or the like missing from the laundry do not enter.

The second step portion 121*c* is formed to surround the outer circumferential portion of the blade 123. The circumference of the second step portion 121*c* is disposed inside the circumference of the first step portion 121*b* when viewed from the upper side to the lower side. When viewed from the upper side to the lower side, the circumference of the second step portion 121*c* is disposed in the inner side of the pulsator 122. The second step portion 121*c* includes a vertical surface formed vertically to face the outer circumferential portion of the blade 123. The lower end of the second step portion 121*c* is connected to the bottom surface of the base 121. The central portion of the base 121 forms the lowest surface. The lower portion of the second step portion 121*c* is connected to the outer circumferential portion of the central portion of the base 121.

An opening is formed in the bottom surface of the base 121. The opening is formed in the center of the base 121. Water may be introduced into the base 121 from the lower outer portion of the base 121 through the opening of the base 121.

The inner tub 120 includes a hub 124 coupled to the lower portion of the base 121. The hub 124 is disposed below the inner tub 120. The hub 124 forms at least a part of the lower side surface of the inner tub 120. The hub 124 is formed of a circular member having a relatively larger thickness than the side wall portion 120*a* and the base 121. The hub 124 receives the rotational force of the driving motor 130 and transmits the rotational force to the base 121 and the side wall portion 120*a*. The hub 124 receives rotational force from an inner tub connecting shaft 149*c*, 249*c*, and 349*c* described later. The hub 124 has a plurality of washing water inflow holes 124*a*. The plurality of washing water inflow holes 124*a* are disposed apart from each other in the circumferential direction. The washing water stored in the outer tub 110 may be introduced into a lower portion of the inner tub 120 through the washing water inflow hole 124*a* of the hub.

The hub 124 is fixed to the lower side surface of the base 121. The hub 124 is disposed in the central portion of the base 121. The washing water inflow holes 124*a* is illustrated as a fan shape, but is not limited thereto. The central portion of the hub 124 is provided with a center coupling portion 124*b* for coupling with a concentric shaft assembly 149, 249, and 349. The center coupling portion 124*b* forms a hole that penetrates in the vertical direction. The upper portion of the inner tub connecting shaft 149*c*, 249*c*, and 349*c* are fixed to the center coupling portion 124*b*. A blade connecting shaft 149*b*, 249*b*, and 349*b* penetrates through the hole of the center coupling portion 124*b*. A pulsator connecting shaft 149*a*, 249*a*, and 349*a* penetrates the hole of the center coupling portion 124*b*. Further, in the third embodiment, a jig connecting shaft 349*d* penetrates via the hole of the center coupling portion 124*b*.

The laundry processing apparatus includes the driving motor 130 disposed below the outer tub 110. The driving motor 130 may include a rotor and a stator. A motor casing 131 that forms an outer shape of the driving motor 130 is provided. The rotor and the stator may be disposed inside the motor casing 131.

The laundry processing apparatus includes a washing shaft 132*a* that is rotated by the driving motor 130. The laundry processing apparatus includes a dewatering shaft 132*b* disposed to surround the circumference of the washing shaft 132*a*. The washing shaft 132*a* is disposed to penetrate the dewatering shaft 132*b*.

The stator is fixed inside the motor casing 131, and the rotor is rotated by electromagnetic interaction with the stator. The washing shaft 132*a* is fixed to the rotor and may rotate integrally with the rotor.

The laundry processing apparatus includes a clutch 137 for switching the integral rotation of the dewatering shaft 132*b* and the washing shaft 132*a*. The pulsator 122 and the blade 123 are provided to relatively rotate with respect to the inner tub 120 when the washing shaft 132*a* relatively rotates with respect to the dewatering shaft 132*b*. The pulsator 122, the blade 123, and the inner tub 120 are integrally rotated when the dewatering shaft 132*b* and the washing shaft 132*a* are integrally rotated. The clutch 137 may switch the dewatering shaft 132*b* to be in close contact with the washing shaft so that the dewatering shaft 132*b* rotates integrally with the washing shaft 132*a*. The clutch 137 may switch the dewatering shaft 132*b* to be spaced apart from the washing shaft so that the washing shaft relatively rotates with respect to the dewatering shaft 132*b*.

The driving motor 130 is supported by the outer tub 110. The laundry processing apparatus includes a driving motor support member 135, 136 which is fixed to the lower side surface of the outer tub 110 and supports the driving motor 130.

The driving motor support member 135, 136 include a fixing bracket 133 fixed to the lower side of the outer tub 110. The fixing bracket 133 may be formed of a circular plate as a whole. The fixing bracket 133 is coupled with the lower side surface of the outer tub 110. The fixing bracket 133 is disposed in the upper side of the driving motor 130. The concentric shaft assembly 149, 249, 349 is disposed to penetrate the center of the fixing bracket 133.

The driving motor support member 135, 136 include a connecting bracket 134 fixed to the lower side of the fixing bracket 133. The connecting bracket 134 supports the driving motor 130. The connecting bracket 134 may be directly fixed to the lower side surface of the outer tub 110. The connecting bracket 134 is generally formed in a cylindrical shape whose central portion is recessed from the upper side to the lower side. The connecting bracket 134 is disposed in the upper side of the driving motor 130. The washing shaft 132*a* is disposed to penetrate the center of the connecting bracket 134. The clutch 137 may be disposed in the connecting bracket 134.

The driving motor support member 135, 136 forms a gear module disposition space 140*a* therein. The driving motor support member 135, 136 may accommodate a gear module described later therein. In this specification, as an example of the gear module, a gear module 142, 143, 144 and 145 according to a first embodiment, a gear module 242, 243, 244 and 245 according to a second embodiment, and a gear module 342, 343, 344 and 345 according to a third embodiment are disclosed. The gear module is disposed in the gear module disposition space 140*a*. The gear module is disposed between the washing shaft 132*a* and the concentric shaft assembly 149. The gear module is disposed between the dewatering shaft 132*b* and the concentric shaft assembly 149. The gear module is disposed in an inner space of the connecting bracket 134. The gear module is disposed below the fixing bracket 133.

The washing shaft 132*a* is disposed in the lower side of the outer tub 110. The washing shaft 132*a* is positioned in the central axis. The washing shaft 132*a* is formed to extend in the vertical direction. The washing shaft 132*a* is rotated by the driving motor 130. The washing shaft 132*a* is disposed to protrude to the upper side of the driving motor 130.

The laundry processing apparatus includes the pulsator 122 provided in the lower portion of the inner tub 120. The pulsator 122 is provided to be rotatable. The pulsator 122 is provided to be rotatable with respect to the inner tub 120. The pulsator 122 receives power from the driving motor 130. The pulsator 122 may rotate in the forward and reverse directions. The pulsator 122 may be used to obtain an effect of scrubbing laundry.

In the first and third embodiments, the pulsator 122 is fixed to the upper portion of the pulsator connecting shaft 149*a*, 349*a*. The pulsator 122 receives rotational force from the pulsator connecting shaft 149*a*, 349*a*.

In the second embodiment, the pulsator 122 is fixed to the upper portion of a pulsator connection frame 248. The pulsator 122 is fixed to an edge portion of the pulsator connection frame 248. The pulsator 122 receives rotational force from the pulsator connection frame 248.

The pulsator 122 includes a rotation plate 122*a* forming a circular plate and a plurality of protrusions 122*c* protruding upward from the upper side surface of the rotation plate 122*a*. The pulsator 122 includes a central protrusion 122*b* protruding upward from the central portion of the rotation plate 122*a*.

The plurality of protrusions 122*c* are formed to extend in the centrifugal direction from the central protrusion 122*b*. One end of the protrusion 122*c* is connected to the central protrusion 122*b* and the other end of the protrusion 122*c* is extended toward the outer circumference of the rotation plate 122*a*. The plurality of protrusions 122*c* are disposed apart from each other along the circumferential direction. The upper side surface of the protrusion 122*c* may be formed to be curved. The plurality of protrusions 122*c* may rotate the introduced washing water in the forward and reverse directions of the pulsator to form a water stream.

An upper cap may be provided in the upper portion of the central protrusion 122*b*. The central protrusion 122*b* may be formed to protrude further upward than the plurality of protrusions 122*c*.

The pulsator 122 forms a plurality of through holes 122*a*1. A plurality of through holes 122*a*1 are formed in the rotation plate 122*a*. The through hole 122*a*1 allows the washing water to penetrate the pulsater 122 in the vertical direction. The washing water may flow to the lower portion of the inner tub 120 through the through hole 122*a*1.

A concave groove 122*b*1 may be formed to be recessed upward in the center of the lower side surface of the pulsator 122.

In the first and third embodiments, a shaft support groove 122*b*2 may be formed to be recessed upward inside the concave groove 122*b*1 of the pulsator 122. The upper end of the pulsator connecting shaft 149*a*, 349*a* is inserted into the shaft support groove 122*b*2. Thus, the rotational force of the pulsator connecting shaft 149*a*, 349*a* may be transmitted to the pulsator 122.

In the second embodiment, the pulsator 122 may include a rib that protrudes downward from the lower side edge and is extended in a circumferential direction, and the upper end of the pulsator connection frame 248 is disposed and fixed to the side opposite to the centrifugal side of the rib. Thus, the rotational force of the pulsator connection frame 248 may be transmitted to the pulsator 122.

The laundry processing apparatus includes a blade 123 provided below the pulsator 122. The blade 123 is provided to be rotatable in the lower portion of the pulsator 122. The blade 123 is provided to be relatively rotatable with respect to the inner tub 120. The blade 123 is provided to be relatively rotatable with respect to the pulsator 122. The blade 123 may form the water stream of the washing water by using the centrifugal force. The blade 123 is provided to pump the washing water upward to the upper end portion of the inner tub. The blade 123 is disposed to be completely covered when viewed from the upper side to the lower side of the pulsator 122.

The blade 123 includes a circular rotation plate 123*a*. The rotation plate 123*a* receives rotational force from the driving motor 130. A shaft coupling portion 123*c* is provided in the center of the rotation plate 123*c*. The upper portion of the blade connecting shaft 149*b*, 249*b*, 349*b* is fixed to the shaft coupling portion 123*c*. The blade 123 receives rotational force from the blade connecting shaft 149*b*, 249*b*, 349*b*.

The blade 123 includes a plurality of pumping wing portions 123*b* protruding downward from the lower side surface of the rotation plate 123*a*. The pumping wing portion 123*b* is a portion for pumping the washing water by rotating the washing water filled in the lower portion of the rotation plate 123*a*. A plurality of pumping wing portions 123*b* are provided. The plurality of pumping wing portions 123*b* may be spaced apart from each other in the circumferential direction. The plurality of pumping wing portions 123*b* may be protruded and disposed in a radial direction. The plurality of pumping wing portions 123*b* are formed to extend in the centrifugal direction. The plurality of pumping wing portions 123*b* are formed to extend in the radial direction toward the outer circumferential portion of the rotation plate 123*a*.

The laundry processing apparatus includes a washing water circulation module for guiding washing water flowing by the blade 123 to the upper side of the inner tub 120 and spraying the washing water. A plurality of washing water circulation modules may be provided. In the present embodiment, two washing water circulation modules are provided. The two washing water circulation modules are disposed symmetrically about the rotation axis of the inner tub 120 so as to face each other.

The washing water circulation module includes a washing water discharge portion 127 which is coupled to the base 121 and into which the washing water flowing by the blade 123 is introduced. The washing water circulation module includes a circulation duct 126 that is provided in the inner surface of the side wall portion 120*a* and guides the washing water introduced into the washing water discharge portion 127 to the upper end of the side wall portion 120*a*. The washing water circulation module includes a filter portion 128 that is disposed in an upper end of the side wall portion 120*a* and sprays washing water guided through the circulation duct 126.

The circulation duct 126 provides a circulation flow path 126*a*, which is connected to the inner tub 120, that raises the washing water in the lower portion of the inner tub 120 to the upper portion of the inner tub 120 and re-supplies and circulates the washing water to the inside of the inner tub 120. The circulation duct 126 may be mounted in the inner circumferential surface of the inner tub 120 in the form of a cover. The circulation duct 126 may be bended such that the lateral surface of the centrifugal direction is opened and the opposite lateral surface of centrifugal direction and both lateral surfaces of the circumferential direction are closed. A fastening protrusion is formed in a lateral end of the circumferential direction in both lateral surfaces of the circumferential direction of the circulation duct 126, and the circulation duct 126 may be fastened to the inner circumferential surface of the inner tub 120 by the fastening protrusion. The circulation flow path 126*a* which allows the washing water to move upward is formed inside the circulation duct 126.

The washing water discharge portion 127 is connected to the lower portion of the circulation duct 126. The washing water discharge portion 127 provides a passage for receiving the washing water discharged by the blade 123 and moving the washing water to the circulation duct 126. The washing water discharge portion 127 is disposed in the lower outer side of the base 121. The washing water discharge portion 127 includes a discharge body 127*a* which is formed in a round shape so that washing water can be smoothly bended and move from the blade 123 to the circulation duct 126. The discharge body 127*a* allows the washing water to be smoothly bended and move upward from the centrifugal direction. A washing water discharge port is formed in the lower part of the discharge body 127*a* in the direction opposite to the centrifugal direction. The washing water discharge port is connected to communicate with the inside of the base 121 and is disposed to face the outer circumferential portion of the blade 123. The washing water pumped by the blade 123 through the washing water discharge port is discharged in the centrifugal direction from the base 121. The washing water flows into the discharge body 127*a* through the washing water discharge port. The discharge body 127*a* forms a duct communication port formed upward in the upper portion thereof. The upper side of the discharge body 127*a* is coupled to communicate with the circulation duct 126 through the duct communication port. The washing water in the discharge body 127*a* flows into the circulation flow path 126*a* through the duct communication port. The washing water flowing into the discharge body 127*a* moves upward into the circulation duct 126.

The filter portion 128 may be installed in the upper end portion of the circulation duct 126. The filter portion 128 includes a filter housing 128*a* and a filter provided inside the filter housing 128*a* to filter out foreign matter. The filter may be formed in a net structure. The lower side of the filter housing 128*a* is connected to the upper end portion of the circulation duct 126. One lateral surface of the filter housing 128*a* forms an outflow port 128*a*1 that is opened in the direction toward the inside of the side wall portion 120*a*. The outflow port 128*a*1 may have a narrow width in the vertical direction and may be elongated in the horizontal direction. The washing water pumped by the blade 123 sequentially passes through the inside of the washing water discharge portion 127, the inside of the circulation duct 126, and the inside of the filter housing 128*a*, and then may be sprayed into the inside of the side wall portion 121*a* through the outflow port 128*a*1.

The driving motor 130 provides power for rotating the pulsator 122 and the blade 123 with a single motor rotational force. When the dewatering shaft 132*b* and the washing shaft 132*a* are integrally rotated, the driving motor 130 provides power for rotating the pulsator 122, the blade 123, and the inner tub 120 integrally by using a single motor rotational force. The rotational force of the driving motor 130 is transmitted to the pulsator 122 and the blade 123 via the washing shaft 132*a* and the gear module. The rotational force of the driving motor 130 may be transmitted to the inner tub 120 via the dewatering shaft 132*b* and the gear module.

Figure 6:
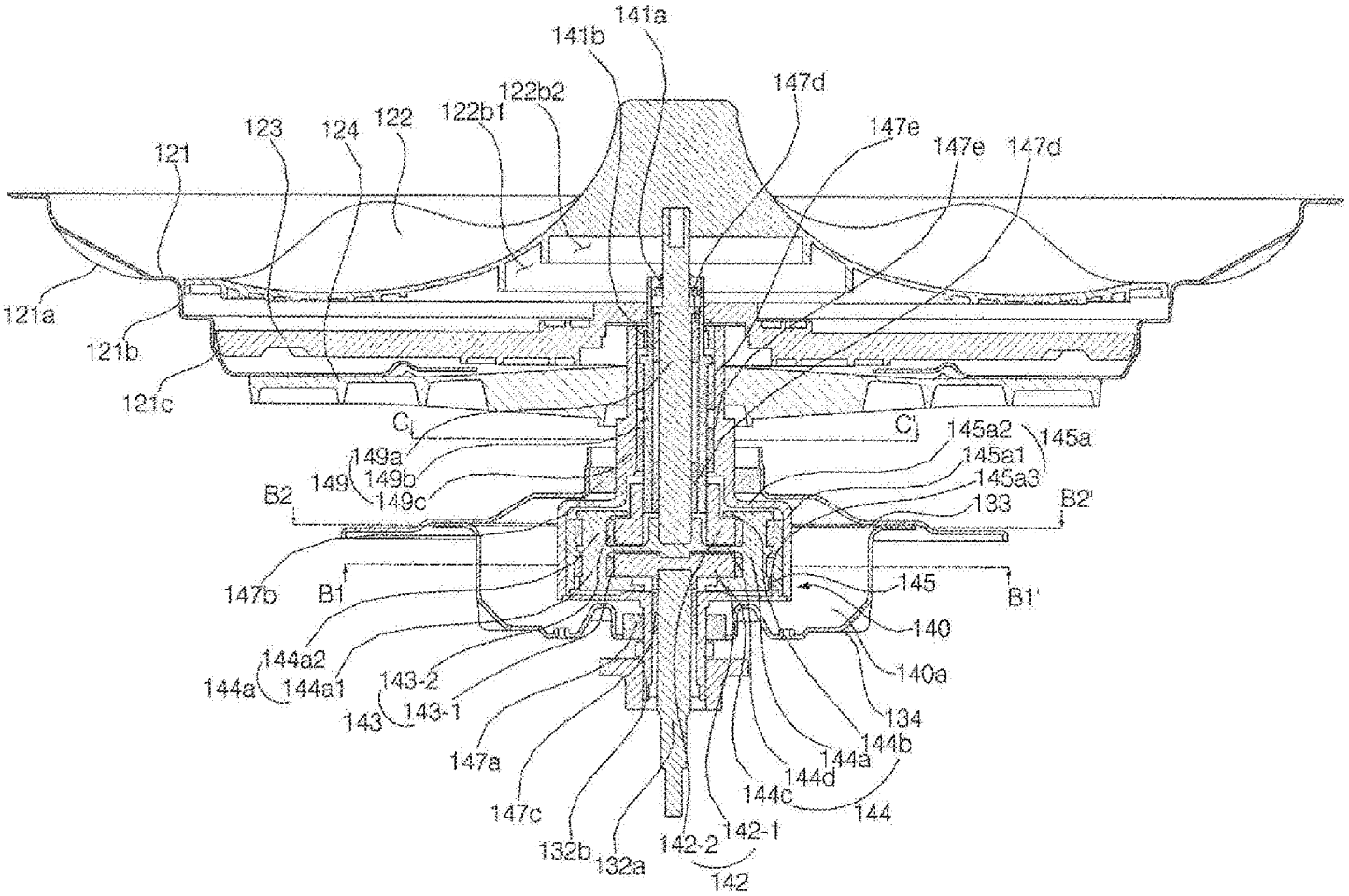
FIG. 6 is an enlarged cross-sectional view of a power transmission portion and the pulsator portion of FIG. 1.
Figure 7A:
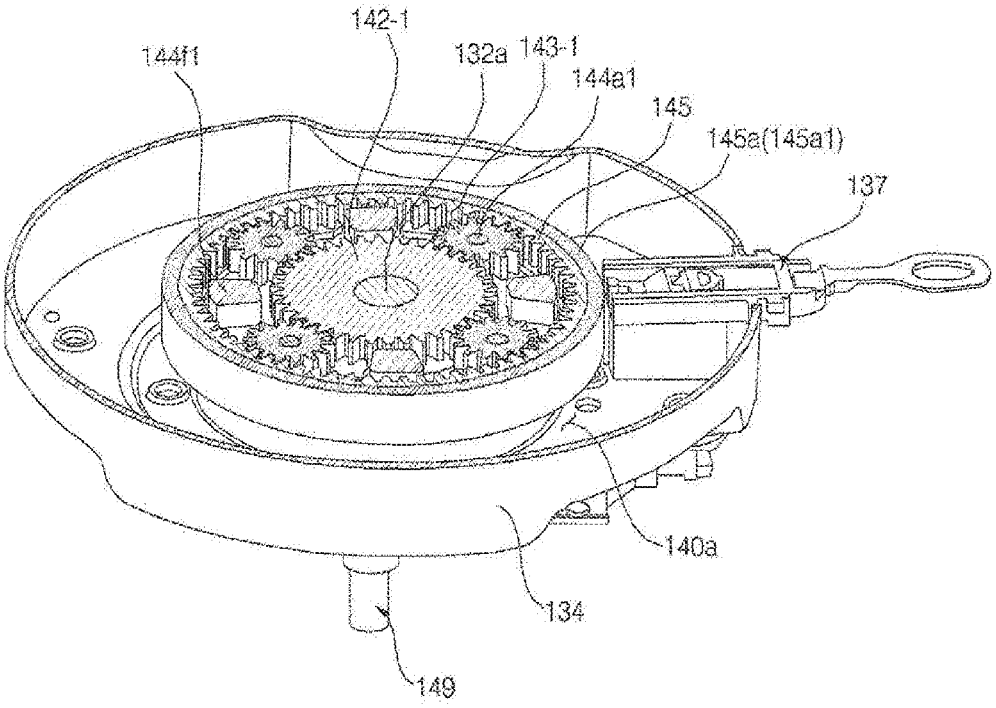
FIG. 7A is a cross-sectional perspective view of the power transmission portion 140 of FIG. 6 cut horizontally along line B1-B1'.
Figure 7B:
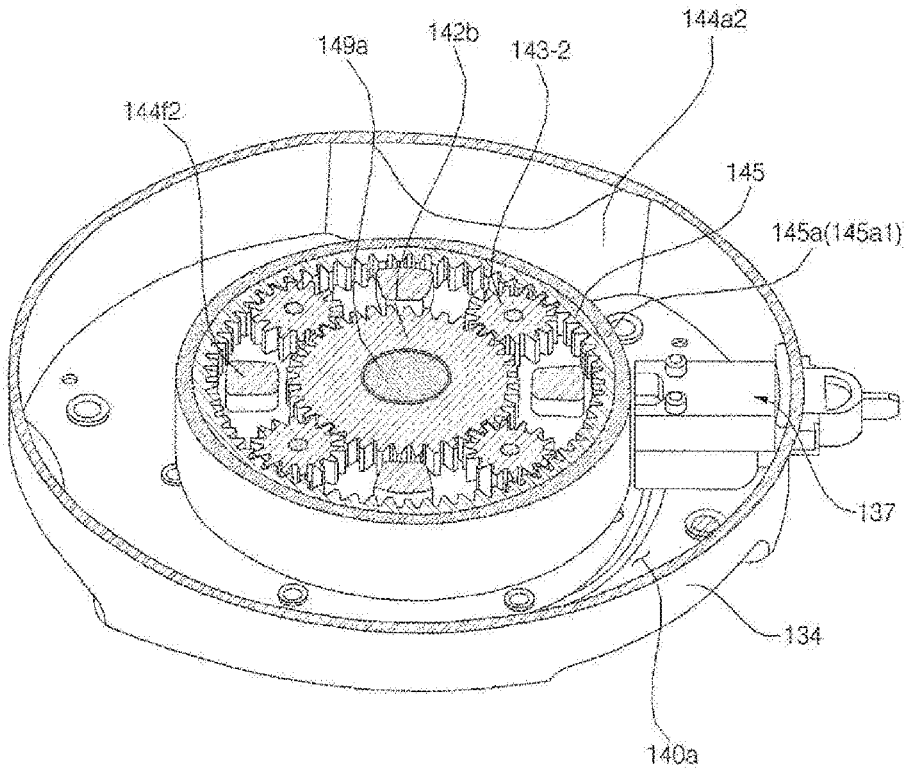
FIG. 7B is a cross-sectional perspective view of the power transmission portion 140 of FIG. 6 cut horizontally along line B1-B2'.
Figure 8:
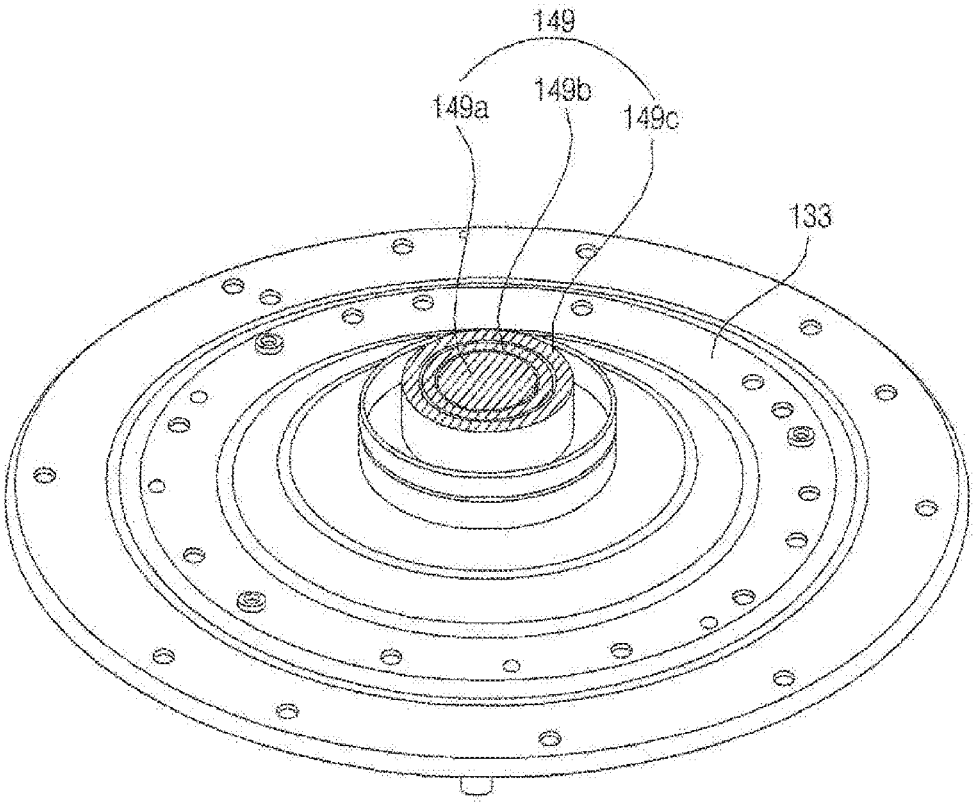
FIG. 8 is a cross-sectional perspective view of the power transmission portion 140 of FIG. 6 cut horizontally along line C-C'.

Hereinafter, the power transmission portion 140 according to the first embodiment will be described in more detail with reference to FIGS. 6 to 8.

The laundry processing apparatus includes a power transmission portion 140 that transmits the rotational force of the driving motor 130 to the pulsator 122 and the blade 123, respectively. The power transmission portion 140 transmits the pulsator 122 and the blade 123 to rotate the rotational force of the driving motor 130, when only the washing shaft 132*a* rotates while the dewatering shaft 132*b* does not rotate by the clutch 137. The power transmission portion 140 transmits the rotational force of the driving motor 130 to the inner tub 120 when the dewatering shaft 132*b* is rotated integrally with the washing shaft 132*a* by the clutch 137.

The power transmission portion 140 includes a gear module 142, 143, 144, and 145 for transmitting rotational force of the washing shaft 132*a* to the concentric shaft assembly 149. The power transmission portion 140 includes the concentric shaft assembly 149 that transmits the rotational force of the gear module 142, 143, 144, 145 to the pulsator 122 and the blade 123, respectively. The power transmission portion 140 includes a bearing 147*a*, 147*b*, 147*c*, 147*d*, and 147*e* disposed between a plurality of components that relatively rotate. The power transmission portion 140 includes a sealer 141*a* and 141*b* for preventing the penetration of the washing water contained in the inner tub 120 into a gap between the plurality of concentric shafts constituting the concentric shaft assembly 149.

The washing shaft 132*a* may rotate integrally with the rotor of the driving motor 130. As another example, it is possible that the washing shaft 132*a* receives the rotating force of the rotor of the driving motor 130 via a belt or a gear. In the present embodiment, the lower portion of the washing shaft 132*a* is fixed to the rotor.

The washing shaft 132*a* rotates integrally with the sun gear 142. The washing shaft 132*a* rotates integrally with a first sun gear 142-1. The upper portion of the washing shaft 132*a* is fixed to the first sun gear 142-1. The upper portion of the washing shaft 132*a* is fixed to the center of the first sun gear 142-1.

The washing shaft 132*a* is disposed to penetrate the center of the dewatering shaft 132*b* vertically. The washing shaft 132*a* is disposed to penetrate the lower portion of a carrier 144. The washing shaft 132*a* is disposed to penetrate a connecting shaft lower plate portion 144*c* of the carrier 144. The washing shaft 132*a* is disposed to penetrate the lower portion of a ring gear housing 145*a*. The washing shaft 132*a* is disposed to penetrate a ring gear lower housing 145*a*3.

When the dewatering shaft 132*b* is brought into close contact with the washing shaft 132*a* by the clutch 137, the dewatering shaft 132*b* rotates integrally with the washing shaft 132*a*. The dewatering shaft 132*b* rotates integrally with the ring gear housing 145*a*. The upper portion of the dewatering shaft 132*b* is fixed to the ring gear housing 145*a*. The upper portion of the dewatering shaft 132*b* is fixed to the lower central portion of the ring gear housing 145*a*. The upper portion of the dewatering shaft 132*b* is fixed to the ring gear lower housing 145*a*3.

The concentric shaft assembly 149 includes a pulsator connecting shaft 149*a* that rotates the pulsator 122. The concentric shaft assembly 149 includes a blade connecting shaft 149*b* for rotating the blade 123. The concentric shaft assembly 149 includes an inner tub connecting shaft 149*c* for rotating the inner tub 120.

The concentric shaft assembly 149 is disposed to penetrate the center of the lower side surface of the outer tub 110. The pulsator connecting shaft 149*a* is disposed to penetrate the lower side surface of the outer tub 110. The blade connecting shaft 149*b* is disposed to penetrate the lower side surface of the outer tub 110. The inner tub connecting shaft 149*c* is disposed to penetrate the lower side surface of the outer tub 110.

The pulsator connecting shaft 149*a* and the blade connecting shaft 149*b* are provided to be concentrically rotated. The pulsator connecting shaft 149*a* and the inner tub connecting shaft 149*c* are provided to be concentrically rotated. The blade connecting shaft 149*b* and the inner tub connecting shaft 149*c* are provided to be concentrically rotated. The pulsator connecting shaft 149*a*, the blade connecting shaft 149*b*, the inner tub connecting shaft 149*c*, the first sun gear 142-1, the second sun gear 142-2, the carrier 144, and the ring gear 145 are provided to be concentrically rotatable based on a single vertical axis.

The pulsator connecting shaft 149*a* and the blade connecting shaft 149*b* are provided to be rotatable independently of each other. The pulsator connecting shaft 149*a* and the inner tub connecting shaft 149*c* are provided to be rotatable independently of each other. The blade connecting shaft 149*b* and the inner tub connecting shaft 149*c* are provided to be rotatable independently of each other. The pulsator connecting shaft 149*a* rotates the pulsator 122 independently from the blade 123. The blade connecting shaft 149*b* rotates the blade 123 independently from the pulsator 122.

The concentric shaft assembly 149 is extended in the vertical direction. The pulsator connecting shaft 149*a* is extended in the vertical direction. The blade connecting shaft 149*b* is extended in the vertical direction. The inner tub connecting shaft 149*c* is extended in the vertical direction.

One of the blade connecting shaft 149*b* and the blade connecting shaft 149*b* is disposed to penetrate the center of the other. The pulsator connecting shaft 149*a* is disposed to penetrate the center of the inner tub connecting shaft 149*c*. The blade connecting shaft 149*b* is disposed to penetrate the center of the inner tub connecting shaft 149*c*. In the present embodiment, the pulsator connecting shaft 149*a* is disposed to penetrate the center of the blade connecting shaft 149*b*. The pulsator connecting shaft 149*a* vertically penetrates the center of the blade connecting shaft 149*b*. The blade connecting shaft 149*b* vertically penetrates the center of the inner tub connecting shaft 149*c*.

The blade connecting shaft 149*b* rotates integrally with the blade 123. The upper portion of the blade connecting shaft 149*b* is fixed to the blade 123. The upper portion of the blade connecting shaft 149*b* is fixed to the center of the blade 123.

The blade connecting shaft 149*b* rotates integrally with the sun gear 142. The blade connecting shaft 149*b* rotates integrally with the second sun gear 142-2. The lower portion of the blade connecting shaft 149*b* is fixed to the second sun gear 142-2. The lower portion of the blade connecting shaft 149*b* is fixed to the center of the second sun gear 142-2.

The blade connecting shaft 149*b* is disposed to penetrate the upper portion of the carrier 144. The blade connecting shaft 149*b* is disposed to penetrate the connecting shaft upper plate portion 144*b* of the carrier 144. The blade connecting shaft 149*b* is disposed to penetrate the upper portion of the ring gear housing 145*a*. The blade connecting shaft 149*b* is disposed to penetrate the ring gear upper housing 145*a*2.

The pulsator connecting shaft 149*a* rotates integrally with the pulsator 122. The upper portion of the pulsator connecting shaft 149*a* is fixed to the pulsator 122. The upper portion of the pulsator connecting shaft 149*a* is fixed to the lower central portion of the pulsator 122.

The pulsator connecting shaft 149*a* rotates integrally with one of the carrier 144 and the ring gear 145. In this case, the other of the carrier 144 and the ring gear 145 is connected to the inner tub connecting shaft 149*c* to be integrally rotatable. The other of a carrier 244 and the ring gear 245 is connected to the dewatering shaft 132*b* to be integrally rotatable.

For example, in a case where the pulsator connecting shaft 149*a* is integrally rotated with the carrier 144, when the washing shaft 132*a* is relatively rotated with respect to the dewatering shaft 132*b* by the clutch 137, the pulsator connecting shaft 149*a* rotates in a rotation speed lower than the rotation speed of the washing shaft 132*a* and in the same rotation direction as the rotation direction of the washing shaft 132*a*. In this case, the lower portion of the inner tub connecting shaft 149*c* is fixed to the ring gear housing 145*a* and maintains a stop state together with the dewatering shaft 132*b* and the ring gear 145. The "rotation" and "stop" mentioned above are relative movements with respect to the inner tub 120.

For another example, in a case where the pulsator connecting shaft 149*a* is integrally rotated with the ring gear 145, when the washing shaft 132*a* is relatively rotated with respect to the dewatering shaft 132*b* by the clutch 137, the pulsator connecting shaft 149*a* rotates in a rotation speed lower than the rotation speed of the washing shaft 132*a* and in the opposite direction to the rotation direction of the washing shaft 132*a*. In this case, the lower portion of the inner tub connecting shaft 149*c* is fixed to the carrier 144 and maintains a stop state together with the dewatering shaft 132*b* and the carrier 144. The "rotation" and "stop" mentioned above are relative movements with respect to the inner tub 120.

In the present embodiment, the pulsator connecting shaft 149*a* rotates integrally with the carrier 144. The lower portion of the pulsator connecting shaft 149*a* is fixed to the carrier 144. The lower portion of the pulsator connecting shaft 149*a* is fixed to a center connecting portion 144*d* of the carrier 144. The lower portion of the pulsator connecting shaft 149*a* is fixed to an upper central portion of the center connecting portion 144*d*.

The pulsator connecting shaft 149*a* is disposed to penetrate the second sun gear 142-2. The pulsator connecting shaft 149*a* is disposed to penetrate the upper portion of the carrier 144. The pulsator connecting shaft 149*a* is disposed to penetrate the connecting shaft upper plate portion 144*b* of the carrier 144. The pulsator connecting shaft 149*a* is disposed to penetrate the upper portion of the ring gear housing 145*a*. The pulsator connecting shaft 149*a* is disposed to penetrate the ring gear upper housing 145*a*2.

The inner tub connecting shaft 149*c* rotates integrally with the inner tub 120. The upper portion of the inner tub connecting shaft 149*c* is fixed to the inner tub 120. The upper portion of the inner tub connecting shaft 149*c* is fixed to the lower central portion of the inner tub 120. The upper portion of the inner tub connecting shaft 149*c* is fixed to the hub 124. The upper portion of the inner tub connecting shaft 149*c* is fixed to the center coupling portion 124*b* of the hub 124.

In the present embodiment, the inner tub connecting shaft 149*c* rotates integrally with the ring gear 145. The inner tub connecting shaft 149*c* rotates integrally with the ring gear housing 145*a*. The lower portion of the inner tub connecting shaft 149*c* is fixed to the ring gear housing 145*a*. The lower portion of the inner tub connecting shaft 149*c* is fixed to the upper central portion of the ring gear housing 145*a*. The lower portion of the inner tub connecting shaft 149*c* is fixed to the ring gear upper housing 145*a*2.

The pulsator connecting shaft 149*a* and the blade connecting shaft 149*b* are spaced apart from each other by a bearing. The blade connecting shaft 149*b* and the inner tub connecting shaft 149*c* are spaced apart from each other by a bearing.

The power transmission portion 140 includes a bearing 147*a*, 147*b*, 147*c*, 147*d*, and 147*e* that supports the washing shaft 132*a*, the dewatering shaft 132*b*, the pulsator connecting shaft 149*a*, the blade connecting shaft 149*b*, and the inner tub connecting shaft 149*c* to be relatively rotatable.

A first bearing 147*a* is provided between the dewatering shaft 132*b* and the driving motor support member 133, 134 so that the dewatering shaft 132*b* can relatively rotate with respect to the driving motor support member 133, 134. A second bearing 147*b* is provided between the inner tub connecting shaft 149*c* and the driving motor support member 133, 134 so that the inner tub connecting shaft 149*c* can relatively rotate with respect to the driving motor support member 133, 134. A third bearing 147*c* is provided between the washing shaft 132*a* and the dewatering shaft 132*b* so that the washing shaft 132*a* can relatively rotate with respect to the dewatering shaft 132*b*. A fourth bearing 147*d* is provided between the pulsator connecting shaft 149*a* and the blade connecting shaft 149*b* so that the pulsator connecting shaft 149*a* can relatively rotate with respect to the blade connecting shaft 149*b*. A plurality of fourth bearings 147*d* may be disposed to be vertically spaced apart. A fifth bearing 147*e* is provided between the blade connecting shaft 149*b* and the inner tub connecting shaft 149*c* so that the blade connecting shaft 149*b* can relatively rotate with respect to the inner tub connecting shaft 149*c*. A plurality of fifth bearings 147*e* may be disposed to be vertically spaced apart.

The power transmission portion 140 includes a sealer 141*a*, 141*b* that blocks the inflow of the washing water into a gap between the respective components of the concentric shaft assembly 149.

A first sealer 141*a* is provided between the pulsator connecting shaft 149*a* and the blade connecting shaft 149*b* to block the inflow of the washing water into the gap between the pulsator connecting shaft 149*a* and the blade connecting shaft 149*b*. The first sealer 141*a* is disposed in the upper end portion of the blade connecting shaft 149*b*. The first sealer 141*a* is disposed above the fourth bearing 147*d*. The upper end of the blade connecting shaft 149*b* is disposed in a space filled with air by the concave groove 122*b*1 of the pulsator 122 so that the washing water can be prevented from being introduced into a gap between the pulsator connecting shaft 149*a* and the blade connecting shaft 149*b*. The first sealer 141*a* may be disposed in the space filled with air by the concave groove 122*b*1 of the pulsator 122.

A second sealer 141*b* is provided between the blade connecting shaft 149*b* and the inner tub connecting shaft 149*c* to block the inflow of the washing water into the gap between the blade connecting shaft 149*b* and the inner tub connecting shaft 149*c*. The second sealer 141*b* is disposed in the upper end portion of the inner tub connecting shaft 149*c*. The second sealer 141*b* is disposed above the fifth bearing 147*e*. The lower central portion of the blade 123 is recessed upward to form an air-filled space, and the upper end of the inner tub connecting shaft 149*c* is disposed in the space in the lower central portion of the blade 123, so that the washing water can be prevented from being introduced into a gap between the blade connecting shaft 149*b* and the inner tub connecting shaft 149*c*. The second sealer 141*b* may be disposed in the air-filled space in the lower central portion of the blade 123.

The gear module 142, 143, 144, 145 is disposed in the lower outer side of the outer tub 110. No other gear is disposed in the concentric shaft assembly 149 inside the inner tub 120. Specifically, the lower end portion of the pulsator connecting shaft 149*a* is connected to the gear module 142, 143, 144, 145, and the upper end portion is connected to the pulsator 122, so that the rotational force of the gear module 142, 143, 144, 145 is directly transmitted to the pulsator 122. The lower end portion of the blade connecting shaft 149*b* is connected to the gear module 142, 143, 144, 145, and the upper end portion is connected to the blade 123, so that the rotational force of the gear module 142, 143, 144, 145 is directly transmitted to the blade 123. The lower end of the inner tub connecting shaft 149*c* is connected to the gear module 142, 143, 144, 145, and the upper end thereof is connected to the inner tub 120, so that the rotational force of the gear module 142, 143, 144, 145 is directly transmitted to the inner tub 120.

The gear module 142, 143, 144, 145 transmits the rotational force of the washing shaft 132*a* to the pulsator connecting shaft 149*a* and the blade connecting shaft 149*b*, respectively. The gear module 142, 143, 144, 145 transmits the rotational force of the dewatering shaft 132*b* to the inner tub connecting shaft 149*c*.

When the washing shaft 132*a* relatively rotates with respect to the dewatering shaft 132*b* by the clutch 137, the gear module 142, 143, 144, 145 decelerates the rotation speed of the washing shaft 132*a* and transmits the rotational force of the washing shaft 132*a* to the pulsator. The gear module 142, 143, 144, 145 decelerates the rotational speed by the gear ratio of the sun gear 142 and the ring gear 145, and transmits the rotational force of the washing shaft 132*a* to the pulsator connecting shaft 149*a*. The gear module 142, 143, 144, 145 is provided in such a manner that the pulsator connecting shaft 149*a* rotates at a rotational speed lower than the rotational speed of the washing shaft 132*a*. The torque of the pulsator 122 is increased as the rotation speed of the washing shaft 132*a* is reduced to be transmitted to the pulsator 122.

When the washing shaft 132*a* relatively rotates with respect to the dewatering shaft 132*b* by the clutch 137, the gear module 142, 143, 144, 145 maintains the rotational speed of the washing shaft 132*a* and transmits the rotational force of the washing shaft 132*a* to the blade 123. The gear module 142, 143, 144, 145 is provided in such a manner that the blade connecting shaft 149*b* rotates at the same rotational direction and at the same rotational speed as the washing shaft 132*a*.

When the washing shaft 132*a* relatively rotates with respect to the dewatering shaft 132*b* by the clutch 137, the gear module 142, 143, 144, 145 can transmit the rotational force of the washing shaft 132*a* to the pulsator 122 and the blade 123 so that the pulsator 122 and the blade 123 rotate in the same direction.

In another embodiment, when the washing shaft 132*a* relatively rotates with respect to the dewatering shaft 132*b* by the clutch 137, the gear module 142, 143, 144, 145 may transmit the rotational force of the washing shaft 132*a* to the pulsator 122 and the blade 123 so that the pulsator 122 and the blade 123 rotate in opposite directions. In this case, the relative rotational speed of the pulsator 122 and the blade 123 is increased, and a more complex water flow can be formed.

The gear module 142, 143, 144, 145 may include a sun gear 142 that rotates integrally with the washing shaft 132*a*. The gear module 142, 143, 144, 145 include a plurality of planetary gears 143 that is engaged and rotate with the outer circumferential surface of the sun gear 142. The gear module 142, 143, 144, 145 includes a carrier 144 having a plurality of planetary gear rotation shafts 144*a*, which are connected to each other, that penetrate a central portion of the plurality of planetary gears 143 respectively. The gear module 142, 143, 144, 145 includes a ring gear 145 which is internally in contact with and engaged with a plurality of planetary gears 143. The gear module 142, 143, 144, 145 include a ring gear housing 145*a* to which the ring gear 145 is fixed to the inner side surface.

The gear module 142, 143, 144, 145 includes a first sun gear 142-1 and a second sun gear 142-2 provided independently of each other.

The first sun gear 142-1 has an upwardly recessed groove formed in a lower central portion thereof. The first sun gear 142-1 may include a protrusion protruding downward from the lower central portion and the groove of the first sun gear 142-1 may be formed in the lower end of the protrusion of the first sun gear 142-1. The protrusion of the first sun gear may be formed in a pipe shape.

The first sun gear 142-1 rotates integrally with the washing shaft 132*a*. The upper portion of the washing shaft 132*a* is fixed to the first sun gear 142-1. A plurality of protrusions such as serrations may be formed along the outer circumferential surface of the upper end portion of the washing shaft 132*a* in order to transmit the power of the washing shaft 132*a*. A plurality of grooves may be formed in the inner circumferential surface of the groove of the first sun gear 142-1 so as to be engaged with the serration protrusion. The upper end of the washing shaft 132*a* may be inserted into the central portion of the first sun gear 142-1. A plurality of gear teeth are formed along the outer circumferential surface of the first sun gear 142-1.

The first sun gear 142-1 is disposed below the center connecting portion 144*d*. The first sun gear 142-1 may be rotatably coupled to the center connecting portion 144*d*. For example, a rotation protrusion may protrude from the central portion of one of the first sun gear 142-1 and the center connecting portion 144*d* toward the central portion of the other, and a groove into which the rotation protrusion is inserted may be formed in the central portion of the other.

The first sun gear 142-1 is disposed below the second sun gear 142-2. The first sun gear 142-1 is disposed in the center of the plurality of first planetary gears 143-1. The first sun gear 142-1 is disposed inside the carrier 144. The first sun gear 142-1 is disposed between the center connecting portion 144*d* of the carrier 144 and the connecting shaft lower plate portion 144*c*. The first sun gear 142-1 is disposed inside the ring gear housing 145*a*.

The second sun gear 142-2 may rotate at the same rotational direction and at the same rotational speed as the first sun gear 142-1. The second sun gear 142-2 rotates integrally with the blade connecting shaft 149*b*. The lower portion of the blade connecting shaft 149*b* is fixed to the second sun gear 142-2. A plurality of protrusions, such as serration, may be formed along the outer circumferential surface of the lower end portion of the blade connecting shaft 149*b* in order to transmit the power of the second sun gear 142-2. A plurality of grooves may be formed in the inner circumferential surface of the upper side central hole of the second sun gear 142-2 so as to be engaged with the serration protrusion. The lower end of the blade connecting shaft 149*b* may be inserted into the center of the second sun gear 142-2. A plurality of gear teeth are formed along the outer circumferential surface of the second sun gear 142-2.

The central portion of the second sun gear 142-2 is formed with a hole which is vertically penetrated. The second sun gear 142-2 may include a protrusion protruding upward from the central portion, and the hole of the second sun gear 142-2 may be formed to vertically penetrate the center of the protrusion of the second sun gear 142-2. The protrusion of the second sun gear may be formed in a pipe shape.

The outer circumferential surface of the lower end portion of the blade connecting shaft 149*b* is coupled with the inner circumferential surface forming the hole of the second sun gear 142-2. A protrusion protruding upward from the center connecting portion 144*d* may be inserted into the lower side of the hole of the second sun gear 142-2. The protrusion of the center connecting portion 144*d* is provided to be relatively rotatable with respect to the second sun gear 142-2. The lower end of the pulsator connecting shaft 149*a* is fixed to the protrusion of the center connecting portion 144*d*. A downwardly recessed hole is formed in the center of the upper side surface of the protrusion of the center connecting portion 144*d*, and the lower end portion of the pulsator connecting shaft 149*a* is inserted and fixed in the hole of the protrusion of the center connecting portion 144*d*.

The second sun gear 142-2 is disposed above the first sun gear 142-1. The second sun gear 142-2 is disposed in the center of the plurality of second planetary gears 143-2. The second sun gear 142-2 is disposed inside the carrier 144. The second sun gear 142-2 is disposed between the center connecting portion 144*d* of the carrier 144 and the connecting shaft upper plate portion 144*b*. The second sun gear 142-2 is disposed inside the ring gear housing 145*a*.

The gear module 142, 143, 144, 145 includes a plurality of first planetary gears 143-1 engaged with the first sun gear 142-1, and a plurality of second planetary gears 143-2 engaged with the second sun gear 142-2.

The plurality of first planetary gears 143-1 are engaged and rotated with the outer circumferential surface of the first sun gear 242-1. Each of the first planetary gears 143-1 has a plurality of gear teeth on the outer circumferential surface. The plurality of first planetary gears 143-1 are disposed apart from each other along the circumferential direction. The first planetary gear 143-1 may be connected to the carrier 144 via the first planetary gear rotation shaft 144*a*1. The first planetary gear rotation shaft 144*a*1 penetrates the center of the first planetary gear 143-1 vertically. The first planetary gear 143-1 is engaged between the first sun gear 142-1 and the ring gear 145 so that gear teeth are engaged with each other. The first planetary gear 143-1 is provided to be rotatable. The first planetary gear 143-1 is able to revolve around the first sun gear 142-1. When the carrier 144 rotates, the plurality of first planetary gears 143-1 revolve together with the carrier 144 around the first sun gear 142-1.

The first planetary gear 143-1 is disposed inside the carrier 144. The first planetary gear 143-1 is disposed between the center connecting portion 144*d* and the connecting shaft lower plate portion 144*c*. The first planetary gear 143-1 is disposed inside the ring gear housing 145*a*.

The plurality of second planetary gears 143-2 are engaged and rotated with the outer circumferential surface of the second sun gear. Each of the second planetary gears 143-2 has a plurality of gear teeth on the outer circumferential surface. The plurality of second planetary gears 143-2 are disposed apart from each other along the circumferential direction. The second planetary gear 143-2 may be connected to the carrier 144 via the second planetary gear rotation shaft 144*a*2. The second planetary gear rotation shaft 144*a*2 penetrates the center of the second planetary gear 143-2 vertically. The second planetary gear 143-2 is engaged between the second sun gear 142-2 and the ring gear 145 so that gear teeth are engaged with each other. The second planetary gear 143-2 is provided to be rotatable. The second planetary gear 143-2 is able to revolve around the second sun gear 142-2. When the carrier 144 rotates, the plurality of second planetary gears 143-2 revolve together with the carrier 144 around the second sun gear 142-2.

The second planetary gear 143-2 is disposed inside the carrier 144. The second planetary gear 143-2 is disposed between the center connecting portion 144*d* and the connecting shaft upper plate portion 144*b*. The second planetary gear 143-2 is disposed inside the ring gear housing 145*a*.

The carrier 144 includes a plurality of planetary gear rotation shafts 144*a* which vertically penetrate the plurality of planetary gears 143 respectively. The plurality of planetary gear rotation shafts 144*a* includes a plurality of first planetary gear rotation shafts 144*a*1 which vertically penetrate a plurality of first planetary gears 143-1 and a plurality of second planetary gears 144*a*2 which vertically penetrate a plurality of second planetary gears 143-2. The carrier 144 has a plurality of first planetary gear rotation shafts 144*a*1 that respectively penetrate the central portion of the plurality of first planetary gears 243-1 and a plurality of second planetary gear rotation shafts 144*a*2 that respectively penetrate the central portion of the plurality of second planetary gears 243-2 so that the plurality of first planetary gear rotation shafts 144*a*1 and the plurality of second planetary gear rotation shafts 144*a*2 are connected to each other.

The carrier 144 supports the upper and lower ends of the planetary gear rotation shaft 144*a*. The carrier 144 supports the upper and lower ends of the first planetary gear rotation shaft 144*a*1. The carrier 144 supports the upper and lower ends of the second planetary gear rotation shaft 144*a*2.

The carrier 144 includes a center connecting portion 144*d* to which the upper end of the plurality of first planetary gear rotation shafts 144*a*1 is fixed. The lower end of the plurality of second planetary gear rotation shafts 144*a*2 is fixed to the center connecting portion 144*d*. The lower portion of the pulsator connecting shaft 149*a* is fixed to the center connecting portion 144*d*. Based on the center connecting portion 144*d*, the first sun gear 142-1 and the plurality of first planetary gears are disposed in the lower side and the second sun gear 142-2 and the plurality of second planetary gears 143-2 are disposed in the upper side. The center connecting portion 144*d* may be disposed horizontally across the center of the gear module 142, 143, 144, 145. The center connecting portion 144*d* may be formed in a plate shape disposed in a horizontal surface as a whole.

The carrier 144 includes the connecting shaft upper plate portion 144*b* fixed to the upper end of the plurality of second planetary gear rotation shafts 144*a*2. The upper end of the second planetary gear rotation shaft 144*a*2 is fixed to the connecting shaft upper plate portion 144*b*. The second sun gear 142-2 and the plurality of second planetary gears 143-2 are disposed below the connecting shaft upper plate portion 144*b*. The connecting shaft upper plate portion 144*b* may be formed in a plate shape that is disposed in the horizontal surface as a whole. A hole may be formed in the center of the connecting shaft upper plate portion 144*b*. The pulsator connecting shaft 149*a* or the protrusion of the center connecting portion 144*d* may be disposed to penetrate the hole of the connecting shaft upper plate portion 144*b*. The blade connecting shaft 149*b* or the protrusion of the second sun gear 142-2 may be disposed to penetrate the hole of the connecting shaft upper plate portion 144*b*.

The carrier 144 includes a connecting shaft lower plate portion 144*c* fixed to the lower end of the plurality of first planetary gear rotation shafts 144*a*1. The lower end of the first planetary gear rotation shaft 144*a*1 is fixed to the connecting shaft lower plate portion 144*c*. The first sun gear 142-1 and the plurality of first planetary gears 143-1 are disposed above the connecting shaft lower plate portion 144*c*. The connecting shaft lower plate portion 144*c* may be formed in a plate shape disposed in the horizontal surface as a whole. A hole may be formed in the center of the connecting shaft lower plate portion 144*c*. The washing shaft 132*a* or the protrusion of the first sun gear 142-1 may be disposed to penetrate the hole of the connecting shaft lower plate portion 144*c*.

The carrier 144 includes a first reinforcing portion 144*f*1 disposed in a gap where the plurality of first planetary gears 143-1 are spaced apart from each other. The first reinforcing portion 144*f*1 connects and fixes the center connecting portion 144*d* and the connecting shaft lower plate portion 144*c*.

The carrier 144 includes a second reinforcing portion 144*f*2 disposed in a gap where the plurality of second planetary gears 143-2 are spaced apart from each other. The second reinforcing portion 144*f*2 connects and fixes the center connecting portion 144*d* and the connecting shaft upper plate portion 144*b*.

The ring gear 145 is internally engaged with the plurality of first planetary gears 143-1 simultaneously. The ring gear 145 is internally engaged with the plurality of second planetary gears 143-2 simultaneously. It may be internally engaged with the plurality of first planetary gears 143-1 and the plurality of second planetary gears 143-2 simultaneously.

The ring gear 145 has a plurality of gear teeth formed along the inner circumferential surface so as to be engaged with the gear teeth in the outer circumferential surface of the plurality of planetary gears 143. The ring gear 145 has a plurality of gear teeth formed along the inner circumferential surface so as to be engaged with the gear teeth in the outer circumferential surface of the plurality of first planetary gears 143-1 and the gear teeth in the outer circumferential surface of the plurality of second planetary gears 143-2 simultaneously.

The ring gear 145 is fixed to the ring gear housing 145*a*. The upper portion of the dewatering shaft 132*b* is fixed to the ring gear housing 145*a*. The lower portion of the inner tub connecting shaft 149*c* is fixed to the ring gear housing 145*a*. The carrier 144 is accommodated inside the ring gear housing 145*a*.

The ring gear housing 145*a* includes a ring gear lateral housing 145*a*1 forming an outer circumferential surface. The ring gear 145 is disposed in the lateral surface of the opposite direction to the centrifugal side of the ring gear lateral housing 145*a*1.

The ring gear housing 145*a* includes a ring gear upper housing 145*a*2 that forms an upper side surface. The lower portion of the inner tub connecting shaft 149*c* is fixed to the ring gear upper housing 145*a*2. The blade connecting shaft 149*b* is disposed to penetrate the upper side surface of the ring gear housing 145*a*. The blade connecting shaft 149*b* is disposed to penetrate the center of the ring gear upper housing 145*a*2. The pulsator connecting shaft 149*a* is disposed to penetrate the upper side surface of the ring gear housing 145*a*. The pulsator connecting shaft 149*a* is disposed to penetrate the center of the ring gear upper housing 145*a*2.

A protrusion protruding upward from the central portion of the ring gear upper housing 145*a*2 may be formed and a hole penetrating the center of the protrusion of the ring gear upper housing 145*a*2 may be formed. The protrusion of the ring gear upper housing 145*a*2 may be formed in a pipe shape. The inner tub connecting shaft 149*c* may be inserted and fixed in the hole of the ring gear upper housing 145*a*2. The blade connecting shaft 149*b* and the pulsator connecting shaft 149*a* are disposed to penetrate the hole of the ring gear upper housing 145*a*2.

The ring gear housing 145*a* includes a ring gear lower housing 145*a*3 forming a lower side surface. The upper portion of the dewatering shaft 132*b* is fixed to the ring gear lower housing 145*a*3. The dewatering shaft 132*b* and the ring gear lower housing 145*a*3 may be integrally formed. The washing shaft 132*a* is disposed to penetrate the lower side surface of the ring gear housing.

Hereinafter, the laundry processing apparatus according to a second embodiment will be described with reference to FIGS. 11 to 20, based on a difference from the first embodiment.

In the second embodiment, the upper portion of the shaft coupling portion 123*c* may be inserted into the shaft support groove 122*b*2 of the pulsator 122. The upper central portion of the blade 123 may be rotatably contacted with the lower central portion of the pulsator 122. For example, a protrusion protruding upward from the upper side surface of the shaft coupling portion 123*c* of the blade 123 may be formed, and a recessed groove engaged with the protrusion of the shaft coupling portion 123*c* may be formed in the lower central portion of the pulsator 122. The blade 123 is relatively rotatable with respect to the pulsator 122 in a state in which the protrusion of the shaft coupling portion 123*c* is inserted into and in contact with the groove of the blade 123.

The laundry processing apparatus according to the second embodiment includes a pulsator connecting shaft 249*b* for rotating the pulsator 122. The laundry processing apparatus includes a blade connecting shaft 249*c* for rotating the blade 123. The pulsator connecting shaft 249*b* is disposed below the blade 123. The upper end of the pulsator connecting shaft 249*b* is disposed below the blade 123. That is, the pulsator connecting shaft 249*b* does not penetrate the blade 123. A pulsator connection frame 248 is provided to transmit the rotational force of the pulsator connecting shaft 249*b* to the pulsator 122 without interfering with the blade 123 independently rotating from the pulsator 122.

The laundry processing apparatus includes the pulsator connection frame 248 that connects the upper portion of the pulsator connecting shaft 249*b* and the pulsator 122 to transmit the rotational force of the pulsator connecting shaft 249*b* to the pulsator 122. The pulsator connection frame 248 is extended between the blade and the inner tub, and connects the upper portion of the pulsator connecting shaft and the pulsator. The pulsator connection frame 248 avoids the rotation orbit of the blade 123 and connects the upper portion of the pulsator connecting shaft 249*b* and the pulsator 122.

The pulsator connection frame 248 rotates integrally with the pulsator connecting shaft 249*b*. The upper portion of the pulsator connecting shaft 249*b* is fixed to the central portion of the pulsator connection frame 248.

The pulsator connection frame 248 rotates integrally with the pulsator 122. The edge portion of the pulsator 122 is fixed to the pulsator connection frame 248. The pulsator 122 is fixed to the edge portion of the pulsator connection frame 248.

The pulsator connection frame 248 is disposed between the blade 123 and the inner tub 120. The lower side surface and the edge of the blade 123 form a gap between the inner surface of the inner tub 120, and the pulsator connection frame 248 is disposed in the gap. The pulsator connection frame 248 is disposed below the blade 123. The pulsator connection frame 248 is disposed in the upper side of the bottom surface of the inner tub 120. The pulsator connecting shaft 249*b* is disposed above the hub 124.

A central portion of the pulsator connection frame 248 is disposed below the blade 123. A part of the edge portion of the pulsator connection frame 248 is disposed above the blade 123 and connected to the pulsator 122.

The pulsator connection frame is disposed to be spaced apart from the rotation orbit of the blade 123. The rotation orbit of the pulsator connection frame 248 and the rotation orbit of the blade 123 are spaced from each other so as not to interfere with each other's rotational motion.

The pulsator connection frame is disposed so as to be spaced apart from the rotation trajectory of the inner tub 120. The rotating track of the pulsator connection frame 248 and the rotating track of the inner tub 120 are spaced from each other so as not to interfere with each other's rotational motion.

The pulsator connection frame 248 is formed in a shape that covers the lower side surface and the edge of the blade 123 as a whole. The pulsator connection frame 248 may be formed in a plate shape disposed on a horizontal plane as a whole.

The pulsator connection frame 248 includes a centrifugal extension portion 248*a* that is extended in the centrifugal direction from the rotational axis of the pulsator connection frame 248. The pulsator connection frame 248 includes an upward extension portion 248*b* that is extended upwardly from the centrifugal extension portion 248*a*. The pulsator connection frame 248 includes a pulsator coupling portion 248*c* disposed in the upper portion of the upward extension portion 248*b* and coupled with the pulsator 122. The pulsator connection frame 248 includes a central shaft coupling portion 248*d* which is disposed in the central portion and coupled with the upper portion of the pulsator connecting shaft 249*b*. The pulsator connection frame 248 forms a water flow through hole 248*e* penetrating in the vertical direction. The pulsator connection frame 248 includes a reinforcing portion 248*f* that is disposed between the plurality of centrifugal extension portions and reinforces the rigidity.

The centrifugal extension portion 248*a* is extended in the centrifugal direction from the central portion of the pulsator connection frame 248. The centrifugal extension portion 248*a* is disposed between the lower side surface of the blade 123 and the inner lower side surface of the inner tub 120. A plurality of centrifugal extension portions 248*a* may be provided. The plurality of centrifugal extension portions 248*a* may be formed radially. One end of the plurality of centrifugal extension portions 248*a* is connected to the central portion of the pulsator connection frame 248, and the other end of the plurality of centrifugal extension portions 248*a* may be extended in the centrifugal direction to be connected to the reinforcing portion 248*f*. The centrifugal extension portion 248*a* may be extended from the central portion of the pulsator connection frame 248 to a position further away from the edge of the blade 123 in the centrifugal direction. The centrifugal extension portion 248*a* may be extended to a position spaced apart from the inner surface of the inner tub 120.

The centrifugal extension portion 248*a* includes a first centrifugal extension portion 248*a*1 extended from the central portion of the pulsator connection frame 248 to the reinforcing portion 248*f*. A plurality of first centrifugal extension portions 248*a*1 may be provided. The plurality of first centrifugal extension portions 248*a*1 may be radially formed. One end portion of the plurality of first centrifugal extension portions 248*a*1 is connected to the central portion of the pulsator connection frame 248, and the other end portion of the plurality of first centrifugal extension portions 248*a*1 is extended in the centrifugal direction and connected to the reinforcing portion 248*f*. In the present embodiment, six first centrifugal extension portions 248*a*1 are disposed at intervals of 60 degrees in the circumferential direction.

The centrifugal extension portion 248*a* includes a second centrifugal extension portion 248*a*2 extended to a position further away from the edge of the blade 123 in the centrifugal direction when viewed from above. The second centrifugal extension portion 248*a*2 may be extended from the reinforcing portion 248*f* to a position spaced apart from the inner surface of the inner tub 120. The second centrifugal extension portion 248*a*2 may be extended in the centrifugal direction from a distal end portion of the first centrifugal extension portion 248*a*1. A plurality of second centrifugal extension portions 248*a*2 may be provided. The number of the plurality of second centrifugal extension portions 248*a*2 may be less than the number of the plurality of first centrifugal extension portions 248*a*1. The second centrifugal extension portion 248*a*2 provides a point of support for the upward extension portion 248*b*. In the present embodiment, three second centrifugal extension portions 248*a*2 are disposed at an interval of 120 degrees in the circumferential direction.

The pulsator connection frame 248 includes the upward extension portion 248*b* connecting the centrifugal extension portion 248*a* and the pulsator 122. The upward extension portion 248*b* protrudes upward from the distal end portion of the centrifugal direction of the centrifugal extension portion 248*a*. The upward extension portion 248*b* is extended upward from a position away from the edge of the blade 123 in the centrifugal direction. The upward extension portion 248*b* is disposed to pass through a gap between the edge of the blade 123 and the inner surface of the inner tub 120. The upper end of the upward extension portion 248*b* is extended to the edge of the pulsator 122. In the upper end portion of the upward extension portion 248*b*, the pulsator coupling portion 248*c* is provided. The lower end portion of the upward extension portion 248*b* is extended to the second upward extension portion 248*a*2.

The pulsator connection frame 248 includes the pulsator coupling portion 248*c* disposed in the upper end portion of the upward extension portion 248*b*. The pulsator coupling portion 248*c* is coupled with the pulsator 122. The pulsator coupling portion 248*c* may be coupled with the lower side surface of the pulsator 122. The pulsator coupling portion 248*c* may be coupled with the edge portion of the pulsator 122. The pulsator 122 may be fastened to the pulsator coupling portion 248*c* by a fastening member such as a screw.

The pulsator connection frame 248 includes a central shaft coupling portion 248*d* disposed in a central portion thereof. The central shaft coupling portion 248*d* is coupled with the pulsator connecting shaft 249*b*. The central shaft coupling portion 248*d* is coupled with the upper portion of the pulsator connecting shaft 249*b*. The blade connecting shaft 249*c* is disposed to penetrate the central shaft coupling portion 248*d*.

The pulsator connection frame 248 is formed with a water flow through hole 248*e* penetrating in the vertical direction. Through the water flow through hole 248*e*, the washing water in the lower side of the blade 123 may penetrate the pulsator connection frame 248 in the vertical direction. A plurality of water flow through holes 248*e* may be formed in the pulsator connection frame 248. The plurality of water flow through holes 248*e* may be disposed to be spaced from each other in the circumferential direction.

The pulsator connection frame 248 includes the reinforcing portion 248*f* that connects between the plurality of centrifugal extension portions 248*a* and is extended in the circumferential direction. The reinforcing portion 248*f* is extended along the edge of the pulsator connection frame 248. The water flow through hole 248*e* is formed between the reinforcing portion 248*f* and the plurality of centrifugal extension portions 248*a*.

Referring to FIGS. 16A to 18, the power transmission portion 240 according to the second embodiment will be described in more detail as follows.

The laundry processing apparatus includes a power transmission portion 240 that transmits the rotational force of the driving motor 130 to the pulsator 122 and the blade 123, respectively. When only the washing shaft 132*a* rotates while not rotating the dewatering shaft 132*b* by the clutch 137, the power transmission portion 240 transmits the rotational force of the driving motor 130 to the pulsator 122 and the blade 123. When the dewatering shaft 132*b* is rotated integrally with the washing shaft 132*a* by the clutch 137, the power transmission portion 240 transmits the rotational force of the driving motor 130 to the inner tub 120 as well.

The power transmission portion 240 includes a gear module 242, 243, 244, 245 that transmits the rotational force of the washing shaft 132*a* to the concentric shaft assembly 249. The power transmission portion 240 includes a concentric shaft assembly 249 for transmitting rotational force of the gear module 242, 243, 244 245 to the pulsator 122 and the blade 123, respectively. The power transmission portion 240 includes a bearing 247*a*, 247*b*, 247*c*, 247*d*, 247*e* disposed between a plurality of components that relatively rotate with respect to each other. The power transmission portion 240 includes a sealer 241*a*, 241*b* that prevent the penetration of the washing water in the inner tub 120 into a gap between a plurality of concentric shafts constituting the concentric shaft assembly 249.

The washing shaft 132*a* may rotate integrally with the rotor of the driving motor 130. As another example, it is possible that the washing shaft 132*a* receives the rotating force of the rotor of the driving motor 130 through a belt or a gear. In the present embodiment, the lower portion of the washing shaft 132*a* is fixed to the rotor.

The washing shaft 132*a* rotates integrally with the sun gear 242. The upper portion of the washing shaft 132*a* is fixed to the sun gear 242. The upper portion of the washing shaft 132*a* is fixed to the central portion of the sun gear 242.

The washing shaft 132*a* is disposed to penetrate the center of the dewatering shaft 132*b* vertically. The washing shaft 132*a* is disposed to penetrate the lower portion of the carrier 244. The washing shaft 132*a* is disposed to penetrate a connecting shaft lower plate portion 244*c* of the carrier 244.

Figure 16A:
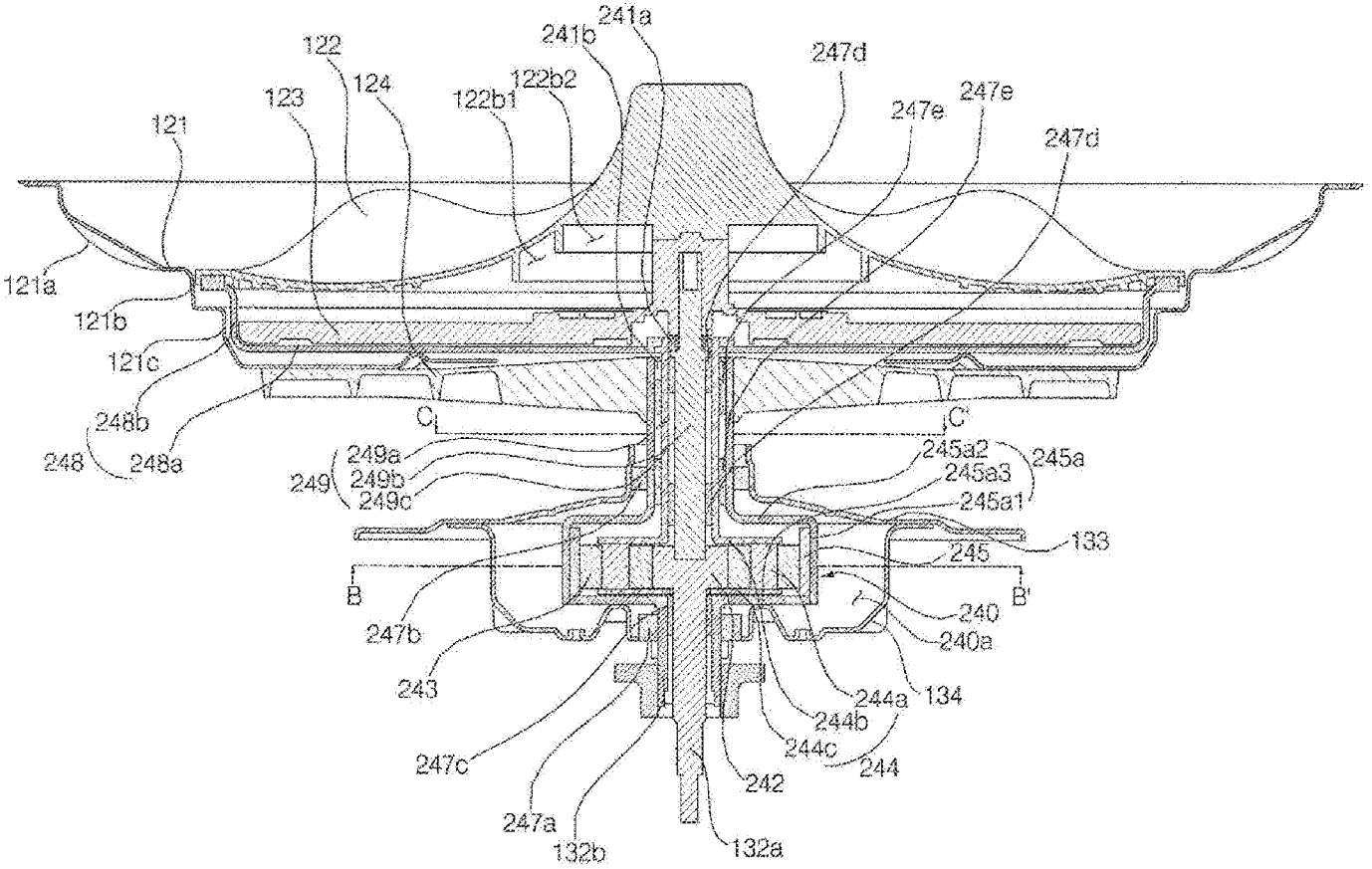
FIG. 16A is an enlarged cross-sectional view of a power transmission portion 240 and the pulsator portion according to a 2-A embodiment of the present invention.

In a 2-A embodiment of FIG. 16A, the washing shaft 132*a* is disposed to penetrate the lower portion of a ring gear housing 245*a*. The washing shaft 132*a* is disposed to penetrate the lower portion of the ring gear housing 245*a*. The washing shaft 132*a* is disposed to penetrate a ring gear lower housing 245*a*3.

Figure 16B:
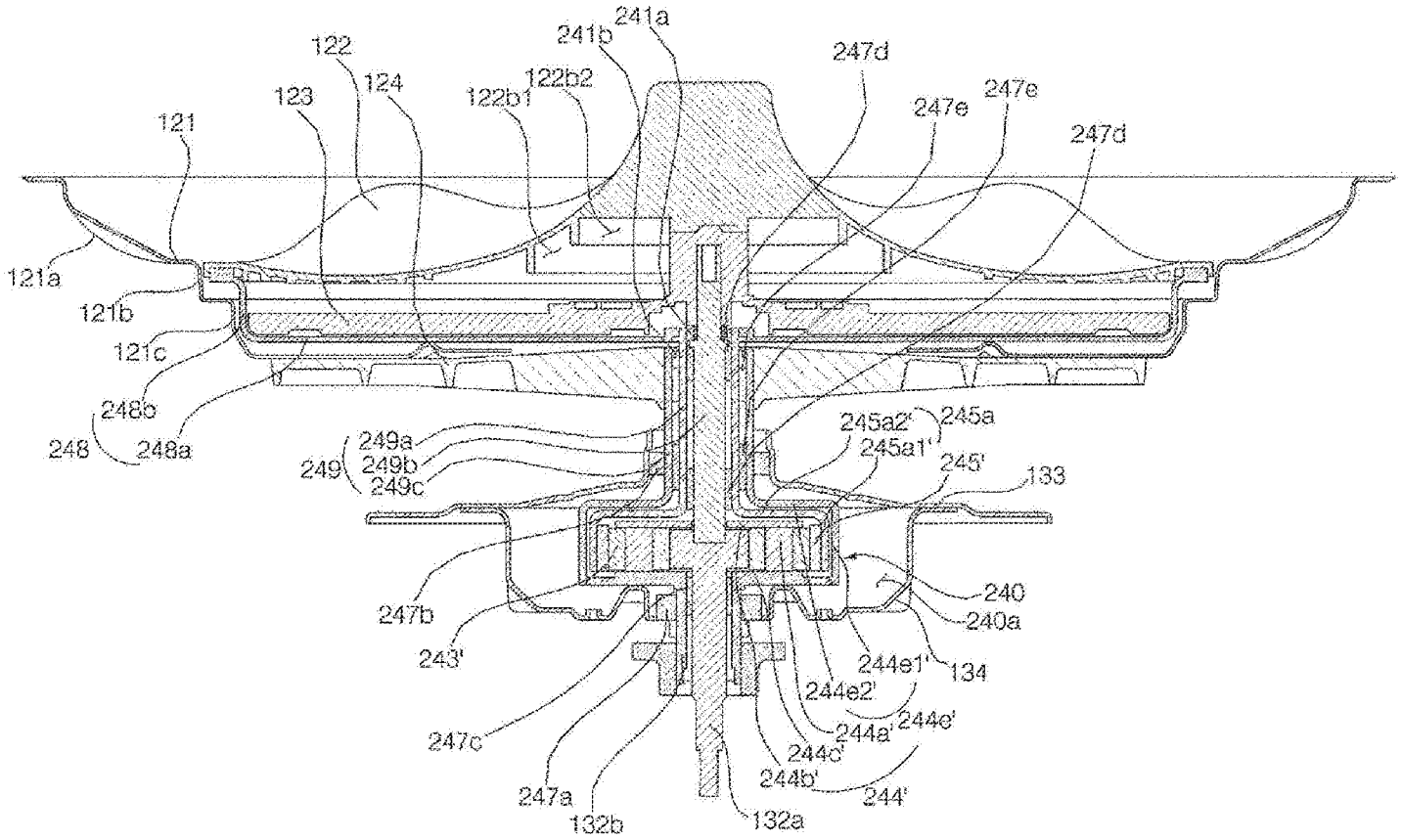
FIG. 16B is an enlarged cross-sectional view of a power transmission portion 240 and the pulsator portion according to a 2-B embodiment of the present invention.
Figure 17:
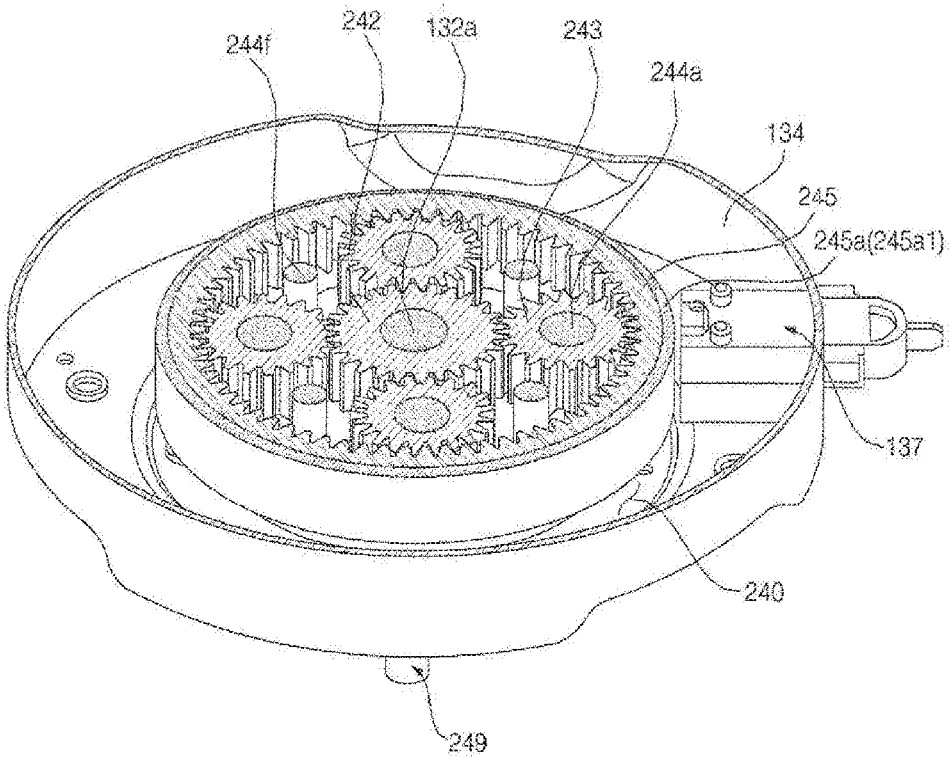
FIG. 17 is a cross-sectional perspective view of the power transmission portion 240 of FIG. 16A cut horizontally along line B-B'.
Figure 18:
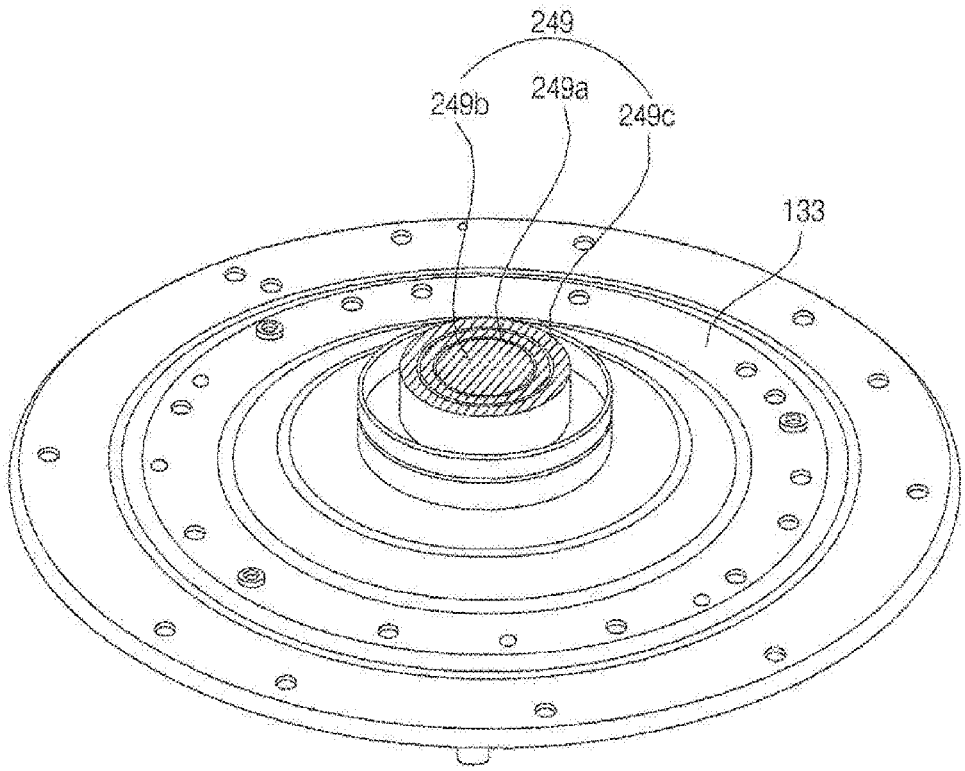
FIG. 18 is a cross-sectional perspective view of the power transmission portion 240 of FIG. 16A cut horizontally along line C-C'.

In a 2-B embodiment of FIG. 16B, a ring gear housing 245*a*' has a form which has a lower portion that is opened. In this case, the washing shaft 132*a* is inserted into the opened lower portion of the ring gear housing 245*a*'.

When the dewatering shaft 132*b* is brought into close contact with the washing shaft 132*a* by the clutch 137, the dewatering shaft 132*b* rotates integrally with the washing shaft 132*a*.

In the 2-A embodiment of FIG. 16A, the dewatering shaft 132*b* rotates integrally with the ring gear housing 245*a*. The upper portion of the dewatering shaft 132*b* is fixed to the ring gear housing 245*a*. The upper portion of the dewatering shaft 132*b* is fixed to the lower central portion of the ring gear housing 245*a*. The upper portion of the dewatering shaft 132*b* is fixed to the ring gear lower housing 245*a*3.

In the 2-B embodiment of FIG. 16B, the dewatering shaft 132*b* rotates integrally with a carrier 244'. The upper portion of the dewatering shaft 132*b* is fixed to the carrier 244'. The upper portion of the dewatering shaft 132*b* is fixed to the lower central portion of the carrier 244'. The upper portion of the dewatering shaft 132*b* is fixed to a connecting shaft lower plate portion 244*c*'.

The concentric shaft assembly 249 includes a pulsator connecting shaft 249*a* that rotates the pulsator 122. The concentric shaft assembly 249 includes a blade connecting shaft 249*b* that rotates the blade 123. The concentric shaft assembly 249 includes an inner tub connecting shaft 249*c* that rotates the inner tub 120.

The concentric shaft assembly 249 is disposed to penetrate the center of the lower side surface of the outer tub 110. The pulsator connecting shaft 249*a* is disposed to penetrate the lower side surface of the outer tub 110. The blade connecting shaft 249*b* is disposed to penetrate the lower side surface of the outer tub 110. The inner tub connecting shaft 249*c* is disposed to penetrate the lower side surface of the outer tub 110.

The pulsator connecting shaft 249*a* and the blade connecting shaft 249*b* are provided to rotate concentrically. The pulsator connecting shaft 249*a* and the inner tub connecting shaft 249*c* are provided to rotate concentrically. The blade connecting shaft 249*b* and the inner tub connecting shaft 249*c* are provided to rotate concentrically. The pulsator connecting shaft 249*a*, the blade connecting shaft 249*b*, the inner tub connecting shaft 249*c*, the sun gear 242, the carrier 244, and the ring gear 245 are provided to be concentrically rotatable based on a single vertical axis.

The pulsator connecting shaft 249*a* and the blade connecting shaft 249*b* are provided to be rotatable independently of each other. The pulsator connecting shaft 249*a* and the inner tub connecting shaft 249*c* are provided to be rotatable independently of each other. The blade connecting shaft 249*b* and the inner tub connecting shaft 249*c* are provided to be rotatable independently of each other. The pulsator connecting shaft 249*a* rotates the pulsator 122 independently from the blade 123. The blade connecting shaft 249*b* rotates the blade 123 independently from the pulsator 122.

The concentric shaft assembly 249 is extended in the vertical direction. The pulsator connecting shaft 249*a* is extended in the vertical direction. The blade connecting shaft 249*b* is extended in the vertical direction. The inner tub connecting shaft 249*c* is extended in the vertical direction.

The blade connecting shaft 249*b* and the blade connecting shaft 249*b* are disposed in such a manner that one of them penetrates the center of the other. The pulsator connecting shaft 249*a* is disposed to penetrate the center of the inner tub connecting shaft 249*c*. The blade connecting shaft 249*b* is disposed to penetrate the center of the inner tub connecting shaft 249*c*. In the present embodiment, the blade connecting shaft 249*b* is disposed to penetrate the center of the pulsator connecting shaft 249*a*. The blade connecting shaft 249*b* penetrates the center of the pulsator connecting shaft 249*a* vertically. The pulsator connecting shaft 249*a* penetrates the center of the inner tub connecting shaft 249*c* vertically.

The blade connecting shaft 249*b* rotates integrally with the blade 123. The upper portion of the blade connecting shaft 249*b* is fixed to the blade 123. The upper portion of the blade connecting shaft 249*b* is fixed to the central portion of the blade 123.

The blade connecting shaft 249*b* rotates integrally with the sun gear 242. The lower portion of the blade connecting shaft 249*b* is fixed to the sun gear 242. The lower portion of the blade connecting shaft 249*b* is fixed to the central portion of the sun gear 242.

The blade connecting shaft 249*b* is disposed to penetrate the upper portion of the carrier 244. The blade connecting shaft 249*b* is disposed to penetrate the connecting shaft upper plate portion 244*b* of the carrier 244.

In the 2-A embodiment of FIG. 16A, the blade connecting shaft 249*b* is disposed to penetrate the upper portion of the ring gear housing 245*a*. The blade connecting shaft 249*b* is disposed to penetrate a ring gear upper housing 245*a*2.

In the 2-B embodiment of FIG. 16B, the blade connecting shaft 249*b* is disposed to penetrate the upper portion of a ring gear housing 245*a*'. The blade connecting shaft 249*b* is disposed to penetrate a ring gear upper housing 245*a*2'. In addition, the blade connecting shaft 249*b* is disposed to penetrate an upper portion of the carrier housing 244*e*'. The blade connecting shaft 249*b* is disposed to penetrate a carrier upper housing 244*e*2'.

The pulsator connecting shaft 249*a* rotates integrally with the pulsator 122. The upper portion of the pulsator connecting shaft 249*a* is fixed to the pulsator connection frame 248.

The upper portion of the pulsator connecting shaft 249*a* is fixed to the central portion of the pulsator connection frame 248.

The pulsator connecting shaft 249*a* rotates integrally with any one of the carrier 244 and the ring gear 245'. In this case, the other one of the carrier 244' and the ring gear 245 is integrally and rotatably connected to the inner tub connecting shaft 249*c*. The other one of the carrier 244' and the ring gear 245 is integrally and rotatably connected to the dewatering shaft 132*b*.

In the 2-A embodiment of FIG. 16A, the pulsator connecting shaft 249*a* is provided to rotate integrally with the carrier 244. The lower portion of the pulsator connecting shaft 249*a* is fixed to the carrier 244. The pulsator connecting shaft 249*a* is disposed to penetrate the upper portion of the ring gear housing 245*a*. The pulsator connecting shaft 249*a* is disposed to penetrate the ring gear upper housing 245*a*2. When the washing shaft 132*a* relatively rotates with respect to the dewatering shaft 132*b* by the clutch 137, the pulsator connecting shaft 249*a* is rotated at a rotational speed lower than the rotational speed of the washing shaft 132*a* and is rotated in the same rotating direction as the rotating direction of the washing shaft 132*a*. In this case, the lower portion of the inner tub connecting shaft 249*c* is fixed to the ring gear housing 245*a*, and maintains a stop state together with the dewatering shaft 132*b* and the ring gear 245. The "rotation" and "stop" mentioned above are relative movements with respect to the inner tub 120.

In the 2-B embodiment of FIG. 16B, the pulsator connecting shaft 249*a* is provided to rotate integrally with the ring gear 245'. The lower portion of the pulsator connecting shaft 249*a* is fixed to the ring gear housing 245*a*'. The pulsator connecting shaft 249*a* is disposed to penetrate the upper portion of the carrier housing 244*e*' The pulsator connecting shaft 249*a* is disposed to penetrate the carrier upper housing 244*e*2'. When the washing shaft 132*a* relatively rotates with respect to the dewatering shaft 132*b* by the clutch 137, the pulsator connecting shaft 249*a* is rotated at a rotational speed lower than the rotational speed of the washing shaft 132*a* and is rotated in the direction opposite to the rotating direction of the washing shaft 132*a*. In this case, the lower portion of the inner tub connecting shaft 249*c* is fixed to the carrier 244' and maintains the stop state together with the dewatering shaft 132*b*. The "rotation" and "stop" mentioned above are relative movements with respect to the inner tub 120.

The inner tub connecting shaft 249*c* rotates integrally with the inner tub 120. The upper portion of the inner tub connecting shaft 249*c* is fixed to the inner tub 120. The upper portion of the inner tub connecting shaft 249*c* is fixed to the lower central portion of the inner tub 120. The upper portion of the inner tub connecting shaft 249*c* is fixed to the hub 124. The upper portion of the inner tub connecting shaft 249*c* is fixed to the center coupling portion 124*b* of the hub 124.

In the 2-A embodiment of FIG. 16A, the inner tub connecting shaft 249*c* rotates integrally with the ring gear 245. The inner tub connecting shaft 249*c* rotates integrally with the ring gear housing 245*a*. The lower portion of the inner tub connecting shaft 249*c* is fixed to the ring gear housing 245*a*. The lower portion of the inner tub connecting shaft 249*c* is fixed to the upper central portion of the ring gear housing 245*a*. The lower portion of the inner tub connecting shaft 249*c* is fixed to the ring gear upper housing 245*a*2.

In the 2-B embodiment of FIG. 16B, the inner tub connecting shaft 249*c* rotates integrally with the carrier 244'. The inner tub connecting shaft 249*c* rotates integrally with the carrier housing 244*e*'. The lower portion of the inner tub connecting shaft 249*c* is fixed to the carrier housing 244*e*'. The lower portion of the inner tub connecting shaft 249*c* is fixed to the upper central portion of the carrier housing 244*e*'. The lower portion of the inner tub connecting shaft 249*c* is fixed to the carrier upper housing 244*a*2'.

The pulsator connecting shaft 249*a* and the blade connecting shaft 249*b* are spaced apart from each other by a bearing. The pulsator connecting shaft 249*a* and the inner tub connecting shaft 249*c* are spaced apart from each other by a bearing.

The power transmission portion 240 includes a bearing 247*a*, 247*b*, 247*c*, 247*d*, 247*e* that supports the washing shaft 132*a*, the dewatering shaft 132*b*, the pulsator connecting shaft 249*a*, the blade connecting shaft 249*b*, and the inner tub connecting shaft 249*c* to be relatively rotatable.

A first bearing 247*a* is provided between the dewatering shaft 132*b* and the driving motor support member 133, 134, so that the dewatering shaft 132*b* can relatively rotate with respect to the driving motor support member 133, 134. A second bearing 247*b* is provided between the inner tub connecting shaft 249*c* and the driving motor support member 133, 134, so that the inner tub connecting shaft 249*c* can relatively rotate with respect to the driving motor support member 133, 134. A third bearing 247*c* is provided between the washing shaft 132*a* and the dewatering shaft 132*b* so that the washing shaft 132*a* can relatively rotate with respect to the dewatering shaft 132*b*. A fourth bearing 247*d* is provided between the pulsator connecting shaft 249*a* and the blade connecting shaft 249*b*, so that the blade connecting shaft 249*b* can relatively rotate with respect to the pulsator connecting shaft 249*a*. A plurality of fourth bearings 247*d* may be disposed to be vertically spaced apart. A fifth bearing 247*e* is provided between the pulsator connecting shaft 249*a* and the inner tub connecting shaft 249*c* so that the pulsator connecting shaft 249*a* can relatively rotate with respect to the inner tub connecting shaft 249*c*. A plurality of fifth bearings 247*e* may be disposed to be vertically spaced apart.

The power transmission portion 240 includes a sealer 241*a*, 241*b* that blocks the inflow of the washing water into a gap between the respective components of the concentric shaft assembly 249.

A first sealer 241*a* is provided between the pulsator connecting shaft 249*a* and the blade connecting shaft 249*b* to block the inflow of the washing water into a gap between the pulsator connecting shaft 249*a* and the blade connecting shaft 249*b*. The first sealer 241*a* is disposed in the upper end of the pulsator connecting shaft 249*a*. The first sealer 241*a* is disposed above the fourth bearing 247*d*. In the lower central portion of the blade 123, a groove that is recessed upward and filled with air is formed, and the upper end of the pulsator connecting shaft 249*a* is disposed in the groove of the blade 123, thereby preventing the washing water from flowing into the gap between the pulsator connecting shaft 249*a* and the blade connecting shaft 249*b*. A first sealer 241*a* may be disposed in a space filled with air by the groove of the blade 123.

A second sealer 241*b* may be provided between the pulsator connecting shaft 249*a* and the inner tub connecting shaft 249*c*, thereby preventing the washing water from flowing into a gap between the pulsator connecting shaft 249*a* and the inner tub connecting shaft 249*c*. The second sealer 241*b* is disposed in the upper end of the inner tub connecting shaft 249*c*. The second sealer 241*b* is disposed above the fifth bearing 247*e*. The lower central portion of the pulsator connection frame 248 may form a space that is recessed upward and filled with air, and the upper end of the inner tub connecting shaft 249*c* may be disposed in the space of the lower central portion of the pulsator connection frame 248, thereby preventing the washing water from flowing into a gap between the blade connecting shaft 249*b* and the inner tub connecting shaft 249*c*. The second sealer 241*b* may be disposed in the air-filled space of the lower central portion of the pulsator connection frame 248.

The gear module 242, 243, 244, 245 is disposed below the outer tub 110. No other gear is disposed in the concentric shaft assembly 249 inside the inner tub 120. Specifically, the lower end portion of the pulsator connecting shaft 249*a* is connected to the gear module 242, 243, 244, 245 and the upper end portion thereof is connected to the pulsator connection frame 248, so that the rotational force of the gear module 242, 243, 244, 245 is directly transmitted to the pulsator connection frame 248. The blade connecting shaft 249*b* has a lower end portion connected to the gear module 242, 243, 244, 245 and an upper end connected to the blade 123, so that the rotational force of the gear module 242, 243, 244, 245 is directly transmitted to the blade 123. The inner tub connecting shaft 249*c* has a lower end portion connected to the gear module 242, 243, 244, 245 and an upper end portion connected to the inner tub 120, so that the rotational force of the gear module 242, 243, 244, 245 is directly transmitted to the inner tub 120.

The gear module 242, 243, 244, 245 transmits the rotational force of the washing shaft 132*a* to the pulsator connecting shaft 249*a* and the blade connecting shaft 249*b*, respectively. The gear module 242, 243, 244, 245 transmits the rotational force of the dewatering shaft 132*b* to the inner tub connecting shaft 249*c*.

When the washing shaft 132*a* relatively rotates with respect to the dewatering shaft 132*b* by the clutch 137, the gear module 242, 243, 244, 245 decelerates the rotation speed of the washing shaft 132*a* and transmits the rotational force of the washing shaft 132*a* to the pulsator 122. The gear module 242, 243, 244, 245 decelerates the rotational speed by a gear ratio of the sun gear 242 and the ring gear 245, and transmits the rotational force of the washing shaft 132*a* to the pulsator connecting shaft 249*a*. The gear module 242, 243, 244, 245 is provided in such a manner that the pulsator connecting shaft 249*a* rotates at a rotational speed lower than the rotational speed of the washing shaft 132*a*. The torque of the pulsator 122 is increased as the rotation speed of the washing shaft 132*a* is reduced to be transmitted to the pulsator 122.

When the washing shaft 132*a* relatively rotates with respect to the dewatering shaft 132*b* by the clutch 137, the gear module 242, 243, 244, 245 maintains the rotational speed of the washing shaft 132*a* and transmits the rotational force of the washing shaft 132*a* to the blade 123. The gear module 242, 243, 244, 245 is provided in such a manner that the blade connecting shaft 249*b* rotates in the same rotation direction and at the same rotation speed as the washing shaft 132*a*.

Figure 19A:
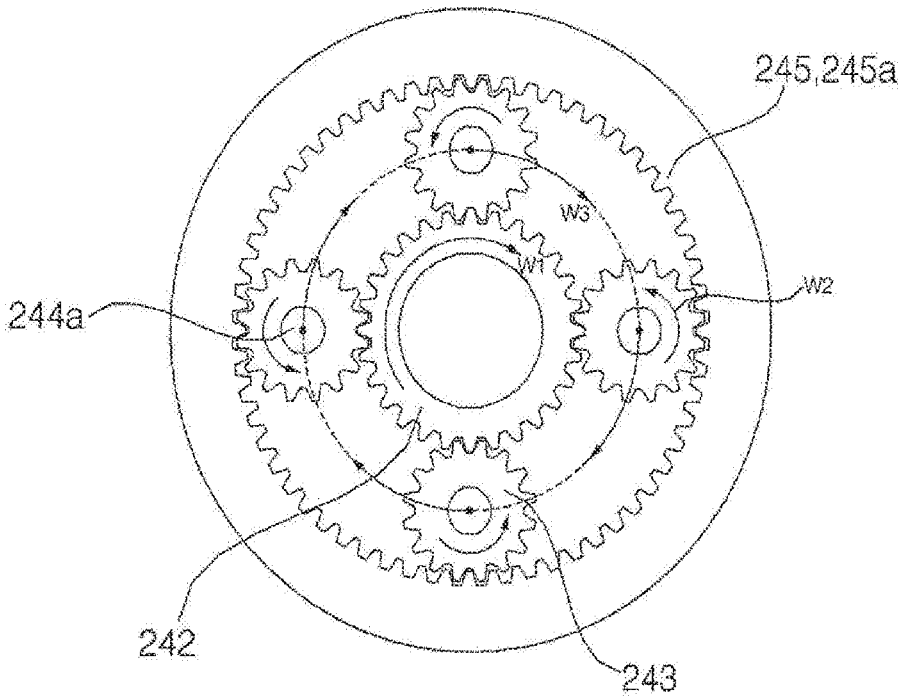
FIG. 19A is a conceptual sectional view of a gear module 242, 243, 244 and 245 according to a 2-A embodiment of FIG. 16A cut horizontally, and is view a showing a state where a sun gear 242, a planetary gear 243, and a ring gear 245 are engaged with each other and rotated when a washing shaft 132*a* relatively rotates with respect to a dewatering shaft 132*b*.

In the 2-A embodiment of FIGS. 16A and 19A, when the washing shaft 132*a* relatively rotates with respect to the dewatering shaft 132*b* by the clutch 137, the gear module 242, 243, 244, 245 transmits the rotational force of the washing shaft 132*a* to the pulsator 122 and the blade 123 such that the pulsator 122 and the blade 123 rotate in the same direction.

Figure 19B:
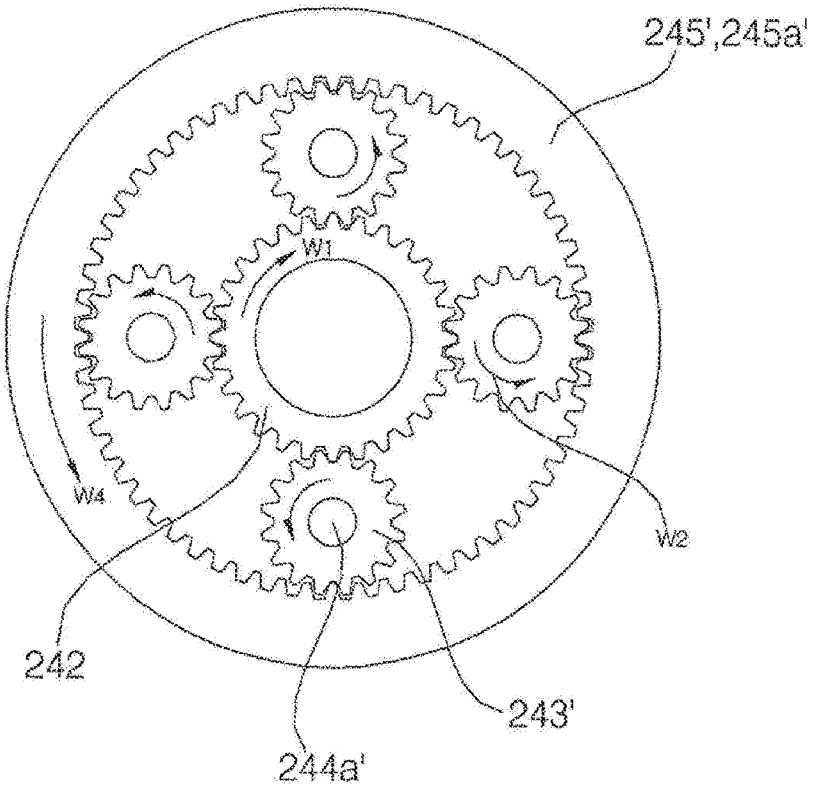
FIG. 19B is a conceptual sectional view of a gear module 242, 243', 244' and 245' according to a 2-B embodiment of FIG. 16B cut horizontally, and is view a showing a state where a sun gear 242, a planetary gear 243', and a ring gear 245' are engaged with each other and rotated when a washing shaft 132*a* relatively rotates with respect to a dewatering shaft 132*b*.

In the 2-B embodiment of FIGS. 16B and 19B, when the washing shaft 132*a* relatively rotates with respect to the dewatering shaft 132*b* by the clutch 137, the gear module 242, 243, 244, 245 transmits the rotational force of the washing shaft 132*a* to the pulsator 122 and the blade 123 such that the pulsator 122 and the blade 123 rotate in opposite directions. In this case, the relative rotational speed of the pulsator 122 and the blade 123 is increased, and a more complex water flow can be formed.

The gear module 242, 243, 244, 245 according to the 2-A embodiment of FIG. 16A will be described in more detail as follows. According to the 2-A embodiment of the present invention, the blade connecting shaft 249*c* rotates integrally with the sun gear 242. Further, the lower portion of the pulsator connecting shaft 249*b* is fixed to the carrier 244, and the pulsator connecting shaft 249*b* rotates integrally with the carrier 244. Further, the lower portion of the inner tub connecting shaft 249*c* is fixed to the ring gear housing 245*a*, and the inner tub connecting shaft 249*c* is integrally and rotatably connected to the ring gear 245 and the ring gear housing 245*a*. Further, the upper portion of the dewatering shaft 132*b* is fixed to the ring gear housing 245*a* and the dewatering shaft 132*b* is integrally and rotatably connected to the ring gear 245 and the ring gear housing 245*a*.

The gear module 242, 243, 244, 245 includes the sun gear 242 that rotates integrally with the washing shaft 132*a*. The sun gear 242 rotates integrally with the blade connecting shaft 249*c*. The gear module 242, 243, 244, 245 includes a plurality of planetary gears 243 which are engaged and rotated with the outer circumferential surface of the sun gear 242. The gear module 242, 243, 244, 245 includes the carrier 244 having a plurality of planetary gear rotation shafts 244*a*, which are connected to each other, that penetrate the central portion of the plurality of planetary gears 243 respectively. The gear module 242, 243, 244, 245 includes the ring gear 245 which is internally in contact with and engaged with a plurality of planetary gears 243. The gear module 242, 243, 244, 245 include the ring gear housing 245*a* to which the ring gear 245 is fixed to the inner side surface.

Although not shown in the drawing, a lower groove (not shown) recessed upward may be formed in the lower central portion of the sun gear 242. An upper groove recessed downward may be formed in the upper central portion of the sun gear 242.

The upper portion of the washing shaft 132*a* is fixed to the sun gear 242. For the power transmission of the washing shaft 132*a*, a plurality of protrusions such as serration may be formed along the outer circumferential surface of the upper end portion of the washing shaft 132*a*. A plurality of grooves formed to be engaged with the serration protrusion may be formed in the inner circumferential surface of the lower groove of the sun gear 242. The upper end of the washing shaft 132*a* may be inserted into the central portion of the sun gear 242. A plurality of gear teeth are formed along the outer circumferential surface of the sun gear 242. As another example, it is possible that the sun gear 242 and the washing shaft 132*a* are integrally formed.

The lower portion of the blade connecting shaft 249*b* is fixed to the sun gear 242. For the power transmission of the sun gear 242, a plurality of protrusions such as serration may be formed along the outer circumferential surface of the lower end portion of the blade connecting shaft 249*b*. A plurality of grooves formed to be engaged with the serration protrusion may be formed in the inner circumferential surface of the upper groove of the sun gear 242. The lower end of the blade connecting shaft 249*b* may be inserted into the central portion of the sun gear 242.

The sun gear 242 is disposed in the center of the plurality of planetary gears 243. The sun gear 242 is disposed inside the carrier 244. The sun gear 242 is disposed between the connecting shaft upper plate portion 244*b* and the connecting shaft lower plate portion 244*c* of the carrier 244. The sun gear 242 is disposed inside the ring gear housing 245*a*. The sun gear 242 is disposed between the ring gear upper housing 245*a*2 and the ring gear lower housing 245*a*3.

The plurality of planetary gears 243 are engaged and rotated with the outer circumferential surface of the sun gear 242. Each of the planetary gears 243 has a plurality of gear teeth on the outer circumferential surface thereof. The plurality of planetary gears 243 are disposed apart from each other along the circumferential direction. The planetary gear 243 may be connected to the carrier 244 through the planetary gear rotation shaft 244*a*. The planetary gear rotation shaft 244*a* penetrates the center of the planetary gear 243 vertically. The planetary gear 243 are engaged between the sun gear 242 and the ring gear 245 so that the gear teeth are engaged with each other. The planetary gear 243 is provided to be rotatable. The planetary gear 243 is provided to be able to revolve around the sun gear 242. When the carrier 244 rotates, a plurality of planet gears 243 revolve around the sun gear 242 together with the carrier 244.

The planetary gear 243 is disposed inside the carrier 244. The planetary gear 243 is disposed between the connecting shaft upper plate portion 244*b* and the connecting shaft lower plate portion 244*c*. The planetary gear 243 is disposed inside the ring gear housing 245*a*. The planetary gear 243 is disposed between the ring gear upper housing 245*a*2 and the ring gear lower housing 245*a*3.

The carrier 244 includes a plurality of planetary gear rotation shafts 244*a* that vertically penetrate the plurality of planetary gears 243 respectively. The carrier 244 is provided in such a manner that the plurality of planetary gear rotation shafts 244*a*, which penetrate the central portion of the plurality of planetary gears 243, are connected to each other. The carrier 244 supports the upper and lower ends of the planetary gear rotation shaft 244*a*.

The carrier 244 includes a connecting shaft upper plate portion 244*b* fixed to the upper end of the plurality of planetary gear rotation shafts 244*a*. The upper end of the planetary gear rotation shaft 244*a* is fixed to the connecting shaft upper plate portion 244*b*. The sun gear 242 and the plurality of planetary gears 243 are disposed below the connecting shaft upper plate portion 244*b*. The connecting shaft upper plate portion 244*b* may be formed in a plate shape disposed in a horizontal surface as a whole. A hole may formed in the center of the connecting shaft upper plate portion 244*b*. The blade connecting shaft 249*b* may be disposed to penetrate the hole of the connecting shaft upper plate portion 244*b*. The blade connecting shaft 249*c* is disposed to penetrate the upper side surface of the carrier 244. The lower portion of the pulsator connecting shaft 249*b* is fixed to the carrier 244. The lower portion of the pulsator connecting shaft 249*b* is fixed to the connecting shaft upper plate portion 244*b*. The pulsator connecting shaft 249*b* forms a hole penetrating in the vertical direction, and the hole of the pulsator connecting shaft 249*b* is connected to the hole of the connecting shaft upper plate portion 244*b*.

The carrier 244 includes a connecting shaft lower plate portion 244*c* fixed to the lower end of the plurality of planetary gear rotation shafts 244*a*. The lower end of the planetary gear rotation shaft 244*a* is fixed to the connecting shaft lower plate portion 244*c*. The sun gear 242 and the plurality of planetary gears 243 are disposed above the connecting shaft lower plate portion 244*c*. The connecting shaft lower plate portion 244*c* may be formed in a plate shape disposed in a horizontal surface as a whole. A hole may be formed in the center of the connecting shaft lower plate portion 244*c*. The washing shaft 132*a* may be disposed to penetrate the hole of the connecting shaft lower plate portion 244*c*.

The carrier 244 includes a reinforcing portion 244*f* disposed in a gap in which the plurality of planetary gears 243 are spaced from each other. The reinforcing portion 244*f* connects and fixes the connecting shaft upper plate portion 244*b* and the connecting shaft lower plate portion 244*c*.

The ring gear 245 is internally in contact with and engaged with the plurality of planetary gears 243. The ring gear 245 has a plurality of gear teeth formed along the inner circumferential surface so as to be engaged with the gear teeth of the outer circumferential surface of the plurality of planetary gears 243. The ring gear 245 has a plurality of gear teeth formed along the inner circumferential surface so as to be simultaneously engaged with the gear teeth of the outer circumferential surface of the plurality of planetary gears 243.

The ring gear 245 is fixed to the ring gear housing 245*a*. The ring gear 245 is fixed to the inner surface of the ring gear housing 245*a*. The upper portion of the dewatering shaft 132*b* is fixed to the ring gear housing 245*a*. The lower portion of the inner tub connecting shaft 249*c* is fixed to the ring gear housing 245*a*. The carrier 244 is accommodated inside the ring gear housing 245*a*.

The ring gear housing 245*a* includes a ring gear lateral housing 245*a*1 forming an outer circumferential surface. The ring gear 245 is disposed in a lateral surface of the opposite direction to the centrifugal side of the ring gear lateral housing 245*a*1. The ring gear 245 is disposed in the inner surface of the ring gear lateral housing 245*a*1.

The ring gear housing 245*a* includes a ring gear upper housing 245*a*2 that forms an upper side surface. The ring gear lateral housing 345*a*1 is fixed to the ring gear upper housing 345*a*2. The lower portion of the inner tub connecting shaft 249*c* is fixed to the ring gear upper housing 245*a*2. The blade connecting shaft 149*b* is disposed to penetrate the upper side surface of the ring gear housing 245*a*. The blade connecting shaft 249*b* is disposed to penetrate the center of the ring gear upper housing 245*a*2. The pulsator connecting shaft 249*a* is disposed to penetrate the upper side surface of the ring gear housing 245*a*. The pulsator connecting shaft 249*a* is disposed to penetrate the center of the ring gear upper housing 245*a*2.

A protrusion protruding upward from the central portion of the ring gear upper housing 245*a*2 may be formed and a hole penetrating the center of the protrusion of the ring gear upper housing 245*a*2 may be formed. The protrusion of the ring gear upper housing 245*a*2 may be formed in a pipe shape. The inner tub connecting shaft 249*c* may be inserted and fixed in the hole of the ring gear upper housing 245*a*2. The blade connecting shaft 249*b* and the pulsator connecting shaft 249*a* are disposed to penetrate the hole of the ring gear upper housing 245*a*2.

The ring gear housing 145*a* includes a ring gear lower housing 245*a*3 which forms a lower side surface. The upper portion of the dewatering shaft 132*b* is fixed to the ring gear lower housing 245*a*3. The dewatering shaft 132*b* and the ring gear lower housing 245*a*3 may be integrally formed. The washing shaft 132*a* is disposed to penetrate the lower side surface of the ring gear housing.

The ring gear housing 245*a* includes a ring gear upper housing 245*a*2 which forms an upper side. The ring gear lateral housing 345*a*1 is fixed to the ring gear upper housing 345*a*2. The lower portion of the inner tub connecting shaft 249*c* is fixed to the ring gear upper housing 245*a*2. The blade connecting shaft 249*b* is disposed to penetrate the upper side of the ring gear housing 245*a*. The blade connecting shaft 249*b* is disposed to penetrate the center of the ring gear upper housing 245*a*2. The pulsator connecting shaft 249*a* is disposed to penetrate the upper side surface of the ring gear housing 245*a*. The pulsator connecting shaft 249*a* is disposed to penetrate the center of the ring gear upper housing 245*a*2.

The gear module 242, 243, 244', 245 according to the 2-B embodiment of FIG. 16B will be described in more detail as follows. According to the 2-B embodiment of the present invention, the blade connecting shaft 249*c* rotates integrally with the sun gear 242. Further, the lower portion of the pulsator connecting shaft 249*b* is fixed to the ring gear housing 245*a'* and the pulsator connecting shaft 249*b* rotates integrally with the ring gear 245' and the ring gear housing 245*a'*. Further, the lower portion of the inner tub connecting shaft 249*c* is fixed to the carrier 244', and the inner tub connecting shaft 249*c* is integrally and rotatably connected to the carrier 244'. Further, the upper portion of the dewatering shaft 132*b* is fixed to the carrier 244' and the dewatering shaft 132*b* is integrally and rotatably connected to the carrier 244'.

The gear module 242, 243, 244', 245' includes the sun gear 242 that rotates integrally with the washing shaft 132*a*. The sun gear 242 rotates integrally with the blade connecting shaft 249*c*. The gear module 242, 243, 244', 245' includes the plurality of planetary gears 243 that are engaged and rotated with the outer circumferential surface of the sun gear 242. The gear module 242, 243, 244', 245' includes a carrier 244' having a plurality of planetary gear rotation shafts 244*a'*, which are connected to each other, that penetrate the central portion of the plurality of planetary gears 243 respectively. The gear module 242, 243, 244', 245' includes a ring gear 245' which is internally in contact with and engaged with the plurality of planetary gears 243. The gear module 242, 243, 244', 245' includes a ring gear housing 245*a'* to which the ring gear 245 is fixed to the inner side surface. The carrier 244' includes a carrier housing 244*e'* that accommodates the ring gear housing 245*a'* therein.

Hereinafter, the 2-B embodiment of the present invention will be described based on a difference from the 2-A embodiment of the present invention. Among the components of the 2-B embodiment of FIG. 16B, the same reference numerals as the components of the 2-A embodiment of FIG. 16A are used as common components for the 2-A embodiment and the 2-B embodiment of the present invention, and thus, a redundant description will be omitted.

The planetary gear 243 is provided to be rotatable. Based on the inner tub 120, the planetary gear 243 is provided to only rotate while not revolving around the sun gear 242. Based on the inner tub 120, the carrier 244' is stopped and the ring gear 245' is rotated.

The carrier 244' includes a connecting shaft upper plate portion 244*b'* fixed to the upper end of the plurality of planetary gear rotation shafts 244*a'*. The connecting shaft upper plate portion 244*b'* is disposed inside the ring gear housing 245*a'*.

The carrier 244' includes a connecting shaft lower plate portion 244*c'* fixed to the lower end of the plurality of planetary gear rotation shafts 244*a'*. The upper portion of the dewatering shaft 132*b* is fixed to the carrier 244' The upper portion of the dewatering shaft 132*b* is fixed to the connecting shaft lower plate portion 244*c'*.

The carrier 244' includes a carrier housing 244*e'* that accommodates the ring gear housing 245*a'* therein. The carrier housing 244*e'* is fixed to the connecting shaft lower plate portion 244*c'*. The carrier housing 244*e'* includes a carrier lateral housing 244*e*1' extended upward from the lateral end of the centrifugal direction of the connecting shaft lower plate portion 244*c'*. The carrier housing 244*e'* includes a carrier upper housing 244*e*2' extended in the opposite direction to the centrifugal side from the upper end portion of the carrier lateral housing 244*e*1'. The connecting shaft lower plate portion 244*c'* is fixed to the carrier lateral housing 244*e*1'. The carrier lateral housing 244*e*1' is fixed to the carrier upper housing 244*e*2'. The lower portion of the inner tub connecting shaft 249*c* is fixed to the carrier 244'. The lower portion of the inner tub connecting shaft 249*c* is fixed to the carrier housing 244*e'*. The lower portion of the inner tub connecting shaft 249*c* is fixed to the carrier upper housing 244*e*2'.

The ring gear 245' is fixed to the ring gear housing 245*a'*. The ring gear housing 245*a'* includes the ring gear lateral housing 245*a*1' forming an outer circumferential surface. The ring gear 245' is disposed in the lateral surface of the opposite direction to the centrifugal side of the ring gear lateral housing 245*a*1'.

The ring gear housing 245*a'* includes the ring gear upper housing 245*a*2' forming an upper side surface. The lower portion of the pulsator connecting shaft 249*b* is fixed to the ring gear upper housing 245*a*2'. The blade connecting shaft 249*b* is disposed to penetrate the upper side surface of the ring gear housing 245*a'*. The blade connecting shaft 249*b* is disposed to penetrate the center of the ring gear upper housing 245*a*2'.

A protrusion protruding upward from the central portion of the ring gear upper housing 245*a*2' may be formed and a hole vertically penetrating the center of the protrusion of the ring gear upper housing 245*a*2' may be formed. The protrusion of the ring gear upper housing 245*a*2' may be formed in a pipe shape. The pulsator connecting shaft 249*b* may be inserted and fixed in the hole of the ring gear upper housing 245*a*2'. The blade connecting shaft 249*b'* may be disposed to penetrate the hole of the ring gear upper housing 245*a*2'. The pulsator connecting shaft 249*b* forms a hole penetrating in the vertical direction, and the hole of the pulsator connecting shaft 249*b* is connected to the hole of the ring gear upper housing 245*a*2'.

Hereinafter, referring to FIGS. 21 to 30, the laundry processing apparatus according to a third embodiment will be described based on a difference from the first embodiment.

The laundry processing apparatus according to the third embodiment includes a jig 346 disposed between the pulsator 122 and the inner tub 120. The jig 346 is disposed below the pulsator 122 to be spaced apart from the pulsator 122. The jig 346 is disposed between the pulsator 122 and the blade 123. The jig 346 is disposed above the blade 123 to be spaced apart from the blade 123. A central portion of the jig 346 is disposed in a position spaced upward from the bottom surface of the inner tub 120, and the blade 123 is disposed in a space between the central portion of the jig 346 and the bottom surface of the inner tub 120.

The jig 346 is fixed to the inner tub 120. The jig 346 is fixed to the base 121 of the inner tub 120. The jig 346 is fixed to the connecting surface 121*d* of the inner tub 120. The later end portion of the circumferential direction of the jig 346 is fixed to the inner tub 120.

The jig 346 includes a center coupling portion 346*a* to which an upper portion of the jig connecting shaft 349*d* is fixed. The center coupling portion 346*a* is disposed in a central portion of the jig 346. The center coupling portion 346*a* forms a hole penetrating vertically, and the pulsator connecting shaft 349*a* is disposed to penetrate the hole of the center coupling portion 346*a*.

The jig 346 includes an extension portion 346*b* extended in the centrifugal direction from the center coupling portion 346*a*. A plurality of extension portions 346*b* may be provided. The plurality of extension portions 346*b* may be disposed radially. One end portion of the plurality of extension portions 346*b* is connected to the center coupling portion 346*a* and the other end portion of the plurality of extension portions 346*b* is disposed apart from each other along the circumferential direction. The extension portion 346*b* is supported by the inner tub 120, and the extension portion 346*b* supports the center coupling portion 346*a*. The jig connecting shaft 349*d* is supported by the center coupling portion 346*a*.

The lateral end portion of the centrifugal direction of the extension portion 346*b* is fixed to the inner tub 120 by a fastening member 346*b*1 such as a screw. The lower side surface of the lateral end portion of the centrifugal direction of the extension portion 346*b* comes into contact with the connecting surface 121*d*. The extension portion 346*b* may be fastened to the connecting surface 121*d* by the fastening member 346*b*1 in a state where the lateral end portion of the centrifugal direction of the extension portion 346*b* is in contact with the connecting surface 121*d*.

The jig 346 includes a connecting portion 346*c* connecting the plurality of extension portions 346*b* in the circumferential direction. The connecting portion 346*c* is disposed to connect two extension portions 346*b*. The connecting portion 346*c* is disposed in the lateral portion of the centrifugal direction of the jig 346.

Referring to FIGS. 26A to 28, the power transmission portion 340 according to the third embodiment will be described in more detail as follows.

The laundry processing apparatus includes a power transmission portion 340 that transmits the rotational force of the driving motor 130 to the pulsator 122 and the blade 123 respectively. When the washing shaft 132*a* is rotated without rotating the dewatering shaft 132*b* by the clutch 137, the power transmission portion 340 transmits the rotational force of the driving motor 130 to the pulsator 122 and the blade 123. When the dewatering shaft 132*b* is integrally rotated with the washing shaft 132*a* by the clutch 137, the power transmission portion 340 transmits the rotational force of the driving motor 130 to the inner tub 120.

The power transmission portion 340 includes the gear module 342, 343, 344, 345 that transmits the rotational force of the washing shaft 132*a* to the concentric shaft assembly 349. The power transmission portion 340 includes a concentric shaft assembly 349 that transmits the rotational force of the gear module 342, 343, 344, 345 to the pulsator 122 and the blade 123 respectively. The power transmission portion 340 includes a bearing 347*a*, 347*b*, 347*c*, 347*d*, 347*e*, 347*f* disposed between a plurality of components that relatively rotate. The power transmission portion 340 includes a seal 341*a*, 341*b*, 341*c* for preventing penetration of the washing water contained in the inner tub 120 into a gap between the plurality of concentric shafts constituting the concentric shaft assembly 349.

The washing shaft 132*a* may rotate integrally with the rotor of the driving motor 130. As another example, it is possible that the washing shaft 132*a* receives the rotating force of the rotor of the driving motor 130 via a belt or a gear. In the present embodiment, the lower portion of the washing shaft 132*a* is fixed to the rotor.

The washing shaft 132*a* rotates integrally with the sun gear 342. The upper portion of the washing shaft 132*a* is fixed to the sun gear 342. The upper portion of the washing shaft 132*a* is fixed to the central portion of the sun gear 342.

The washing shaft 132*a* is disposed to penetrate the center of the dewatering shaft 132*b* vertically. The washing shaft 132*a* is disposed to penetrate the lower portion of the carrier 344. The washing shaft 132*a* is disposed to penetrate a connecting shaft lower plate portion 344*c* of the carrier 344. The ring gear housing 345*a* is formed in a shape having an opened lower portion, and the washing shaft 132*a* is inserted into the opened lower portion of the ring gear housing 345*a*. The washing shaft 132*a* is disposed to penetrate the lower portion of a gearbox housing 345*b*. The washing shaft 132*a* is disposed to penetrate a gearbox lower housing 345*b*1.

When the dewatering shaft 132*b* is brought into close contact with the washing shaft 132*a* by the clutch 137, the dewatering shaft 132*b* rotates integrally with the washing shaft 132*a*. The dewatering shaft 132*b* rotates integrally with the gearbox housing 345*b*. The upper portion of the dewatering shaft 132*b* is fixed to the gear box housing 345*b*. The dewatering shaft 132*b* is fixed to the lower central portion of the gearbox housing 345*b*. The upper portion of the dewatering shaft 132*b* is fixed to the gearbox lower housing 345*b*1.

Figure 26A:
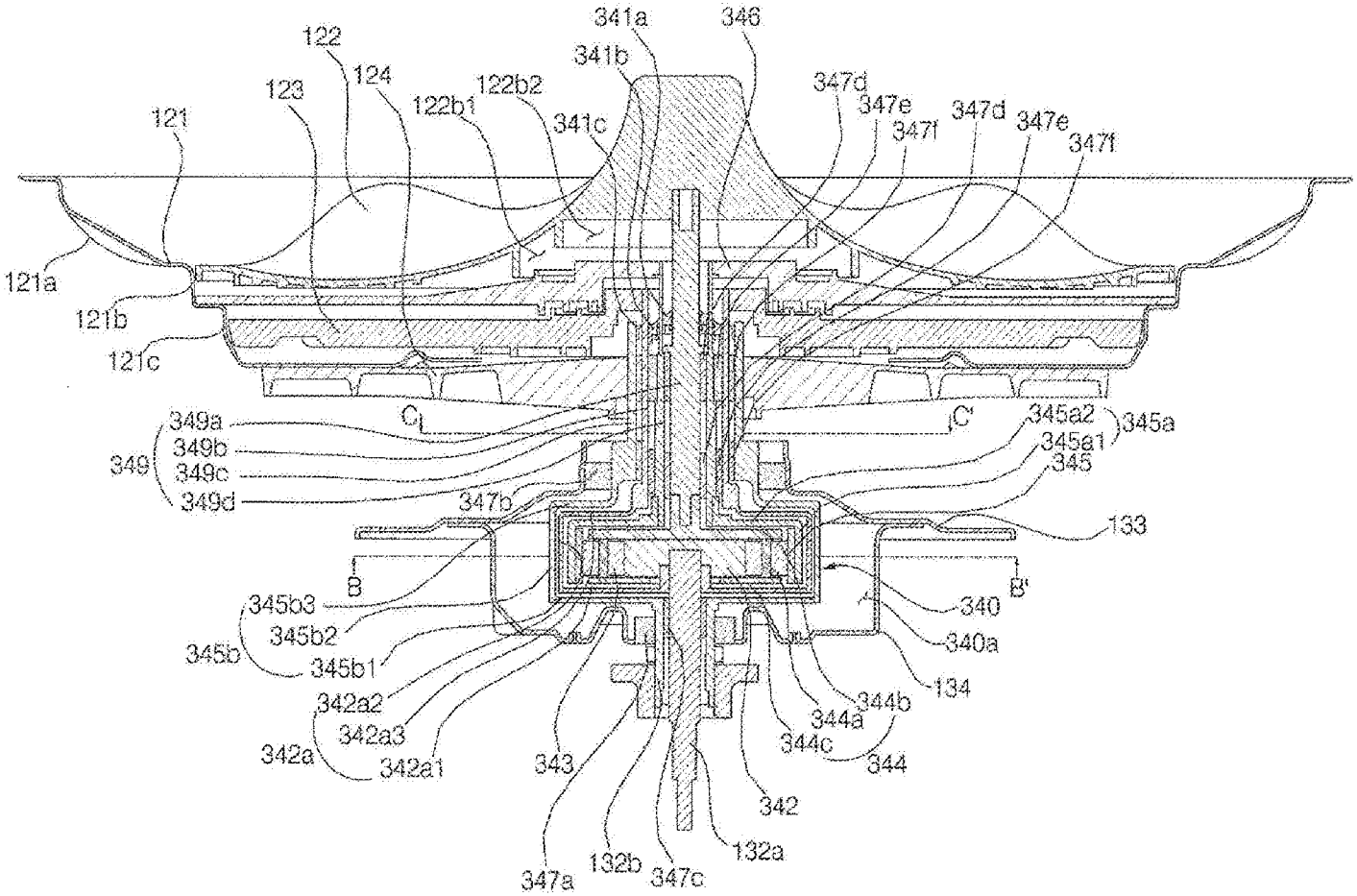
FIG. 26A is an enlarged cross-sectional view of a power transmission portion 340 and the pulsator portion according to a 3-A embodiment of the present invention.

In the 3-A embodiment of FIG. 26A, the dewatering shaft 132*b* rotates integrally with the ring gear 345 and the ring gear housing 345*a*. The upper portion of the dewatering shaft 132*b* is fixed to the gear box housing 345*b*, the gear box housing 345*b* is fixed to the inner tub connecting shaft 349*c*, and the inner tub connecting shaft 349*c* is fixed to the inner tub 120. The jig 346 is fixed to the inner tub 120, the jig connecting shaft 349*d* is fixed to the jig 346, and the ring gear housing 345*a* is fixed to the jig connecting shaft 349*d*. Accordingly, all of the dewatering shaft 132*b*, the gear box housing 345*b*, the inner tub connecting shaft 349*c*, the inner tub 120, the jig 346, the jig connecting shaft 349*d*, the ring gear housing 345*a*, and the ring gear 345 rotate integrally.

Figure 26B:
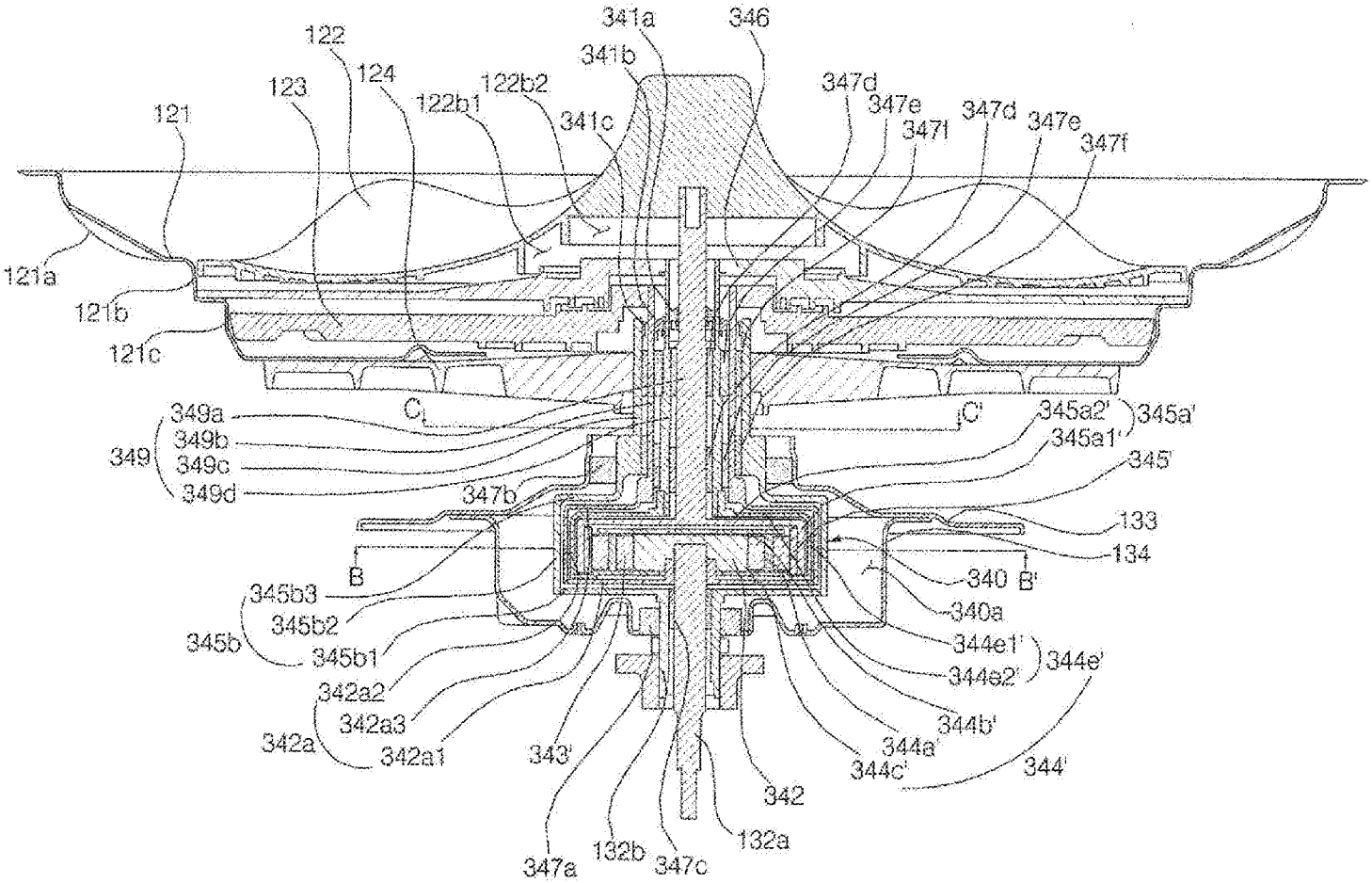
FIG. 26B is an enlarged cross-sectional view of a power transmission portion 340 and the pulsator portion according to a 3-B embodiment of the present invention.
Figure 27:
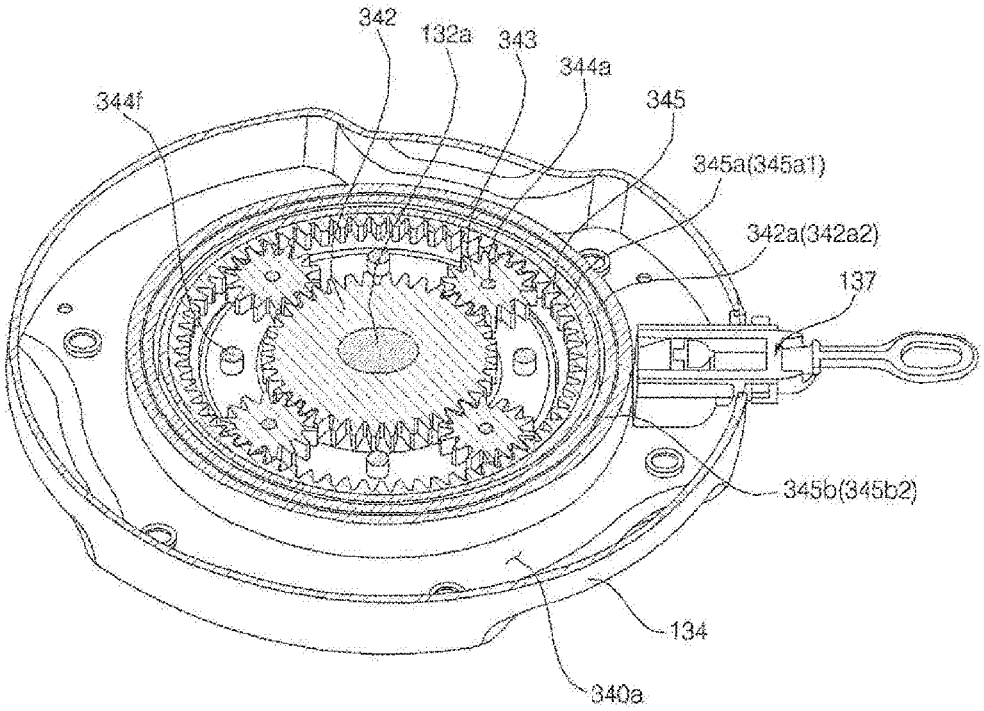
FIG. 27 is a cross-sectional perspective view of the power transmission portion 340 of FIG. 26A cut horizontally along line B-B'.
Figure 28:
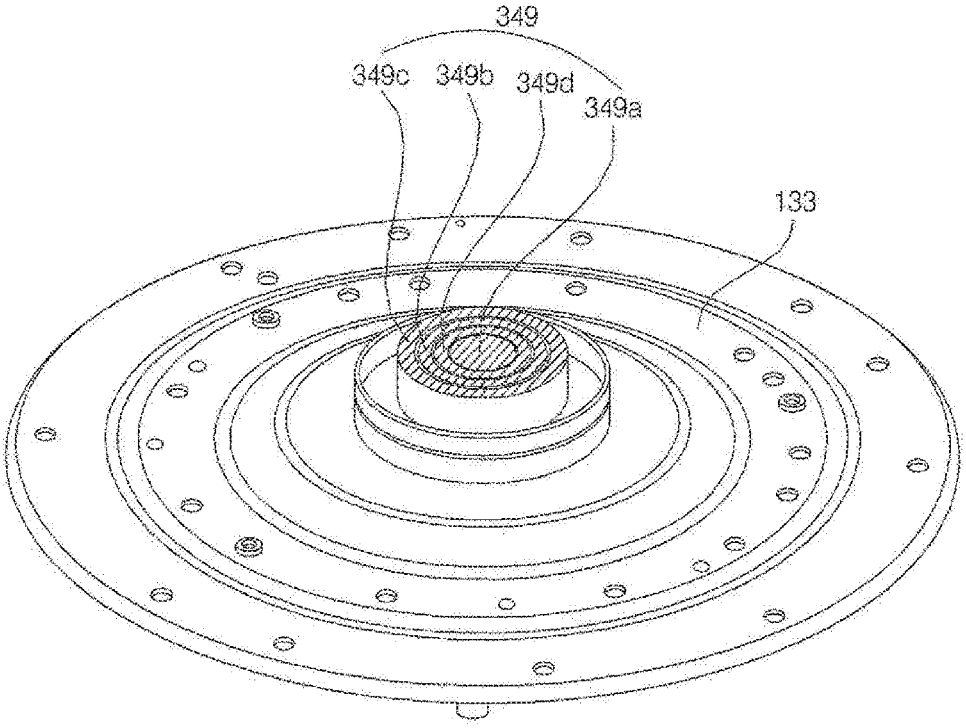
FIG. 28 is a cross-sectional perspective view of the power transmission portion 340 of FIG. 26A cut horizontally along line C-C'.

In the 3-B embodiment of FIG. 26B, the dewatering shaft 132*b* rotates integrally with the carrier 344'. The upper portion of the dewatering shaft 132*b* is fixed to the gear box housing 345*b*, the gear box housing 345*b* is fixed to the inner tub connecting shaft 349*c*, and the inner tub connecting shaft 349*c* is fixed to the inner tub 120. The jig 346 is fixed to the inner tub 120, the jig connecting shaft 349*d* is fixed to the jig 346, and the carrier 344' is fixed to the jig connecting shaft 349*d*. Accordingly, all of the dewatering shaft 132*b*, the gear box housing 345*b*, the inner tub connecting shaft 349*c*, the inner tub 120, the jig 346, the jig connecting shaft 349*d*, and the carrier 344' rotate integrally.

The concentric shaft assembly 349 includes the pulsator connecting shaft 349*a* that rotates the pulsator 122. The concentric shaft assembly 349 includes the blade connecting shaft 349*b* that rotates the blade 123. The concentric shaft assembly 349 includes the inner tub connecting shaft 349*c* that rotates the inner tub 120. The concentric shaft assembly 349 includes the jig connecting shaft 349*d* having an upper portion that is fixed to the jig 346.

The concentric shaft assembly 349 is disposed to penetrate the center of the lower side surface of the outer tub 110. The pulsator connecting shaft 349*a* is disposed to penetrate the lower side surface of the outer tub 110. The blade connecting shaft 349*b* is disposed to penetrate the lower side surface of the outer tub 110. The inner tub connecting shaft 349*c* is disposed to penetrate the lower side surface of the outer tub 110. The jig connecting shaft 349*d* is disposed to penetrate the lower side surface of the outer tub 110.

The pulsator connecting shaft 349*a* and the blade connecting shaft 349*b* are provided to rotate concentrically. The pulsator connecting shaft 349*a* and the inner tub connecting shaft 349*c* are provided to rotate concentrically. The blade connecting shaft 349*b* and the inner tub connecting shaft 349*c* are provided to rotate concentrically. The jig connecting shaft 349*d* and the pulsator connecting shaft 349*a* are provided to rotate concentrically. The jig connecting shaft 349*d* and the blade connecting shaft 349*b* are provided to rotate concentrically.

The pulsator connecting shaft 349*a*, the blade connecting shaft 349*b*, the inner tub connecting shaft 349*c*, the jig connecting shaft 349*d*, the sun gear 342, the carrier 344, and the ring gear 345 are provided to be concentrically rotatable based on a single vertical axis.

The pulsator connecting shaft 349*a* and the blade connecting shaft 349*b* are provided to be rotatable independently of each other. The pulsator connecting shaft 349*a* and the inner tub connecting shaft 349*c* are provided to be rotatable independently of each other. The blade connecting shaft 349*b* and the inner tub connecting shaft 349*c* are provided to be rotatable independently of each other. The pulsator connecting shaft 349*a* and the jig connecting shaft 349*d* are provided to be rotatable independently of each other. The blade connecting shaft 349*b* and the jig connecting shaft 349*d* are provided to be rotatable independently of each other. The pulsator connecting shaft 349*a* rotates the pulsator 122 independently from the blade 123. The blade connecting shaft 349*b* rotates the blade 123 independently from the pulsator 122.

The concentric shaft assembly 349 is extended in the vertical direction. The pulsator connecting shaft 349*a* is extended in the vertical direction. The blade connecting shaft 349*b* is extended in the vertical direction. The inner tub connecting shaft 349*c* is extended in the vertical direction. The jig connecting shaft 349*d* is extended in the vertical direction.

The pulsator connecting shaft 349*a* is disposed to penetrate the center of the inner tub connecting shaft 349*c*. The jig connecting shaft 349*d* is disposed to penetrate the center of the inner tub connecting shaft 349*c*. The blade connecting shaft 349*b* is disposed to penetrate the center of the inner tub connecting shaft 349*c*.

The pulsator connecting shaft 349*a* is disposed to penetrate the center of the blade connecting shaft 349*b*. The jig connecting shaft 349*d* is disposed to penetrate the center of the blade connecting shaft 349*b*.

The pulsator connecting shaft 349*a* is disposed to penetrate the center of the jig connecting shaft 349*d*.

The pulsator connecting shaft 349*a* vertically penetrates the center of the jig connecting shaft 349*d*. The jig connecting shaft 349*d* vertically penetrates the center of the blade connecting shaft 349*b*. The blade connecting shaft 349*b* vertically penetrates the center of the inner tub connecting shaft 349*c*.

The blade connecting shaft 349*b* rotates integrally with the blade 123. The upper portion of the blade connecting shaft 349*b* is fixed to the blade 123. The upper portion of the blade connecting shaft 349*b* is fixed to the central portion of the blade 123.

The blade connecting shaft 349*b* rotates integrally with the sun gear 342. The blade connecting shaft 349*b* rotates integrally with the sun gear housing 342*a*. The lower portion of the blade connecting shaft 349*b* is fixed to the sun gear housing 342*a*. The lower portion of the blade connecting shaft 349*b* is fixed to the central portion of the sun gear housing 342*a*. The sun gear housing 342*a* is fixed to the sun gear 342 so as to rotate integrally with the sun gear 342.

The blade connecting shaft 349*b* is disposed to penetrate the upper portion of the gear box housing 345*b*. The blade connecting shaft 349*b* is disposed to penetrate the gearbox upper housing 345*b*3.

The pulsator connecting shaft 349*a* rotates integrally with the pulsator 122. The upper portion of the pulsator connecting shaft 349*a* is fixed to the pulsator 122. The upper portion of the pulsator connecting shaft 349*a* is fixed to the lower central portion of the pulsator 122.

The pulsator connecting shaft 349*a* rotates integrally with any one of the carrier 344 and the ring gear 345'. In this case, the other one of the carrier 344' and the ring gear 345 is integrally and rotatably connected to the jig connecting shaft 349*d*.

In the 3-A embodiment of FIG. 26A, the pulsator connecting shaft 349*a* is provided to rotate integrally with the carrier 344. The lower portion of the pulsator connecting shaft 349*a* is fixed to the carrier 344. The pulsator connecting shaft 349*a* is disposed to penetrate the upper portion of the ring gear housing 345*a*. The pulsator connecting shaft 349*a* is disposed to penetrate the ring gear upper housing 345*a*2. When the washing shaft 132*a* relatively rotates with respect to the dewatering shaft 132*b* by the clutch 137, the pulsator connecting shaft 349*a* is rotated at a rotational speed lower than the rotational speed of the washing shaft 132*a* and is rotated in the same rotating direction as the rotating direction of the washing shaft 132*a*. In this case, the lower portion of the jig connecting shaft 349*d* is fixed to the ring gear housing 345*a*, and maintains a stop state together with the ring gear 345, the jig 346, the inner tub 120, the inner tub connecting shaft 349*c*, the gear box housing 345*b*, and the dewatering shaft 132*b*. The "rotation" and "stop" mentioned above are relative movements with respect to the inner tub 120.

In the 3-B embodiment of FIG. 26B, the pulsator connecting shaft 349*a* is provided to rotate integrally with the ring gear 345'. The lower portion of the pulsator connecting shaft 349*a* is fixed to the ring gear housing 345*a*'. The pulsator connecting shaft 349*a* is disposed to penetrate the upper portion of the carrier housing 344*e*' The pulsator connecting shaft 349*a* is disposed to penetrate the carrier upper housing 344*e*2'. When the washing shaft 132*a* relatively rotates with respect to the dewatering shaft 132*b* by the clutch 137, the pulsator connecting shaft 349*a* is rotated at a rotational speed lower than the rotational speed of the washing shaft 132*a* and is rotated in the direction opposite to the rotating direction of the washing shaft 132*a*. In this case, the lower portion of the jig connecting shaft 349*d* is fixed to the carrier housing 344*e*' and maintains the stop state together with the carrier 344', the jig 346, the inner tub 120, the inner tub connecting shaft 349*c*, the gearbox housing 345*b*, and the dewatering shaft 132*b*. The "rotation" and "stop" mentioned above are relative movements with respect to the inner tub 120.

The inner tub connecting shaft 349*c* rotates integrally with the inner tub 120. The upper portion of the inner tub connecting shaft 349*c* is fixed to the inner tub 120. The upper portion of the inner tub connecting shaft 349*c* is fixed to the lower central portion of the inner tub 120. The upper portion of the inner tub connecting shaft 349*c* is fixed to the hub 134. The upper portion of the inner tub connecting shaft 349*c* is fixed to the center coupling portion 124*b* of the hub 124.

The inner tub connecting shaft 349*c* rotates integrally with the dewatering shaft 132*b*. The lower portion of the inner tub connecting shaft 349*c* is fixed to the gear box housing 345*b*. The lower portion of the inner tub connecting shaft 349*c* is fixed to the gearbox upper housing 345*b*3. The upper portion of the dewatering shaft 132*b* is fixed to the gear box housing 345*b*. The upper portion of the dewatering shaft 132*b* is fixed to the gearbox lower housing 345*b*1.

The jig connecting shaft 349*d* rotates integrally with the inner tub 120. The upper portion of the jig connecting shaft 349*d* is fixed to the jig 346. The upper portion of the jig connecting shaft 349*d* is fixed to the center coupling portion 346*a* of the jig 346. The jig 346 is fixed to the inner tub 120. Thus, the jig connecting shaft 349*d* rotates integrally with the inner tub connecting shaft 349*c*. The jig connecting shaft 349*d* rotates integrally with the gear box housing 345*b*. The jig connecting shaft 349*d* rotates integrally with the dewatering shaft 132*b*.

In the 3-A embodiment of FIG. 26A, the jig connecting shaft 349*d* rotates integrally with the ring gear 345. The jig connecting shaft 349*d* rotates integrally with the ring gear housing 345*a*. The lower portion of the jig connecting shaft 349*d* is fixed to the ring gear housing 345*a*. The lower portion of the jig connecting shaft 349*d* is fixed to the upper central portion of the ring gear housing 345*a*. The lower portion of the jig connecting shaft 349*d* is fixed to the ring gear upper housing 345*a*2.

In the 3-B embodiment of FIG. 26B, the jig connecting shaft 349*d* rotates integrally with the carrier 344'. The jig connecting shaft 349*d* rotates integrally with the carrier housing 344*e*'. The lower portion of the jig connecting shaft 349*d* is fixed to the carrier housing 344*e*'. The lower portion of the jig connecting shaft 349*d* is fixed to the upper central portion of the carrier housing 344*e*' The lower portion of the jig connecting shaft 349*d* is fixed to the carrier upper housing 344*a*2'.

The pulsator connecting shaft 349*a* and the jig connecting shaft 349*d* are disposed apart from each other by a bearing. The jig connecting shaft 349*d* and the blade connecting shaft 349*b* are disposed apart from each other by a bearing. The blade connecting shaft 349*b* and the inner tub connecting shaft 349*c* are disposed apart from each other by a bearing.

The power transmission portion 340 includes a bearing that supports the washing shaft 132*a*, the dewatering shaft 132*b*, the pulsator connecting shaft 349*a*, the blade connecting shaft 349*b*, the inner tub connecting shaft 349*c*, and the jig connecting shaft 349*d* to be relatively rotatable.

A first bearing 347*a* is provided between the dewatering shaft 132*b* and the driving motor support member 133, 134 so that the dewatering shaft 132*b* can relatively rotate with respect to the driving motor support member 133, 134. A second bearing 347*b* is provided between the inner tub connecting shaft 349*c* and the driving motor support member 133, 134 so that the inner tub connecting shaft 349*c* can relatively rotate with respect to the driving motor support member 133, 134. A third bearing 347*c* is provided between the washing shaft 132*a* and the dewatering shaft 132*b* so that the washing shaft 132*a* can relatively rotate with respect to the dewatering shaft 132*b*. A fourth bearing 347*d* is provided between the pulsator connecting shaft 349*a* and the jig connecting shaft 349*d* so that the pulsator connecting shaft 349*a* can relatively rotate with respect to the jig connecting shaft 349*d*. A plurality of fourth bearings 347*d* may be disposed to be vertically spaced apart. A fifth bearing 347*e* is provided between the jig connecting shaft 349*d* and the blade connecting shaft 349*b* so that the blade connecting shaft 349*b* can relatively rotate with respect to the jig connecting shaft 349*d*. A plurality of fifth bearings 347*e* may be disposed to be vertically spaced apart. A sixth bearing 347*f* is provided between the blade connecting shaft 349*b* and the inner tub connecting shaft 349*c* so that the blade connecting shaft 349*b* can relatively rotate with respect to the inner tub connecting shaft 349*c*. A plurality of sixth bearings 347*f* may be disposed to be vertically spaced apart.

The power transmission portion 340 includes a sealer 341*a*, 341*b*, 341*c* that blocks the inflow of the washing water into a gap between the respective components of the concentric shaft assembly 349.

A first sealer 341*a* is provided between the pulsator connecting shaft 349*a* and the blade connecting shaft 349*b* to block the inflow of the washing water into the gap between the pulsator connecting shaft 349*a* and the jig connecting shaft 349*d*. The first sealer 341*a* is disposed in the upper end portion of the jig connecting shaft 349*d*. The first sealer 341*a* is disposed above the fourth bearing 347*d*. A groove 122*b*2, which is recessed upward and filled with air, is formed in the lower central portion of the pulsator 122, and the upper end of the jig connecting shaft 349*d* is disposed in the groove 122*b*2 of the pulsator 122, so that the washing water can be prevented from being introduced into a gap between the pulsator connecting shaft 349*a* and the jig connecting shaft 349*d*. The first sealer 341*a* may be disposed in the space filled with air by the groove 122*b*2 of the pulsator 122.

A second sealer 341*b* is provided between the jig connecting shaft 349*d* and the blade connecting shaft 349*b* to block the inflow of the washing water into the gap between the jig connecting shaft 349*d* and the blade connecting shaft 349*b*. The second sealer 341*b* is disposed in the upper end portion of the blade connecting shaft 349*b*. The second sealer 341*b* is disposed above the fifth bearing 347*e*. The lower central portion of the jig 346 is recessed upward to form an air-filled groove, and the upper end of the blade connecting shaft 349*b* is disposed in the groove of the jig 346, so that the washing water can be prevented from being introduced into a gap between the jig connecting shaft 349*d* and the blade connecting shaft 349*b*. The second sealer 341*b* may be disposed in a space filled with air by the groove.

A third sealer 341*c* is provided between the blade connecting shaft 349*b* and the inner tub connecting shaft 349*c* to block the inflow of the washing water into a gap between and the blade connecting shaft 349*b* and the inner tub connecting shaft 349*c*. The third sealer 341*c* is disposed in the upper end portion of the inner tub connecting shaft 349*c*. The third sealer 341*c* is disposed above the sixth bearing 347*f*. The lower central portion of the blade 123 is recessed upward to form an air-filled space, and the upper end of the inner tub connecting shaft 349*c* is disposed in the space of the lower central portion of the blade 123, so that the washing water can be prevented from being introduced into a gap between the blade connecting shaft 349*b* and the inner tub connecting shaft 349*c*. The third sealer 341*c* may be disposed in the air-filled space of the lower central portion of the blade 123.

The gear module 342, 343, 344, 345 is disposed in the lower outer side of the outer tub 110. No other gear is disposed in the concentric shaft assembly 349 inside the inner tub 120. Specifically, the lower end portion of the pulsator connecting shaft 349*a* is connected to the gear module 342, 343, 344, 345, and the upper end portion is connected to the pulsator 122, so that the rotational force of the gear module 342, 343, 344, 345 is directly transmitted to the pulsator 122. The lower end portion of the blade connecting shaft 349*b* is connected to the gear module 342, 343, 344, 345, and the upper end portion is connected to the blade 123, so that the rotational force of the gear module 342, 343, 344, 345 is directly transmitted to the blade 123. The lower end portion of the inner tub connecting shaft 349*c* is connected to the gear module 342, 343, 344, 345, and the upper end portion thereof is connected to the inner tub 120, so that the rotational force of the gear module 342, 343, 344, 345 is directly transmitted to the inner tub 120.

The gear module 342, 343, 344, 345 relatively rotates the blade connecting shaft 349*b* and the pulsator connecting shaft 349*a* with respect to the jig connecting shaft 349*d*. One of the ring gear 345 and the carrier 244' of the gear modules 342, 343, 344, 345 is fixed to the jig connecting shaft 349*d*, and the other relatively rotates with respect to the jig connecting shaft 349*d*.

The gear module 342, 343, 344, 345 transmits the rotational force of the washing shaft 132*a* to the pulsator connecting shaft 349*a* and the blade connecting shaft 349*b* respectively. The gear module 342, 343, 344, 345 transmits the rotational force of the dewatering shaft 132*b* to the inner tub connecting shaft 349*c*.

When the washing shaft 132*a* relatively rotates with respect to the dewatering shaft 132*b* by the clutch 137, the gear module 342, 343, 344, 345 decelerates the rotation speed of the washing shaft 132*a* and transmits the rotational force of the washing shaft 132*a* to the pulsator 122. The gear module 342, 343, 344, 345 decelerates the rotational speed by the gear ratio of the sun gear 342 and the ring gear 345, and transmits the rotational force of the washing shaft 132*a* to the pulsator connecting shaft 349*a*. The gear module 342, 343, 344, 345 is provided in such a manner that the pulsator connecting shaft 349*a* rotates at a rotational speed lower than the rotational speed of the washing shaft 132*a*. The torque of the pulsator 122 is increased as the rotation speed of the washing shaft 132*a* is reduced to be transmitted to the pulsator 122.

When the washing shaft 132*a* relatively rotates with respect to the dewatering shaft 132*b* by the clutch 137, the gear module 342, 343, 344, 345 maintains the rotational speed of the washing shaft 132*a* and transmits the rotational force of the washing shaft 132*a* to the blade 123. The gear module 342, 343, 344, 345 is provided in such a manner that the blade connecting shaft 349*b* rotates at the same rotational direction and at the same rotational speed as the washing shaft 132*a*.

Figure 29A:
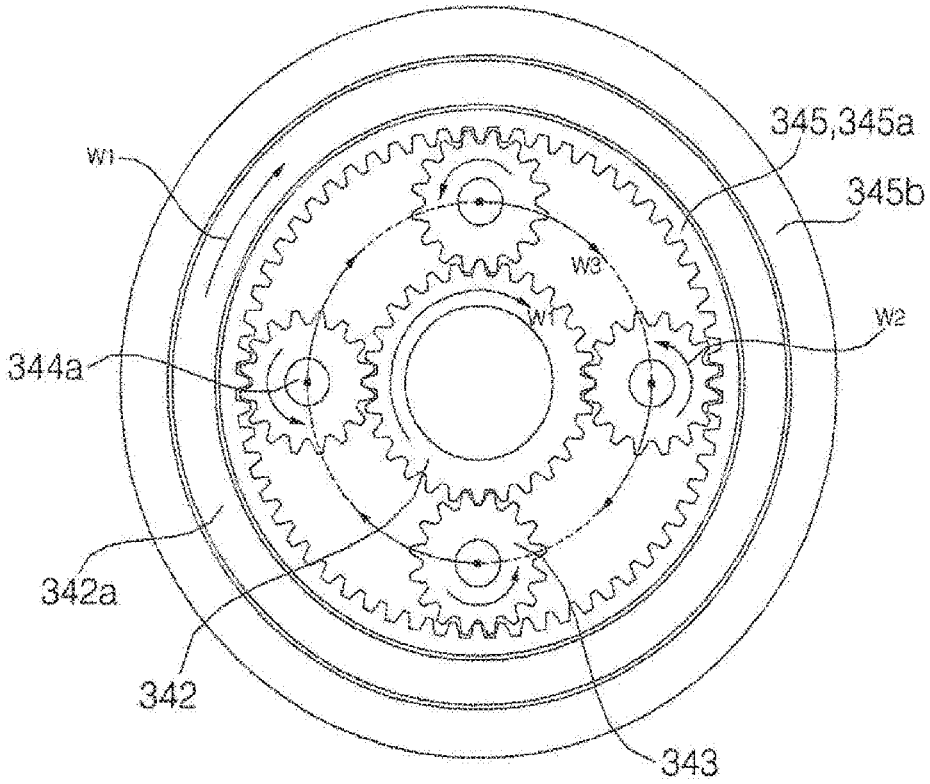
FIG. 29A is a conceptual sectional view of a gear module 342, 343, 344 and 345 according to a 3-A embodiment of FIG. 26A cut horizontally, and is view a showing a state where a sun gear 342, a planetary gear 343, and a ring gear 345 are engaged with each other and rotated when a washing shaft 132*a* relatively rotates with respect to a dewatering shaft 132*b*.

In the 3-A embodiment of FIGS. 26A and 29A, when the washing shaft 132*a* relatively rotates with respect to the dewatering shaft 132*b* by the clutch 137, the gear module 342, 343, 344, 345 transmits the rotational force of the washing shaft 132*a* to the pulsator 122 and the blade 123 so that the pulsator 122 and the blade 123 rotate in the same direction.

Figure 29B:
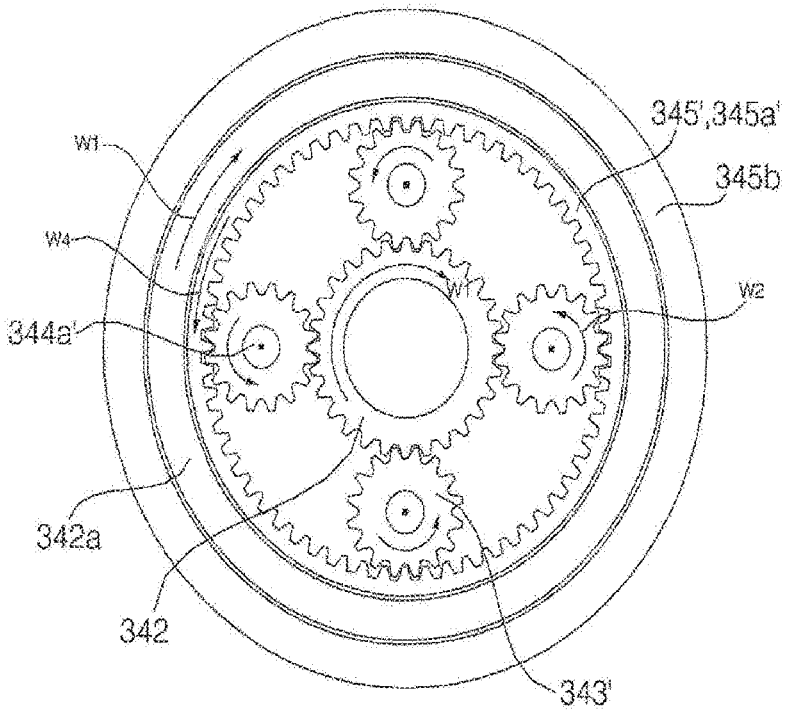
FIG. 29B is a conceptual sectional view of a gear module 342, 343', 244' and 345' according to a 3-B embodiment of FIG. 26B cut horizontally, and is view a showing a state where a sun gear 342, a planetary gear 343', and a ring gear 345' are engaged with each other and rotated when a washing shaft 132*a* relatively rotates with respect to a dewatering shaft 132*b*.

In the 3-B embodiment of FIGS. 26B and 29B, when the washing shaft 132*a* relatively rotates with respect to the dewatering shaft 132*b* by the clutch 137, the gear module 342, 343, 344, 345 transmits the rotational force of the washing shaft 132*a* to the pulsator 122 and the blade 123 so that the pulsator 122 and the blade 123 rotate in opposite directions. In this case, the relative rotational speed of the pulsator 122 and the blade 123 is increased, and a more complex water flow can be formed.

The gear module 342, 343, 344, 345 according to the 3-A embodiment of FIG. 26A will be described in more detail as follows. According to the 3-A embodiment of the present invention, the blade connecting shaft 349*c* rotates integrally with the sun gear 342. Further, the lower portion of the pulsator connecting shaft 349*b* is fixed to the carrier 344, and the pulsator connecting shaft 349*b* rotates integrally with the carrier 344. Further, the lower portion of the jig connecting shaft 349*d* is fixed to the ring gear housing 345*a*, and the jig connecting shaft 349*d* is integrally and rotatably connected to the ring gear 345 and the ring gear housing 345*a*. Further, the lower portion of the inner tub connecting shaft 349*c* and the upper portion of the dewatering shaft 132*b* are fixed to the gear box housing 345*b*, and the dewatering shaft 132*b* is integrally and rotatably connected to the gear box housing 345*b*, the inner tub connecting shaft 349*c*, the inner tub 120, the jig 346, the jig connecting shaft 349*d*, the ring gear housing 345*a*, and the ring gear 345.

The gear module 342, 343, 344, 345 includes the sun gear 342 which rotates integrally with the washing shaft 132*a*. The gear module 342, 343, 344, 345 includes the sun gear housing 342*a* which rotates integrally with the sun gear. The sun gear 342 and the sun gear housing 342*a* rotate integrally with the blade connecting shaft 349*c*. The gear module 342, 343, 344, 345 includes a plurality of planetary gears 343 which are engaged and rotated with the outer circumferential surface of the sun gear 342. The gear module 342, 343, 344, 345 includes the carrier 344 having a plurality of planetary gear rotation shafts 344*a*, which are connected to each other, that penetrate the central portion of the plurality of planetary gears 343 respectively. The gear module 342, 343, 344, 345 includes a ring gear 345 which is internally in contact with and engaged with a plurality of planetary gears 343. The gear module 342, 343, 344, 345 include a ring gear housing 345*a* to which the ring gear 345 is fixed to the inner side surface. The gear module 342, 343, 344, 345 includes a gear box housing 345*b* to which the upper portion of the dewatering shaft 132*b* is fixed and the lower portion of the inner tub connecting shaft 349*c* is fixed.

A lower groove recessed upward may be formed in the lower central portion of the sun gear 342. The sun gear 142 is disposed in the lower side of the connecting shaft upper plate portion 344*b* of the carrier 344. The sun gear 142 may be rotatably coupled to the connecting shaft upper plate portion 344*b*. Although not shown in the drawings, for example, a protrusion for rotation may be protruded from the central portion of one of the sun gear 142-1 and the connecting shaft upper plate portion 344*b* in the direction of a central portion of the other of the sun gear 142-1 and the connecting shaft upper plate portion 344*b*, and a groove into which the protrusion for rotation is inserted may be formed in the central portion of the other.

The upper portion of the washing shaft 132*a* is fixed to the sun gear 342. In order to transmit the power of the washing shaft 132*a*, a plurality of protrusions such as serration may be formed along the outer circumferential surface of the upper end portion of the washing shaft 132*a*. A plurality of grooves formed to be engaged with the serration protrusions may be formed in the inner circumferential surface of the lower groove of the sun gear 342. The upper end of the washing shaft 132*a* may be inserted and coupled to the central portion of the sun gear 342. A plurality of gear teeth are formed along the outer circumferential surface of the sun gear 342. As another example, the sun gear 342 and the washing shaft 132*a* may be integrally formed.

The sun gear 342 is disposed in the center of the plurality of planetary gears 343. The sun gear 342 is disposed inside the carrier 344. The sun gear 342 is disposed between the connecting shaft upper plate portion 344*b* of the carrier 344 and the connecting shaft lower plate portion 344*c*. The sun gear 342 is disposed inside the ring gear housing 345*a*. The sun gear 342 is disposed inside the sun gear housing 342*a*. The sun gear 342 is disposed inside the gearbox housing 345*b*.

The sun gear housing 342*a* accommodates the ring gear housing 345*a* therein. The sun gear housing 342*a* accommodates the carrier 344 therein. The sun gear housing 342*a* accommodates the sun gear 342 and the plurality of planet gears 343 therein. The sun gear housing 342*a* surrounds the outside of the sun gear 342 and forms an internal space between the inner surface of the sun gear housing 342*a* and the sun gear 342. The plurality of planetary gears 343, the carrier 344, the ring gear 345, and the ring gear housing 345*a* are rotatably disposed in the internal space of the sun gear housing 342*a*.

The sun gear housing 342*a* rotates integrally with the sun gear 342. The sun gear housing 342*a* rotates integrally with the washing shaft 132*a*. The sun gear housing 342*a* is fixed to at least one of the sun gear 342 and the washing shaft 132*a*.

The lower portion of the blade connecting shaft 349*b* is fixed to the sun gear housing 342*a*. A protrusion protruding upward from the upper central portion of the sun gear housing 342*a* is formed, and an insertion groove recessed downwardly is formed in the upper side surface of the protrusion of the sun gear housing 342*a*. For the power transmission of the sun gear housing 342*a*, a plurality of protrusions, such as serration, may be formed along the outer circumferential surface of the lower end portion of the blade connecting shaft 349*b*. A plurality of grooves formed to be engaged with the serration protrusions may be formed in the inner circumferential surface of the insertion groove of the sun gear housing 342*a*. The lower end of the blade connecting shaft 349*b* may be inserted into the insertion groove of the sun gear housing 342*a*.

The sun gear housing 342*a* includes a sun gear lower housing 342*a*1 forming a lower side surface. The center portion of the sun gear lower housing 342*a*1 is fixed to at least one of the sun gear 342 and the washing shaft 132*a*. The rotational force of the washing shaft 132*a* is transmitted to the sun gear lower housing 342*a*1.

The sun gear housing 342*a* includes a sun gear lateral housing 342*a*2 forming an outer circumferential surface. The lower portion of the sun gear lateral housing 342*a*2 is fixed to the sun gear lower housing 342*a*1. The sun gear lateral housing 342*a*2 is fixed to the edge of the sun gear lower housing 342*a*1. The rotational force of the sun gear lower housing 342*a*1 is transmitted to the sun gear lateral housing 342*a*2.

The sun gear housing 342*a* includes a sun gear upper housing 342*a*3 forming an upper side surface. The sun gear upper housing 342*a*3 is fixed to the sun gear lateral housing 342*a*2. The edge of the sun gear upper housing 342*a*3 is fixed to the upper portion of the sun gear lateral housing 342*a*2. The rotational force of the sun gear lateral housing 342*a*2 is transmitted to the sun gear upper housing 342*a*3.

The protrusion of the sun gear housing 342*a* is formed in the central portion of the sun gear upper housing 342*a*3. The lower end of the pulsator connecting shaft 349*a* is fixed to the sun gear upper housing 342*a*3. The rotational force of the sun gear upper housing 342*a*3 is transmitted to the pulsator connecting shaft 349*a*.

The plurality of planetary gears 343 engage with the outer circumferential surface of the sun gear 342 and rotate. Each planetary gear 343 has a plurality of teeth gear on the outer circumferential surface. The plurality of planetary gears 343 are disposed apart from each other along the circumferential direction. The planetary gear 343 may be connected to the carrier 344 through the planetary gear rotation shaft 344*a*. The planetary gear rotation shaft 344*a* penetrates the center of the planetary gear 343 vertically. The planetary gear 343 is engaged between the sun gear 342 and the ring gear 345 so that teeth of the gears are engaged with each other. The planetary gear 343 is provided to be rotatable. The planetary gear 343 is provided to be able to revolve around the sun gear 342. When the carrier 344 rotates, the plurality of planetary gears 343 revolve around the sun gear 342 together with the carrier 344.

The planetary gear 343 is disposed inside the carrier 344. The planetary gear 343 is disposed between the connecting shaft upper plate portion 344*b* and the connecting shaft lower plate portion 344*c*. The planetary gear 343 is disposed inside the ring gear housing 345*a*. The planetary gear 343 is disposed inside the sun gear housing 342*a*. The planetary gear 343 is disposed between the sun gear upper housing 342*a*3 and the sun gear lower housing 342*a*1. The planetary gear 343 is disposed inside the gear box housing 345*b*. The planetary gear 343 is disposed between the gearbox upper housing 345*b*3 and the gearbox lower housing 345*b*1.

The carrier 344 includes a plurality of planetary gear rotation shafts 344*a* that vertically penetrate the plurality of planetary gears 343 respectively. The carrier 344 is provided in such a manner that the plurality of planetary gear rotation shafts 344*a*, which penetrates the central portion of the plurality of planetary gears 343, are connected to each other. The carrier 344 supports the upper and lower ends of the planetary gear rotation shaft 344*a*.

The carrier 344 includes the connecting shaft upper plate portion 344*b* fixed to the upper end of the plurality of planetary gear rotation shafts 344*a*. The upper end of the planetary gear rotation shaft 344*a* is fixed to the connecting shaft upper plate portion 344*b*. The sun gear 342 and the plurality of planetary gears 343 are disposed below the connecting shaft upper plate portion 344*b*. The connecting shaft upper plate portion 344*b* may be formed in a plate shape disposed in a horizontal surface as a whole. The lower portion of the pulsator connecting shaft 349*b* is fixed to the carrier 344. The lower portion of the pulsator connecting shaft 349*b* is fixed to the connecting shaft upper plate portion 344*b*.

The carrier 344 includes the connecting shaft lower plate portion 344*c* fixed to the lower ends of the plurality of planetary gear rotation shafts 344*a*. The lower end of the planetary gear rotation shaft 344*a* is fixed to the connecting shaft lower plate portion 344*c*. The sun gear 342 and the plurality of planetary gears 343 are disposed above the connecting shaft lower plate portion 344*c*. The connecting shaft lower plate portion 344*c* may be formed in a plate shape disposed in the horizontal surface as a whole. A hole may be formed in the center of the connecting shaft lower plate portion 344*c*. The hole of the connecting shaft lower plate 344*c* may be disposed to penetrate the washing shaft 132*a*.

The carrier 344 includes a reinforcing portion 344*f* disposed in a gap where the plurality of planetary gears 343 are spaced apart from each other. The reinforcing portion 344*f* connects and fixes the connecting shaft upper plate portion 344*b* and the connecting shaft lower plate portion 344*c*.

The ring gear 345 is internally engaged with the plurality of planetary gears 343 simultaneously. The ring gear 345 has a plurality of gear teeth formed along the inner circumferential surface so as to be engaged with the gear teeth of the outer circumferential surface of the plurality of planetary gears 343. The ring gear 345 has a plurality of gear teeth formed along the inner circumferential surface so as to be engaged with the gear teeth of the outer circumferential surface of the plurality of planetary gears 343 simultaneously.

The ring gear 345 is fixed to the ring gear housing 345*a*. The ring gear 345 is fixed to the inner surface of the ring gear housing 345*a*. The lower portion of the jig connecting shaft 349*d* is fixed to the ring gear housing 345*a*. The carrier 344 is accommodated inside the ring gear housing 345*a*.

The ring gear housing 345*a* includes a ring gear lateral housing 345*a*1 forming an outer circumferential surface. The ring gear 345 is disposed in the lateral surface of the opposite direction to the centrifugal side of the ring gear lateral housing 145*a*1. The ring gear 345 is disposed in the inner surface of the ring gear lateral housing 345*a*1.

The ring gear housing 145*a* includes a ring gear upper housing 145*a*2 that forms an upper side surface. The ring gear lateral housing 345*al* is fixed to the ring gear upper housing 345*a*2. The lower portion of the jig connecting shaft 349*d* is fixed to the ring gear upper housing 345*a*2. The pulsator connecting shaft 349*a* is disposed to penetrate the upper side surface of the ring gear housing 345*a*. The pulsator connecting shaft 349*a* is disposed to penetrate the center of the ring gear upper housing 345*a*2.

A protrusion protruding upward from the central portion of the ring gear upper housing 345*a*2 may be formed, and a hole penetrating the center of the protrusion of the ring gear upper housing 345*a*2 may be formed. The protrusion of the ring gear upper housing 345*a*2 may be formed in a pipe shape. The pulsator connecting shaft 349*a* is disposed to penetrate the hole of the ring gear upper housing 345*a*2.

The gearbox housing 345*b* accommodates the sun gear housing 342*a* therein. The gearbox housing 345*b* accommodates the ring gear housing 345*a* therein. The gearbox housing 345*b* accommodates the carrier 344 therein. The gearbox housing 345*b* accommodates the sun gear 342 and the plurality of planet gears 343 therein. The gear box housing 345*b* surrounds the outside of the sun gear housing 342*a*, and the sun gear housing 342*a* is rotatably disposed inside the gear box housing 345*b*. The gearbox housing 345*b* forms an internal space, and the sun gear housing 342*a*, the plurality of planet gears 343, the carrier 344, and the sun gear 342 are rotatably disposed in the internal space of the gearbox housing 345*b*.

The gear box housing 345*b* rotates integrally with the dewatering shaft 132*b*. The gearbox housing 345*b* is fixed to the upper portion of the dewatering shaft 132*b*.

The inner tub connecting shaft 349*c* rotates integrally with the gear box housing 345*b*. The lower portion of the inner tub connecting shaft 349*c* is fixed to the gear box housing 345*b*. The protrusion protruding upward from an upper central portion of the gear box housing 345*b* may be formed, and an insertion hole penetrating the center of the protrusion of the gearbox housing 345*b* vertically may be formed. For the power transmission of the gear box housing 345*b*, a plurality of protrusions such as serration may be formed along the outer circumferential surface of the lower end portion of the inner tub connecting shaft 349*c*. A plurality of grooves may be formed in the inner circumferential surface of the insertion hole of the gear box housing 345*b* so as to be engaged with the serration protrusion. The lower end of the inner tub connecting shaft 349*c* may be inserted into the insertion hole of the gear box housing 345*b*. The blade connecting shaft 349*b* is disposed to pass through the insertion hole of the gearbox housing 345*b*. The jig connecting shaft 349*d* is disposed to pass through the insertion hole of the gearbox housing 345*b*. The pulsator connecting shaft 349*a* is disposed to pass through the insertion hole of the gearbox housing 345*b*.

The gearbox housing 345*b* includes a gearbox lower housing 345*b*1 that forms a lower side surface. The center portion of the gearbox lower housing 345*b*1 is fixed to the dewatering shaft 132*b*. The rotational force of the dewatering shaft 132*b* is transmitted to the gearbox lower housing 345*b*1.

The gearbox housing 345*b* includes a gearbox lateral housing 345*b*2 that forms an outer circumferential surface. The lower portion of the gearbox lateral housing 345*b*2 is fixed to the gearbox lower housing 342*b*1. The gearbox lateral housing 345*b*2 is fixed to the edge of the gearbox lower housing 342*b*1. The rotational force of the gearbox lower housing 342*b*1 is transmitted to the gearbox lateral housing 345*b*2.

The gearbox housing 345*b* includes a gearbox upper housing 342*b*3 which forms an upper side surface. The gearbox upper housing 342*b*3 is fixed to the gearbox lateral housing 345*b*2. The edge of the gearbox upper housing 342*b*3 is fixed to the upper portion of the gearbox lateral housing 345*b*2. The rotational force of the gearbox lateral housing 345*b*2 is transmitted to the gearbox upper housing 342*b*3.

The protrusion of the gearbox housing 345*b* is formed in the central portion of the gearbox upper housing 342*b*3. The lower end of the inner tub connecting shaft 349*c* is fixed to the gearbox upper housing 342*b*3. The rotational force of the gearbox upper housing 342*b*3 is transmitted to the inner tub connecting shaft 349*c*.

The gear module 342, 343, 344', 345 according to the 3-B embodiment of FIG. 26B will be described in more detail as follows. According to the 3-B embodiment of the present invention, the blade connecting shaft 349*c* rotates integrally with the sun gear 342. Further, the lower portion of the pulsator connecting shaft 349*b* is fixed to the ring gear housing 345*a'*, and the pulsator connecting shaft 349*b* rotates integrally with the ring gear 345' Further, the lower portion of the jig connecting shaft 349*d* is fixed to the carrier housing 344*e'*, and the jig connecting shaft 349*d* is integrally and rotatably connected to the carrier 344'. Further, the lower portion of the inner tub connecting shaft 349*c* and the upper portion of the dewatering shaft 132*b* are fixed to the gear box housing 345*b*, and the dewatering shaft 132*b* is integrally and rotatably connected to the gear box housing 345*b*, the inner tub connecting shaft 349*c*, the inner tub 120, the jig 346, the jig connecting shaft 349*d*, the carrier 344'.

The gear module 342, 343, 344', 345' includes the sun gear 342 which rotates integrally with the washing shaft 132*a*. The gear module 342, 343, 344', 345' includes the sun gear housing 342*a* which rotates integrally with the sun gear. The sun gear 342 and the sun gear housing 342*a* rotate integrally with the blade connecting shaft 349*c*. The gear module 342, 343, 344', 345' includes a plurality of planetary gears 343 which are engaged and rotated with the outer circumferential surface of the sun gear 342. The gear module 342, 343, 344', 345' includes a carrier 344' having a plurality of planetary gear rotation shafts 344*a'*, which are connected to each other, that penetrate the central portion of the plurality of planetary gears 343 respectively. The gear module 342, 343, 344/, 345' includes a ring gear 345' which is internally in contact with and engaged with a plurality of planetary gears 343. The gear module 342, 343, 344', 345' include a ring gear housing 345*a'* to which the ring gear 345' is fixed to the inner side surface. The gear module 342, 343, 344', 345' includes a gear box housing 345*b* to which the upper portion of the dewatering shaft 132*b* is fixed and the lower portion of the inner tub connecting shaft 349*c* is fixed. The carrier 344' includes a carrier housing 344*e'* that accommodates the ring gear housing 345*a'* therein.

Hereinafter, the 3-B embodiment of the present invention will be described based on a difference from the 3-A embodiment of the present invention. Among the components of the 3-B embodiment of FIG. 26B, the same reference numerals as the components of the 3-A embodiment of FIG. 26A are used as common components for the 3-A embodiment and the 3-B embodiment of the present invention, and thus, a redundant description will be omitted.

The planetary gear 343 is provided to be rotatable. Based on the inner tub 120, the planetary gear 343 is provided to only rotate while not revolving around the sun gear 342. Based on the inner tub 120, the carrier 344' is stopped and the ring gear 345' is rotated.

The carrier 344' includes a connecting shaft upper plate portion 344*b*' fixed to the upper end of the plurality of planetary gear rotation shafts 344*a*'. Unlike the 3-A embodiment, the lower portion of the pulsator connecting shaft 349*a* is not fixed to the connecting shaft upper plate portion 344*b*'. The connecting shaft upper plate portion 344*b*' is disposed inside the ring gear housing 345*a'*.

The carrier 344' includes a connecting shaft lower plate portion 344*c*' fixed to the lower end of the plurality of planetary gear rotation shafts 344*a'*.

The carrier 344' includes a carrier housing 344*e*' that accommodates the ring gear housing 345*a*' therein. The carrier housing 344*e*' is fixed to the connecting shaft lower plate portion 344*c*'. The carrier housing 344*e*' includes a carrier lateral housing 344*e*1' extended upward from the lateral end of the centrifugal direction of the connecting shaft lower plate portion 344*c*'. The carrier housing 344*e*' includes a carrier upper housing 344*e*2' extended in the opposite direction to the centrifugal side from the upper end portion of the carrier lateral housing 344*e*1'. The connecting shaft lower plate portion 344*c*' is fixed to the carrier lateral housing 344*e*1'. The carrier lateral housing 344*e*1' is fixed to the carrier upper housing 344*e*2'. The lower portion of the jig connecting shaft 349*d* is fixed to the carrier 344'. The lower portion of the jig connecting shaft 349*d* is fixed to the carrier housing 344*e*'. The lower portion of the jig connecting shaft 349*d* is fixed to the carrier upper housing 344*e*2'.

The ring gear 345' is fixed to the ring gear housing 345*a*'. The ring gear housing 345*a*' includes the ring gear lateral housing 345*a*1' forming an outer circumferential surface. The ring gear 345' is disposed in the lateral surface of the opposite direction to the centrifugal side of the ring gear lateral housing 345*a*1'.

The ring gear housing 345*a*' includes the ring gear upper housing 345*a*2' forming an upper side surface. The lower portion of the pulsator connecting shaft 349*b* is fixed to the ring gear upper housing 345*a*2'.

A protrusion protruding upward from the central portion of the ring gear upper housing 345*a*2' may be formed, and a groove recessed downward from the upper center of the protrusion of the ring gear upper housing 345*a*2' may be formed. The protrusion of the ring gear upper housing 345*a*2' may be formed in a pipe shape. The pulsator connecting shaft 349*b* may be inserted and fixed in the groove of the ring gear upper housing 345*a*2'.

Meanwhile, referring to FIGS. 1, 11, and 21, the movement path of water in the first, second, and third embodiments is as follows.

The washing water is supplied to the inside of the outer tub 110 through a washing water supply hose connected to a washing water supply unit. At this time, the detergent may be supplied to the inside of the outer tub 110 together with the washing water from a detergent supply unit.

The washing water supplied to the inside of the outer tub 110 flows into a space between the inner tub 120 and the outer tub 110 and is stored in the lower portion of the outer tub 110.

The washing water supplied to the lower portion of the outer tub 110 is introduced into the base 121 through the washing water inflow hole 124*a* of the hub 124. The washing water introduced into the base is pumped by the blade 123, passes through the washing water discharge portion 127 and the circulation duct 126, and is spouted into the inner tub 120 through the outflow port 128*a*1 of the filter housing 128*a*.

Thus, the washing water spouted to the upper portion of the inner tub 120 is spread widely, and easily wet the laundry. In addition, the washing water is evenly sprayed on the laundry that is not sunk but floats in the washing water of the inner tub, so that detergent is uniformly infiltrated into the laundry, thereby improving washing performance.

The washing water that wetted the laundry is moved to a space between the bottom surface of the inner tub 120 and the pulsator 122 through the through hole 122*a*1 of the pulsator 122, or permeates downward through a gap between the first step portion 121*b* of the base 121 and the outer circumferential portion of the pulsator 122 and moves to the space between the bottom surface of the inner tub 120 and the pulsator 122.

The washing water moved to the space between the bottom surface of the inner tub 120 and the pulsator 122 is pumped again by the blade 123.

Hereinafter, referring to FIGS. 9, 19A, 19B, 29A, and 29B, for each embodiment, in a state in which the washing shaft 132*a* is set relatively rotated with respect to the dewatering shaft 132*b* by the clutch 137, the transmission of the rotational force of the driving motor 130 will be described in detail as follows.

Figure 9:
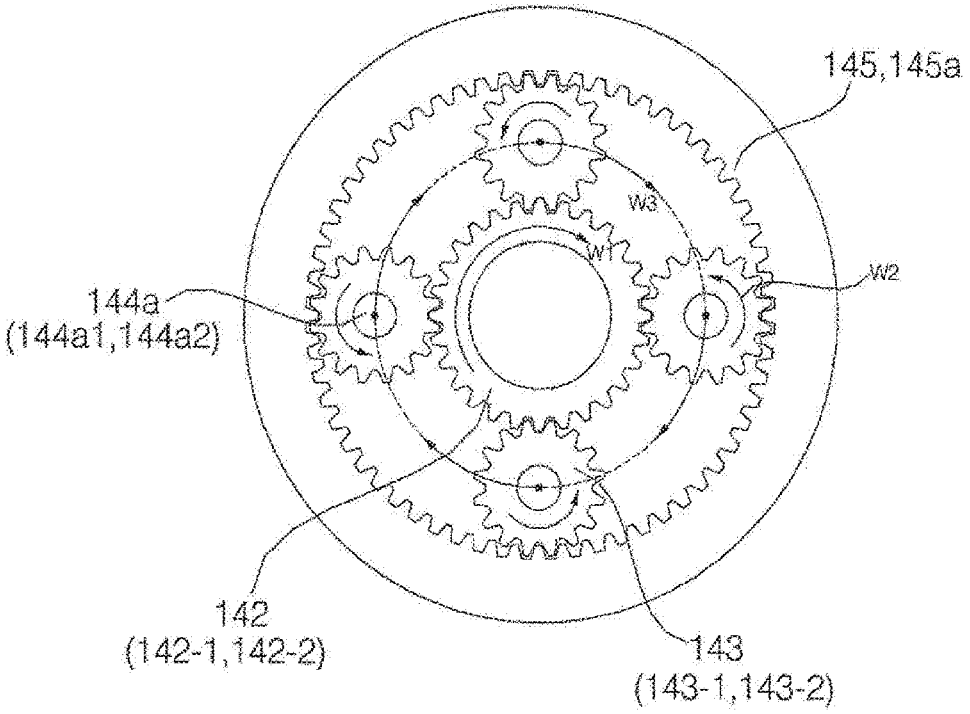
FIG. 9 is a conceptual sectional view of a gear module 142, 143, 144 and 145 of FIGS. 7A and 7B cut horizontally, and is view a showing a state where a sun gear 142, a planetary gear 143, and a ring gear 145 are engaged with each other and rotated when a washing shaft 132*a* relatively rotates with respect to a dewatering shaft 132*b*.

Hereinafter, the first embodiment will be described with reference to FIG. 9.

In this case, there is no relative rotational movement of the inner tub connecting shaft 149*c*, the ring gear housing 145*a*, the ring gear 145, and the dewatering shaft 132*b* with respect to the inner tub 120. In addition, in this case, the pulsator 122, the blade 123, the pulsator connecting shaft 149*a*, the blade connecting shaft 149*b*, the carrier 144, the first planetary gear 143-1, the second planetary gear 143-2, the first sun gear 142-1, the second sun gear 142-2, and the washing shaft 132*a* are relatively rotated with respect to the inner tub 120.

The rotational force generated by the driving motor 130 is transmitted from the washing shaft 132*a* to the first sun gear 142-1. The carrier 144 is rotated at a rotational speed lower than the rotational speed of the first sun gear 142-1 by the gear ratio of the first sun gear 142-1, the first planetary gear 143-1, and the ring gear 145. The rotational force of the carrier 144 is transmitted to the pulsator connecting shaft 149*a* and the rotational force of the pulsator connecting shaft 149*a* is transmitted to the pulsator 122.

Further, when the carrier 144 rotates, the second planetary gear 143-2 rotates while revolving around the second sun gear 142-2. The second sun gear 142-2 rotates by revolving and rotating the second planetary gear 143-2. The rotation direction of the second sun gear 142-2 is the same as the rotation direction of the first sun gear 142-1. The number of gear teeth of the first sun gear 142-1 and the number of gear teeth of the second sun gear 142-2 may be equal to each other and the number of gear teeth of the first planetary gear 143-1 and the number of gear teeth of the second planetary gear 143-2 may be equal to each other. In this case, the rotational speed of the first sun gear 142-1 is equal to the rotational speed of the second sun gear 142-2.

The rotational force of the second sun gear 142-2 is transmitted to the blade connecting shaft 149*b*, and the rotational force of the blade connecting shaft 149*b* is transmitted to the blade 123.

When the first sun gear 142-1 rotates in the first direction, the first planetary gear 143-1 rotates in a second direction and the carrier 144 rotates in a first direction. When the first sun gear 142-1 rotates at a first rotational speed w1, the first planetary gear 143-1 rotates at a second rotational speed w2 higher than the first rotational speed w1. When the first sun gear 142-1 rotates at the first rotational speed w1, the carrier 144 rotates at a third rotational speed w3 lower than the first rotational speed w1. When the carrier 144 rotates at the third rotational speed w3, the second planetary gear 143-2 may rotate at the second rotational speed w2 higher than the third rotational speed w3. When the carrier 144 rotates at the third rotational speed w3, the second sun gear 142-2 rotates at the first rotational speed w1 higher than the third rotational speed w3.

The blade connecting shaft 149*b* coupled to the second sun gear 142-2 and the blade 123 coupled to the blade connecting shaft 149*b* rotate integrally with the second sun gear 142-2. The blade 123 rotates at the same rotational speed w1 as the second sun gear 142-2.

The pulsator connecting shaft 149*a* coupled to the carrier 144 and the pulsator 122 coupled to the pulsator connecting shaft 149*a* rotate integrally with the carrier 144. The pulsator 122 rotates at the same rotational speed w3 as the carrier 144.

Hereinafter, it is described based on the 2-A embodiment of FIG. 19A.

In this case, there is no relative rotational movement of the inner tub connecting shaft 249*c*, the ring gear housing 245*a*, the ring gear 245, and the dewatering shaft 132*b* with respect to the inner tub 120. In addition, in this case, the pulsator 122, the blade 123, the pulsator connecting shaft 249*a*, the blade connecting shaft 249*b*, the carrier 244, the planetary gear 243, the sun gear 242, and the washing shaft 132*a* are relatively rotated with respect to the inner tub 120.

The rotational force generated by the driving motor 130 is transmitted from the washing shaft 132*a* to the sun gear 242. The rotational force of the sun gear 242 is transmitted to the blade connecting shaft 249*b*, and the rotational force of the blade connecting shaft 249*b* is transmitted to the blade 123.

The carrier 244 rotates at a rotational speed lower than the rotational speed of the sun gear 242 by the gear ratio of the sun gear 242 and the ring gear 245. The rotational force of the carrier 244 is transmitted to the pulsator connecting shaft 249*a* and the rotational force of the pulsator connecting shaft 249*a* is transmitted to the pulsator 122.

When the sun gear 242 rotates in the first direction, the planetary gear 243 rotates in a second direction and the carrier 244 rotates in the first direction. When the sun gear 242 rotates at the first rotational speed w1, the planetary gear 243 may rotate at the second rotational speed w2 higher than the first rotational speed w1. When the sun gear 242 rotates at the first rotational speed w1, the carrier 244 rotates at the third rotational speed w3 lower than the first rotational speed w1.

The blade connecting shaft 249*b* coupled to the sun gear 242 and the blade 123 coupled to the blade connecting shaft 249*b* rotate integrally with the sun gear 242. The blade 123 rotates at the same rotational speed w1 as the sun gear 242.

The pulsator connecting shaft 249*a* coupled to the carrier 244 and the pulsator 122 coupled to the pulsator connecting shaft 249*a* rotate integrally with the carrier 244. The pulsator 122 rotates at the same rotational speed w3 as the carrier 244.

Hereinafter, it is described based on the 2-B embodiment of FIG. 19B.

In this case, there is no relative rotational movement of the inner tub connecting shaft 249*c*, the carrier 244', the planetary gear 243', and the dewatering shaft 132*b* with respect to the inner tub 120. In addition, in this case, the pulsator 122, the blade 123, the pulsator connecting shaft 249*a*, the blade connecting shaft 249*b*, the ring gear housing 245*a'*, the ring gear 245', the sun gear 242, and the washing shaft 132*a* are relatively rotated with respect to the inner tub 120.

The rotational force generated by the driving motor 130 is transmitted from the washing shaft 132*a* to the sun gear 242. The rotational force of the sun gear 242 is transmitted to the blade connecting shaft 249*b*, and the rotational force of the blade connecting shaft 249*b* is transmitted to the blade 123.

The ring gear 245' rotates at a rotational speed lower than the rotational speed of the sun gear 242 by the gear ratio of the sun gear 242 and the ring gear 245'. The rotational force of the ring gear 245' is transmitted to the pulsator connecting shaft 249*a*, and the rotational force of the pulsator connecting shaft 249*a* is transmitted to the pulsator 122.

When the sun gear 242 rotates in the first direction, the planetary gear 243' rotates in the second direction and the ring gear 245' rotates in the second direction. When the sun gear 242 rotates at the first rotational speed w1, the planetary gear 243 may rotate at the second rotational speed w2 higher than the first rotational speed w1. When the sun gear 242 rotates at the first rotational speed w1, the carrier 244 rotates at the third rotational speed w3 lower than the first rotational speed w1.

The blade connecting shaft 249*b* coupled to the sun gear 242 and the blade 123 coupled to the blade connecting shaft 249*b* rotate integrally with the sun gear 242. The blade 123 rotates at the same rotational speed w1 as the sun gear 242.

The pulsator connecting shaft 249*a* coupled to the ring gear housing 245*a'* and the pulsator 122 coupled to the pulsator connecting shaft 249*a* rotate integrally with the ring gear 245'. The pulsator 122 rotates at the same rotational speed w3 as the ring gear 245'.

Hereinafter, it is described based on the 3-A embodiment of FIG. 29A.

In this case, there is no relative rotational movement of the inner tub connecting shaft 349*c*, the jig connecting shaft 349*d*, the gearbox housing 345*b*, the ring gear housing 345*a*, the ring gear 345, and the dewatering shaft 132*b* with respect to the inner tub 120. In addition, in this case, the pulsator 122, the blade 123, the pulsator connecting shaft 349*a*, the blade connecting shaft 349*b*, the carrier 344, the planetary gear 343, the sun gear 342, the sun gear housing 342*a*, and the washing shaft 132*a* are relatively rotated with respect to the inner tub 120.

The rotational force generated by the driving motor 130 is transmitted from the washing shaft 132*a* to the sun gear 342 and the sun gear housing 342*a*. The rotational force of the sun gear housing 342*a* is transmitted to the blade connecting shaft 349*b*, and the rotational force of the blade connecting shaft 349*b* is transmitted to the blade 123.

The carrier 344 rotates at a rotational speed lower than the rotational speed of the sun gear 342 by the gear ratio of the sun gear 342 and the ring gear 345. The rotational force of the carrier 344 is transmitted to the pulsator connecting shaft 349*a* and the rotational force of the pulsator connecting shaft 349*a* is transmitted to the pulsator 122.

When the sun gear 342 and the sun gear housing 342*a* rotate in the first direction, the planetary gear 343 rotates in the second direction and the carrier 344 rotates in the first direction. When the sun gear 342 and the sun gear housing 342*a* rotate at the first rotational speed w1, the planetary gear 343 may rotate at the second rotational speed w2 higher than the first rotational speed w1. When the sun gear 342 and the sun gear housing 342*a* rotate at the first rotational speed w1, the carrier 344 rotates at the third rotational speed w3 lower than the first rotational speed w1.

The blade connecting shaft 349*b* coupled to the sun gear housing 342*a* and the blade 123 coupled to the blade connecting shaft 349*b* rotate integrally with the sun gear housing 342*a*. The blade 123 rotates at the same rotational speed w1 as the sun gear housing 342*a*.

The pulsator connecting shaft 349*a* coupled to the carrier 344 and the pulsator 122 coupled to the pulsator connecting shaft 349*a* rotate integrally with the carrier 344. The pulsator 122 rotates at the same rotational speed w3 as the carrier 344.

Hereinafter, it is described based on the 3-B embodiment of FIG. 29B.

In this case, there is no relative rotational movement of the inner tub connecting shaft 349*c*, the jig connecting shaft 349*d*, the gearbox housing 345*b*, the carrier 344', the planetary gear 343', and the dewatering shaft 132*b* with respect to the inner tub 120. In addition, in this case, the pulsator 122, the blade 123, the pulsator connecting shaft 349*a*, the blade connecting shaft 349*b*, the ring gear housing 345*a'*, the ring gear 345', the sun gear 342, the sun gear housing 342*a*, and the washing shaft 132*a* are relatively rotated with respect to the inner tub 120.

The rotational force generated by the driving motor 130 is transmitted from the washing shaft 132*a* to the sun gear 342 and the sun gear housing 342*a*. The rotational force of the sun gear housing 342*a* is transmitted to the blade connecting shaft 349*b*, and the rotational force of the blade connecting shaft 349*b* is transmitted to the blade 123.

The ring gear 345' rotates at a rotational speed lower than the rotational speed of the sun gear 342 by the gear ratio of the sun gear 342 and the ring gear 345'. The rotational force of the ring gear 345' is transmitted to the pulsator connecting shaft 349*a*, and the rotational force of the pulsator connecting shaft 349*a* is transmitted to the pulsator 122.

When the sun gear 342 and the sun gear housing 342*a* rotate in the first direction, the planetary gear 343' rotates in the second direction and the ring gear 345' rotates in the second direction. When the sun gear 342 rotates at the first rotational speed w1, the planetary gear 343 may rotate at the second rotational speed w2 higher than the first rotational speed w1. When the sun gear 342 rotates at the first rotational speed w1, the carrier 344 rotates at the third rotational speed w3 lower than the first rotational speed w1.

The blade connecting shaft 349*b* coupled to the sun gear housing 342*a* and the blade 123 coupled to the blade connecting shaft 349*b* rotate integrally with the sun gear housing 342*a*. The blade 123 rotates at the same rotational speed w1 as the sun gear housing 342*a*.

The pulsator connecting shaft 349*a* coupled to the ring gear housing 345*a'* and the pulsator 122 coupled to the pulsator connecting shaft 349*a* rotate integrally with the ring gear 345'. The pulsator 122 rotates at the same rotational speed w3 as the ring gear 345'.

Figure 10:
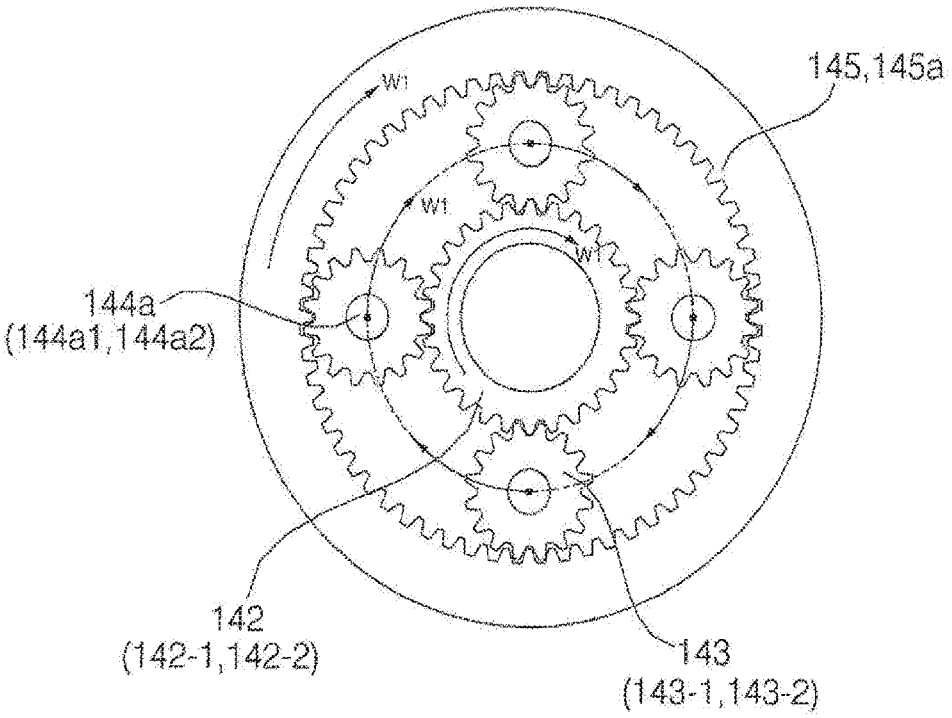
FIG. 10 is a conceptual sectional view of a gear module 142, 143, 144 and 145 of FIGS. 7A and 7B cut horizontally, and is view a showing a state where a sun gear 142, a planetary gear 143, and a ring gear 145 are integrally rotated when a dewatering shaft 132*b* and a washing shaft 132*a* are integrally rotated.
Figure 20:
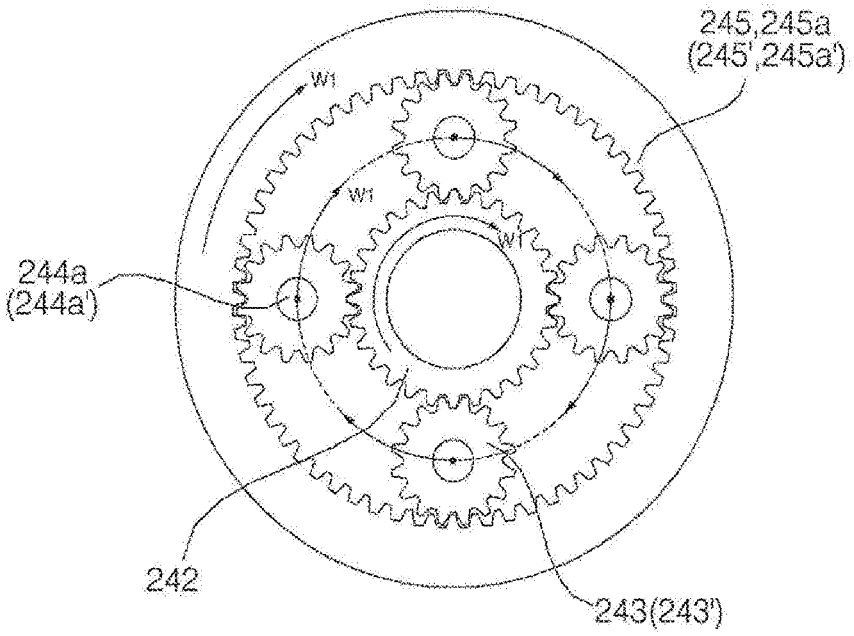
FIG. 20 is a conceptual sectional view of a gear module of FIG. 16A or 16B cut horizontally, and is view a showing a state where a sun gear 242, a carrier 244, 244', and a ring gear 245, 245' are integrally rotated when a dewatering shaft 132*b* and a washing shaft 132*a* are integrally rotated.
Figure 30:
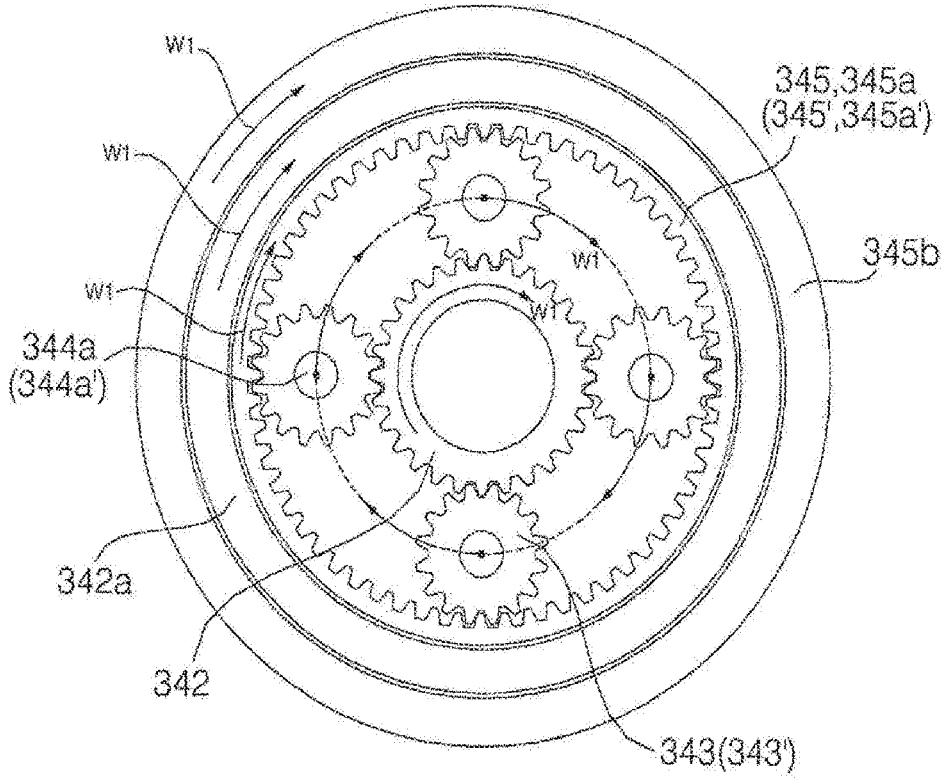
FIG. 30 is a conceptual sectional view of a gear module of FIG. 26A or 6B cut horizontally, and is view a showing a state where a sun gear 342, a carrier 344, 344', and a ring gear 345, 345' are integrally rotated when a dewatering shaft 132*b* and a washing shaft 132*a* are integrally rotated.

Hereinafter, referring to FIGS. 10, 20, and 30, for each embodiment, in a state in which the dewatering shaft 132*b* is set relatively rotated with the washing shaft 132*a* by the clutch 137, the transmission of the rotational force of the driving motor 130 will be described in detail as follows.

Hereinafter, the first embodiment will be described with reference to FIG. 10.

In this case, there is no relative rotational movement of the pulsator 122, the blade 123, the pulsator connecting shaft 149*a*, the blade connecting shaft 149*b*, the inner tub connecting shaft 149*c*, the ring gear housing 145*a*, the ring gear 145, the carrier 144, the first planetary gear 143-1, the second planetary gear 143-2, the first sun gear 142-1, the second sun gear 142-2, the washing shaft 132*a*, and the dewatering shaft 132*b* with respect to the inner tub 120.

The rotational force generated by the driving motor 130 is transmitted from the washing shaft 132*a* to the dewatering shaft 132*b*. The rotational force of the washing shaft 132*a* is transmitted to the first sun gear 142-1 and the rotational force of the dewatering shaft 132*b* is transmitted to the ring gear housing 145*a*. The first sun gear 142-1 and the ring gear 145 fixed to the ring gear housing 145*a* are rotated at the same rotational speed w1, so that the first planetary gear 143-1 does not rotate and the carrier 144 rotates at the same rotational speed w1 as the first sun gear 142-1. Further, since the carrier 144 and the ring gear 145 rotate at the same rotational speed w1, the second planetary gear 143-2 does not rotate. Since the second planetary gear 143-2 does not rotate and the carrier 144 rotates, the second sun gear 142-2 rotates at the same rotational speed w1 as the carrier 144.

The rotational force of the carrier 144 is transmitted to the pulsator connecting shaft 149*a* and the rotational force of the pulsator connecting shaft 149*a* is transmitted to the pulsator 122. The rotational force of the second sun gear 142-2 is transmitted to the blade connecting shaft 149*b* and the rotational force of the blade connecting shaft 149*b* is transmitted to the blade 123. The rotational force of the ring gear 145 and the ring gear housing 145*a* is transmitted to the inner tub connecting shaft 149*c*, and the rotational force of the inner tub connecting shaft 149*c* is transmitted to the inner tub 120.

When the first sun gear 142-1 rotates in the first direction, the first planetary gear 143-1 does not rotate and the carrier 144 rotates in the first direction. When the first sun gear 142-1 rotates at the first rotational speed w1, the carrier 144 rotates at the first rotational speed w1 which is the same rotational speed as the first sun gear 142-1. When the first sun gear 142-1 rotates at the first rotational speed w1, the ring gear 145 rotates at the first rotational speed w1 which is the same rotational speed as the first sun gear 142-1. When the carrier 144 and the ring gear 145 rotate at the first rotation speed w3, the second planetary gear 143-2 does not rotate. When the carrier 144 rotates at the first rotational speed w1 and the second planetary gear 143-2 does not rotate, the second sun gear 142-2 rotates at the first rotational speed w1 which is the same rotational speed as the carrier 144.

The blade connecting shaft 149*b* coupled to the second sun gear 142-2 and the blade 123 coupled to the blade connecting shaft 149*b* rotate integrally with the second sun gear 142-2. The blade 123 rotates at the same rotational speed w1 as the second sun gear 142-2.

The pulsator connecting shaft 149*a* coupled to the carrier 144 and the pulsator 122 coupled to the pulsator connecting shaft 149*a* rotate integrally with the carrier 144. The pulsator 122 rotates at the same rotational speed w1 as the carrier 144.

The inner tub connecting shaft 149*c* coupled to the ring gear housing 145*a* and the inner tub 120 coupled to the inner tub connecting shaft 149*c* rotate integrally with the ring gear housing 145*a*. The inner tub 120 rotates at the same rotational speed w1 as the ring gear housing 145*a*.

Hereinafter, the second embodiment will be described with reference to FIG. 20.

In this case, there is no relative rotational movement of the pulsator 122, the blade 123, the pulsator connecting shaft 249*a*, the blade connecting shaft 249*b*, the inner tub connecting shaft 249*c*, the ring gear housing 245*a*, 245*a*', the ring gear 245, 245', the carrier 244, 244', the planetary gear 243, the sun gear 242, the washing shaft 132*a*, and the dewatering shaft 132*b* with respect to the inner tub 120.

The rotational force generated by the driving motor 130 is transmitted from the washing shaft 132*a* to the dewatering shaft 132*b*. The rotational force of the washing shaft 132*a* is transmitted to the sun gear 242. The rotational force of the sun gear 242 is transmitted to the blade connecting shaft 249*b*, and the rotational force of the blade connecting shaft 249*b* is transmitted to the blade 123.

In the 2-A embodiment, the rotational force of the dewatering shaft 132*b* is transmitted to the ring gear housing 245*a*. Since the sun gear 242 and the ring gear 245 rotate at the same rotational speed w1, the planetary gear 243 does not rotate and the carrier 244 rotates at the same rotational speed w1 as the sun gear 242. The rotational force of the carrier 244 is transmitted to the pulsator connecting shaft 249*a*, and the rotational force of the pulsator connecting shaft 249*a* is transmitted to the pulsator 122. The rotational force of the ring gear 245 and the ring gear housing 245*a* is transmitted to the inner tub connecting shaft 249*c*, and the rotational force of the inner tub connecting shaft 249*c* is transmitted to the inner tub 120.

In the 2-B embodiment, the rotational force of the dewatering shaft 132*b* is transmitted to the carrier 244' Since the sun gear 242 and the carrier 244' rotate at the same rotational speed w1, the planetary gear 243' does not rotate and the ring gear 245' is rotated at the same rotational speed w1 as the sun gear 242. The ring gear 245' rotates at the same rotational speed w1 as the sun gear 242. The rotational force of the carrier 244' is transmitted to the inner tub connecting shaft 249*c*, and the rotational force of the inner tub connecting shaft 249*c* is transmitted to the inner tub 120. The rotational force of the ring gear 245' and the ring gear housing 245*a*' is transmitted to the pulsator connecting shaft 249*a* and the rotational force of the pulsator connecting shaft 249*a* is transmitted to the pulsator 122.

In the 2-A and 2-B embodiments, when the sun gear 242 rotates in the first direction, the planetary gear 243, 243' does not rotate and the carrier 244, 244' rotates in the first direction. When the sun gear 242 rotates at the first rotational speed w1, the carrier 244, 244' rotates at the first rotational speed w1 which is the same rotational speed as the sun gear 242. When the sun gear 242 rotates at the first rotational speed w1, the ring gear 245, 245' rotates at the first rotational speed w1 which is the same rotational speed as the sun gear 242. The blade connecting shaft 249*b* coupled to the sun gear 242 and the blade 123 coupled to the blade connecting shaft 249*b* rotate integrally with the sun gear 242. The blade 123 rotates at the same rotational speed w1 as the sun gear 242. The pulsator connecting shaft 249*a* and the inner tub connecting shaft 249*c* respectively coupled to any one of the carrier 244, 244' and the ring gear housing 245*a*, 245*a*' rotate at the same rotational speed w1 as the carrier 244, 244' and the ring gear housing 245*a*, 245*a*'. The pulsator 122 and the inner tub 120 rotate at the same rotational speed w1 as the carrier 244, 244' and the ring gear housing 245*a*, 245*a'*.

Hereinafter, the third embodiment will be described with reference to FIG. 30.

In this case, there is no relative rotational movement of the pulsator 122, the blade 123, the pulsator connecting shaft 349*a*, the blade connecting shaft 349*b*, the inner tub connecting shaft 349*c*, the jig connecting shaft 349*d*, the gear box housing 345*b*, the ring gear housing 345*a*, 345*a*', the ring gear 345, 345', the carrier 344, 344', the planetary gear 343, the sun gear 342, the washing shaft 132*a*, and the dewatering shaft 132*b* with respect to the inner tub 120.

The rotational force generated by the driving motor 130 is transmitted from the washing shaft 132*a* to the dewatering shaft 132*b*. The rotational force of the washing shaft 132*a* is transmitted to the sun gear 342 and the sun gear housing 342*a*. The rotational force of the sun gear housing 342*a* is transmitted to the blade connecting shaft 349*b*, and the rotational force of the blade connecting shaft 349*b* is transmitted to the blade 123.

The rotational force of the dewatering shaft 132*b* is transmitted to the gearbox housing 345*b*. The rotational force of the gear box housing 345*b* is transmitted to the inner tub connecting shaft 349*c* and the rotational force of the inner tub connecting shaft 349*c* is transmitted to the inner tub 120. The rotational force of the inner tub 120 is transmitted to the jig 346 and the rotational force of the jig 346 is transmitted to the jig connecting shaft 349*d*.

In the 3-A embodiment, the rotational force of the jig connecting shaft 349*d* is transmitted to the ring gear housing 345*a*. Since the sun gear 342 and the ring gear 345 rotate at the same rotational speed w1, the planetary gear 343 does not rotate and the carrier 344 rotates at the same rotational speed w1 as the sun gear 342. The rotational force of the carrier 344 is transmitted to the pulsator connecting shaft 349*a*, and the rotational force of the pulsator connecting shaft 349*a* is transmitted to the pulsator 122.

In the 3-B embodiment, the rotational force of the jig connecting shaft 349*d* is transmitted to the carrier 344'. Since the sun gear 342 and the carrier 344' rotate at the same rotational speed w1, the planetary gear 343' does not rotate and the ring gear 345' is rotated at the same rotational speed w1 as the sun gear 342. The rotational force of the ring gear 345' and the ring gear housing 345*a*' is transmitted to the pulsator connecting shaft 349*a*, and the rotational force of the pulsator connecting shaft 349*a* is transmitted to the pulsator 122.

In the 3-A and 3-B embodiments, when the sun gear 342 and the sun gear housing 342*a* rotate in the first direction, the planet gear 343, 343' does not rotate and the carrier 344, 344' rotate in the first direction. When the sun gear 342 and the sun gear housing 342*a* are rotated at the first rotational speed w1, the carrier 344, 344' is rotated at the first rotational speed w1 that is the same rotational speed as the sun gear 342 and the sun gear housing 342*a*. When the sun gear 342 and the sun gear housing 342*a* are rotated at the first rotational speed w1, the ring gear 345, 345' is rotated at the first rotational speed w1 that is the same rotational speed as the sun gear 342 and the sun gear housing 342*a*. The blade connecting shaft 349*b* coupled to the sun gear housing 342*a* and the blade 123 coupled to the blade connecting shaft 349*b* rotate integrally with the sun gear housing 342*a*. The blade 123 rotates at the same rotational speed w1 as the sun gear 342 and the sun gear housing 342*a*. The pulsator connecting shaft 349*a* and the jig connecting shaft 349*d* respectively coupled to the carrier 344, 344' and the ring gear housing 345*a*, 345*a*' rotate at the same rotational speed w1 as the carrier 344, 344' and the ring gear housing 345*a*, 345*a*'. The pulsator 122 and the inner tub 120 rotate at the same rotational speed w1 as the carrier 344, 344' and the ring gear housing 345*a*, 345*a*'. In addition, the gearbox housing 345*b* rotates at the same rotational speed w1 as the sun gear 342.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

The invention claimed is:

1. A laundry processing apparatus comprising:

an outer tub which accommodates washing water therein;

an inner tub which is disposed inside the outer tub;

a pulsator which is provided in a lower portion of the inner tub;

a blade which is provided below the pulsator;

a driving motor which is disposed outside the outer tub and rotates a washing shaft;

a pulsator connecting shaft which rotates the pulsator, and is disposed to penetrate a lower side surface of the outer tub;

a blade connecting shaft which rotates the blade, and is disposed to penetrate the lower side surface of the outer tub; and a gear module which is disposed outside the outer tub, and transmits a rotational force of the washing shaft to the pulsator connecting shaft and the blade connecting shaft, wherein the gear module comprises:

a first sun gear to which the washing shaft is fixed;

a second sun gear to which the blade connecting shaft is fixed;

a plurality of first planetary gears which are engaged and rotated with an outer circumferential surface of the first sun gear;

a plurality of second planetary gears which are engaged and rotated with an outer circumferential surface of the second sun gear;

a carrier which has a plurality of first planetary gear rotation shafts, which are connected to each other, that penetrate a central portion of the plurality of first planetary gears respectively, and has a plurality of second planetary gear rotation shafts, which are connected to each other, that penetrate a central portion of the plurality of second planetary gears respectively such that the plurality of first planetary gear rotation shafts and the plurality of second planetary gear rotation shafts are connected to each other; and a ring gear which is internally in contact with and engaged with the plurality of first planetary gears and the plurality of second planetary gears simultaneously, wherein the blade connecting shaft rotates integrally with the second sun gear, and the pulsator connecting shaft rotates integrally with the carrier.

2. The laundry processing apparatus of claim 1, wherein the pulsator connecting shaft is disposed to penetrate a center of the blade connecting shaft.

3. The laundry processing apparatus of claim 1, wherein the gear module is provided in such a manner that the blade connecting shaft is rotated in a same rotation direction and at a same rotation speed as the washing shaft, and the pulsator connecting shaft is rotated at a rotation speed lower than the rotation speed of the washing shaft.

4. The laundry processing apparatus of claim 1, wherein the blade is provided to pump the washing water upward to an upper end of the inner tub, and is disposed to be all covered by the pulsator when viewed from an upper side of the pulsator.

5. The laundry processing apparatus of claim 1, further comprising a driving motor support member which is fixed to a lower side surface of the outer tub to support the driving motor, and accommodates the gear module.

6. The laundry processing apparatus of claim 1, further comprising:

a dewatering shaft to which the washing shaft is disposed to penetrate;

a clutch which switches an integral rotation of the dewatering shaft and the washing shaft; and an inner tub connecting shaft which has an upper portion that is fixed to the inner tub, and is disposed to penetrate the lower side surface of the outer tub, wherein the gear module transmits a rotational force of the dewatering shaft to the inner tub connecting shaft.

7. The laundry processing apparatus of claim 6, wherein the pulsator connecting shaft and the blade connecting shaft are disposed to penetrate a center of the inner tub connecting shaft.

8. The laundry processing apparatus of claim 1, further comprising:

an inner tub connecting shaft which has an upper portion which is fixed to the inner tub, and is disposed to penetrate the lower side surface of the outer tub, wherein the ring gear is integrally and rotatably connected with the inner tub connecting shaft.

9. The laundry processing apparatus of claim 1, further comprising:

a dewatering shaft to which the washing shaft is disposed to penetrate;

a clutch which switches an integral rotation of the dewatering shaft and the washing shaft; and an inner tub connecting shaft which has an upper portion that is fixed to the inner tub, and is disposed to penetrate the lower side surface of the outer tub, wherein the gear module comprises a ring gear housing which has an inner side surface to which the ring gear is fixed, to which an upper portion of the dewatering shaft is fixed, and to which a lower portion of the inner tub connecting shaft is fixed.

10. The laundry processing apparatus of claim 1, wherein a lower portion of the pulsator connecting shaft is fixed to the carrier.

11. The laundry processing apparatus of claim 1, wherein the pulsator connecting shaft is disposed to penetrate the blade connecting shaft and the second sun gear, wherein the carrier includes a center connecting portion to which a lower portion of the pulsator connecting shaft, an upper end of the plurality of first planetary gear rotation shafts, and a lower end of the plurality of second planetary gear rotation shafts are fixed.

12. The laundry processing apparatus of claim 11, wherein the first sun gear is disposed below the center connecting portion, wherein the second sun gear is disposed above the center connection portion.

13. The laundry processing apparatus of claim 1, wherein the gear module further comprises a ring gear housing having an inner surface to which the ring gear is fixed.

14. The laundry processing apparatus of claim 13, further comprising:

a dewatering shaft which has an upper portion that is fixed to the ring gear housing;

a clutch which switches an integral rotation of the dewatering shaft and the washing shaft; and an inner tub connecting shaft which has an upper portion that is fixed to the inner tub, and is disposed to penetrate the lower side surface of the outer tub, wherein a lower portion of the inner tub connecting shaft is fixed to the ring gear housing.

15. The laundry processing apparatus of claim 13, wherein the washing shaft is disposed to penetrate a lower side surface of the ring gear housing, wherein the blade connecting shaft is disposed to penetrate an upper side surface of the ring gear housing.

16. The laundry processing apparatus of claim 13, wherein a lower portion of the pulsator connecting shaft is fixed to the carrier, wherein the blade connecting shaft is disposed to penetrate an upper side surface of the ring gear housing.

* * * * *